US008257512B1

(12) United States Patent
Branagan et al.

(10) Patent No.: US 8,257,512 B1
(45) Date of Patent: Sep. 4, 2012

(54) CLASSES OF MODAL STRUCTURED STEEL WITH STATIC REFINEMENT AND DYNAMIC STRENGTHENING AND METHOD OF MAKING THEREOF

(75) Inventors: Daniel James Branagan, Idaho Falls, ID (US); Brian E. Meacham, Idaho Falls, ID (US); Jason K. Walleser, Idaho Falls, ID (US); Andrew T. Ball, Ammom, ID (US); Grant G. Justice, Idaho Falls, ID (US); Brendan L. Nation, Idaho Falls, ID (US); Sheng Cheng, Idaho Falls, ID (US); Alla V. Sergueeva, Idaho Falls, ID (US)

(73) Assignee: The Nanosteel Company, Inc., Providence, RI (US)

( * ) Notice: Subject to any disclaimer, the term of this patent is extended or adjusted under 35 U.S.C. 154(b) by 0 days.

(21) Appl. No.: 13/354,924

(22) Filed: Jan. 20, 2012

Related U.S. Application Data

(60) Provisional application No. 61/586,951, filed on Jan. 16, 2012, provisional application No. 61/488,558, filed on May 20, 2011.

(51) Int. Cl.

| | |
|---|---|
| ***C22C 38/54*** | (2006.01) |
| ***C22C 38/34*** | (2006.01) |
| ***C21D 6/00*** | (2006.01) |
| ***C21D 7/00*** | (2006.01) |
| ***C21D 9/00*** | (2006.01) |

(52) U.S. Cl. ..... 148/326; 148/325; 148/327; 148/328; 148/330; 148/579; 148/648

(58) Field of Classification Search ..... 148/579, 148/648, 325, 326, 327, 328, 330; 420/50, 420/64, 106

See application file for complete search history.

(56) References Cited

U.S. PATENT DOCUMENTS

| | | | | |
|---|---|---|---|---|
| 4,297,135 | A * | 10/1981 | Giessen et al. | 148/321 |
| 4,576,653 | A * | 3/1986 | Ray | 419/61 |
| 6,689,234 | B2 | 2/2004 | Branagan | |
| 6,767,419 | B1 | 7/2004 | Branagan | |
| 7,323,071 | B1 | 1/2008 | Branagan | |
| 8,133,333 | B2 * | 3/2012 | Branagan et al. | 148/561 |

* cited by examiner

*Primary Examiner* — Deborah Yee

(74) *Attorney, Agent, or Firm* — Grossman, Tucker, Perreault & Pfleger PLLC

(57) ABSTRACT

The present disclosure is directed at formulations and methods to provide new steel alloys having relatively high strength and ductility. The alloys may be provided in sheet or pressed form and characterized by their particular alloy chemistries and identifiable crystalline grain size morphology. The alloys are such that they include boride grains present as pinning phases. Mechanical properties of the alloys in what is termed a Class 1 Steel indicate yield strengths of 300 MPa to 840 MPa, tensile strengths of 630 to 1100 MPa and elongations of 10% to 40%. In what is termed a Class 2 steel, the alloys indicate yield strengths of 300 MPa to 1300 MPa, tensile strengths of 720 MPa to 1580 MPa and elongations of 5% to 35%.

27 Claims, 62 Drawing Sheets

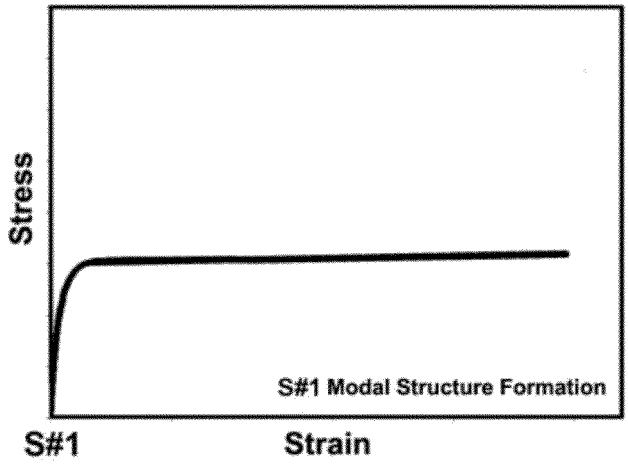
FIG. 4 Model stress-strain curve illustrating the mechanical response of materials with Structure #1: Modal phase formation. Modal Structure may support relatively high ductility but no strengthening may occur.

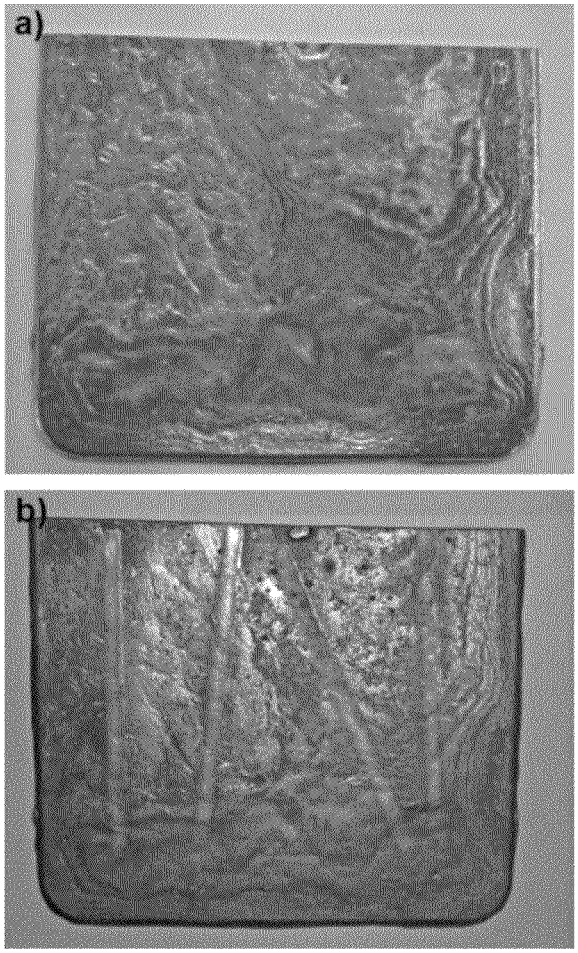
FIG. 6 Pictures of Alloy 19 sheet; a) As-cast, b) After HIP cycle at 1150°C for 1 hour.

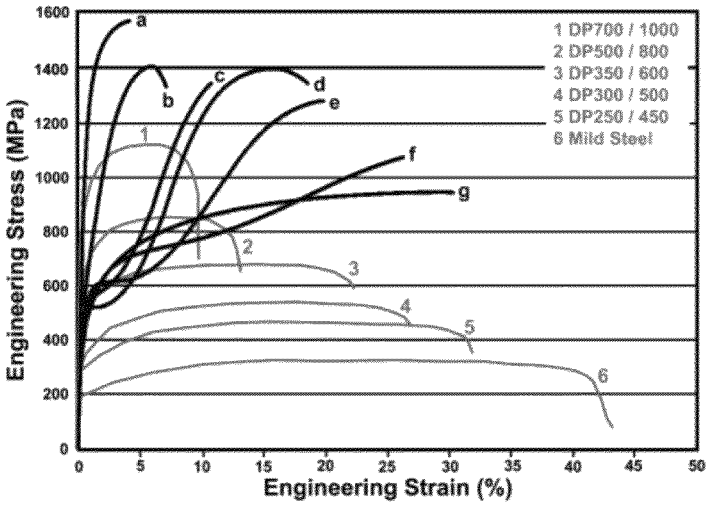
FIG. 7 Comparison of stress-strain curves of new steel sheet types with existing Dual Phase (DP) steels.
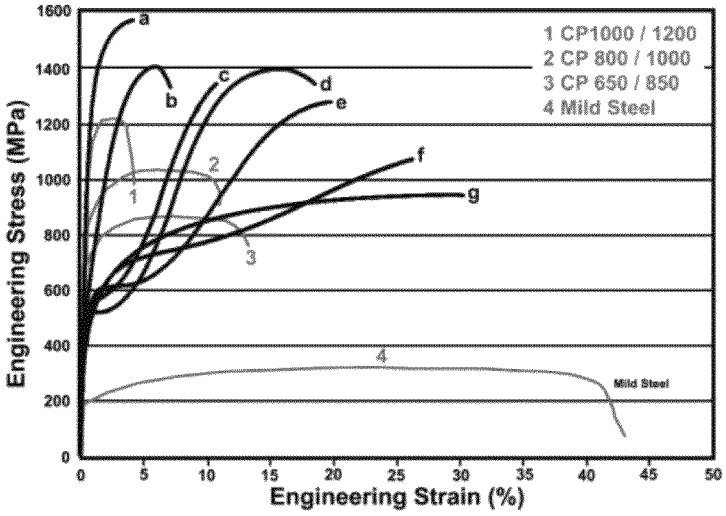
FIG. 8 Comparison of stress-strain curves of new steel sheet types with existing Complex Phase (CP) steels.

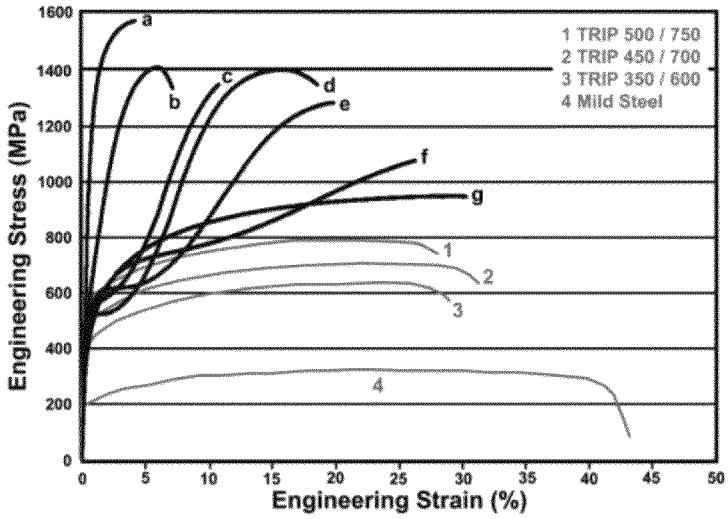
FIG. 9 Comparison of stress-strain curves of new steel sheet types with existing Transformation Induced Plasticity (TRIP) steels.
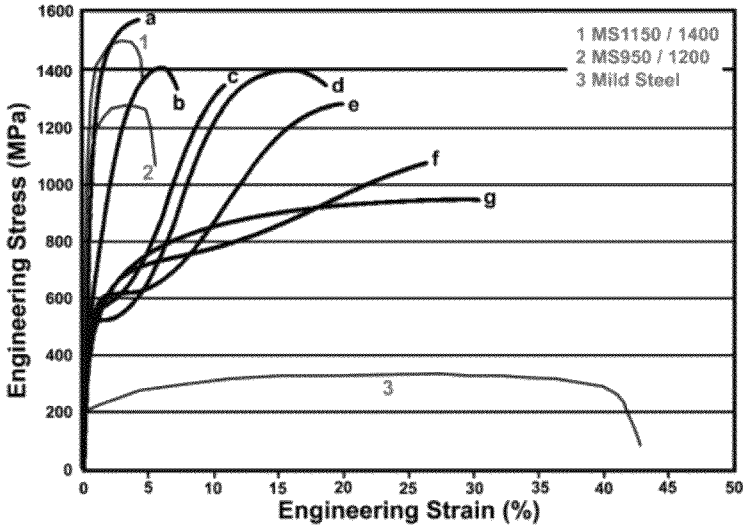
FIG. 10 Comparison of stress-strain curves of new steel sheet types with existing Martensitic (MS) steels.

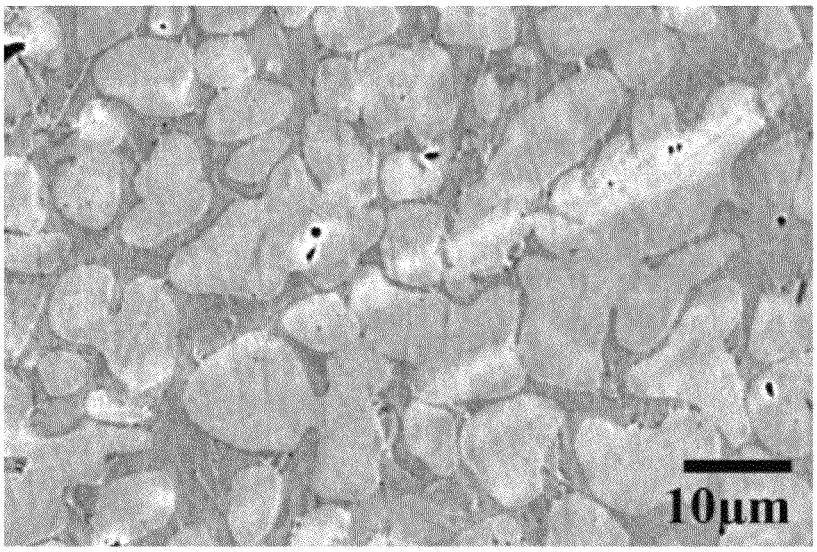
FIG. 11. SEM micrograph of Modal Structure of Alloy 2.

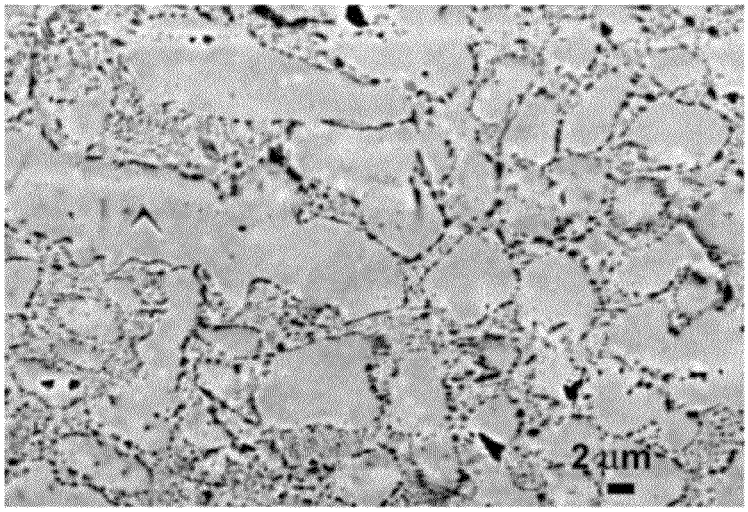
FIG. 14
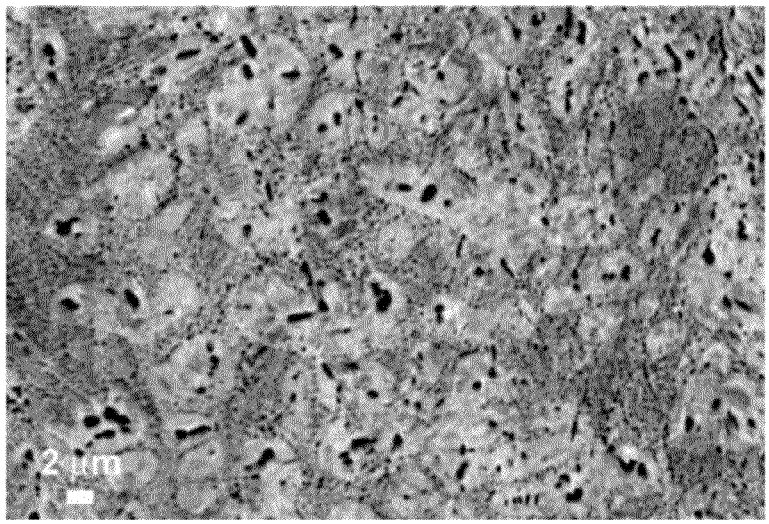
FIG. 15 SEM micrograph of the NanoModal Structure in the sheet from Alloy 14 after HIP cycle at 1000°C for 1 hr and annealing at 350°C for 20 min.

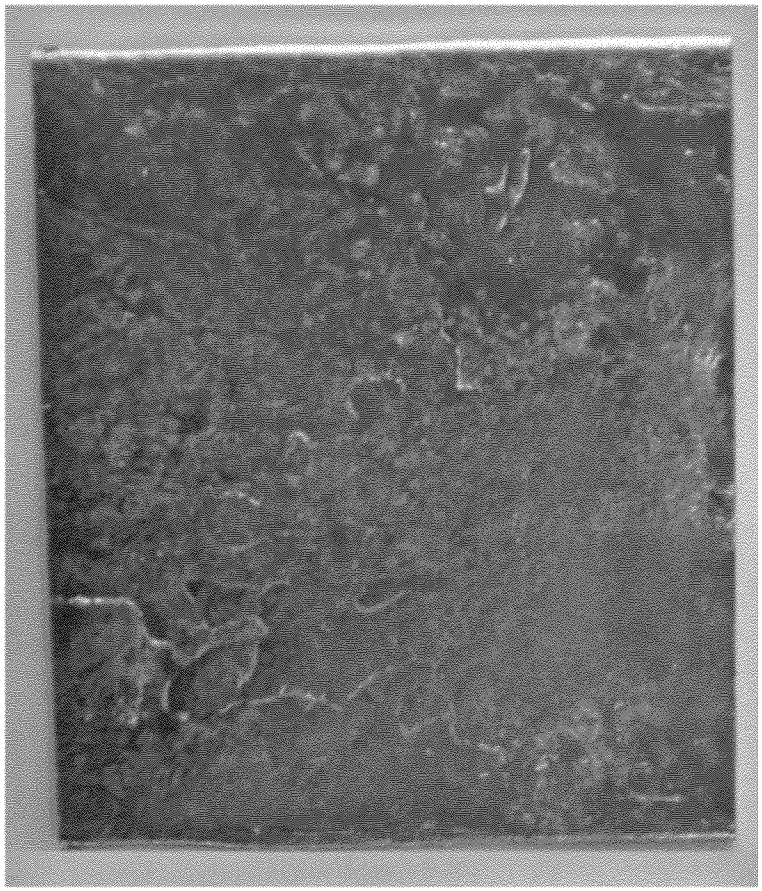
FIG. 16 Picture of as-cast Alloy 1 sheet.

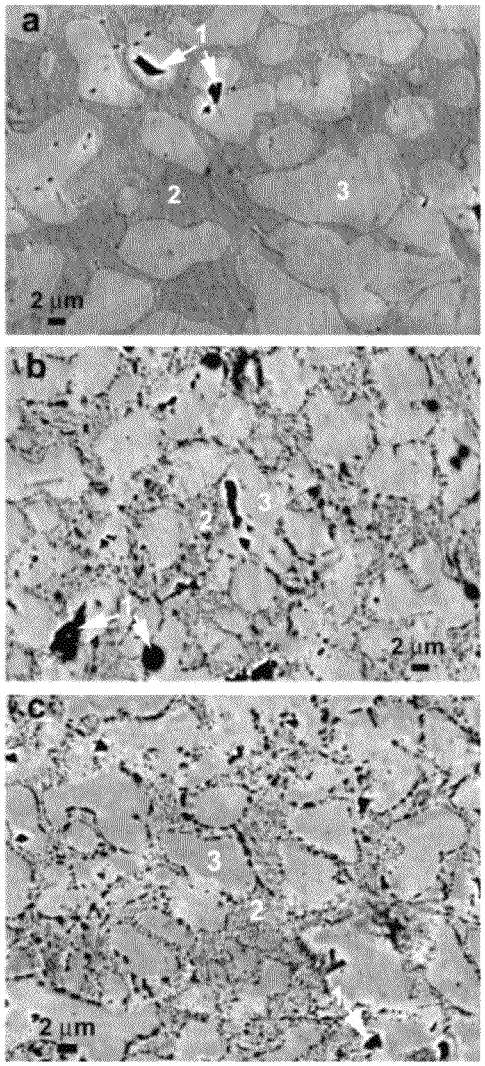
FIG. 17 SEM backscattered electron micrographs of the Alloy 1 sheet sample; a) As-Cast, b) HIPed at 1000°C for 1 hour, and c) HIPed at 1000°C for 1 hour and heat treated at 350°C for 20 minutes.

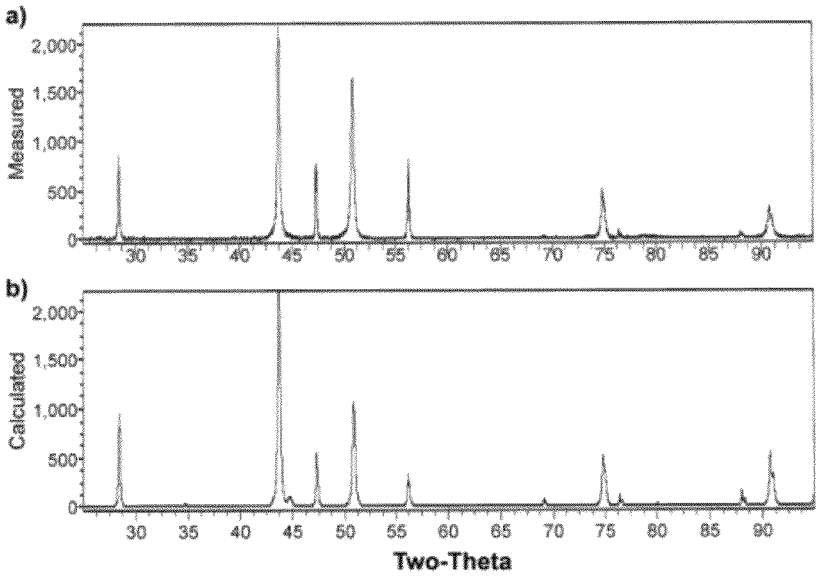
FIG. 18 X-ray diffraction data (intensity vs two-theta) for Alloy 1 sheet in the as-cast condition; a) Measured pattern, b) Rietveld calculated pattern.

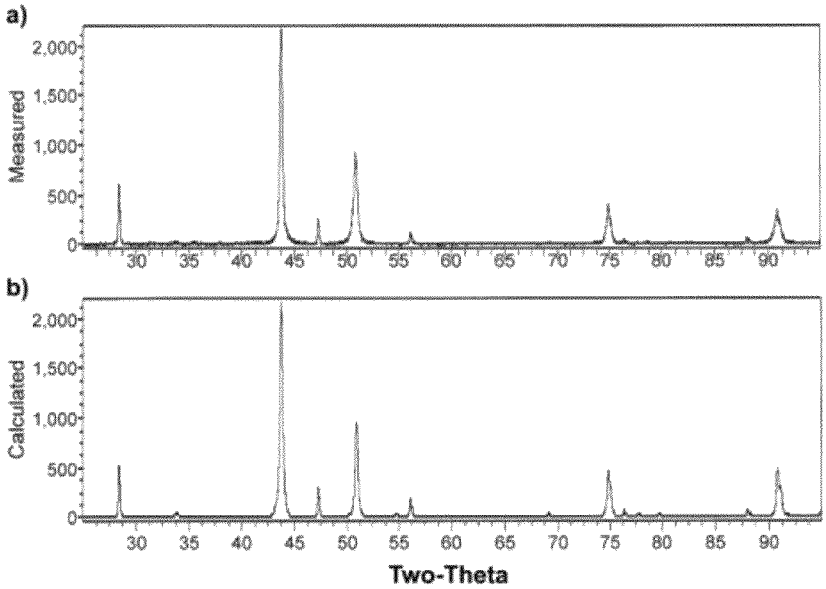
FIG. 19 X-ray diffraction data (intensity vs two-theta) for Alloy 1 sheet in the HIPed condition (1000°C for 1 hour); a) Measured pattern, b) Rietveld calculated pattern with peaks identified.

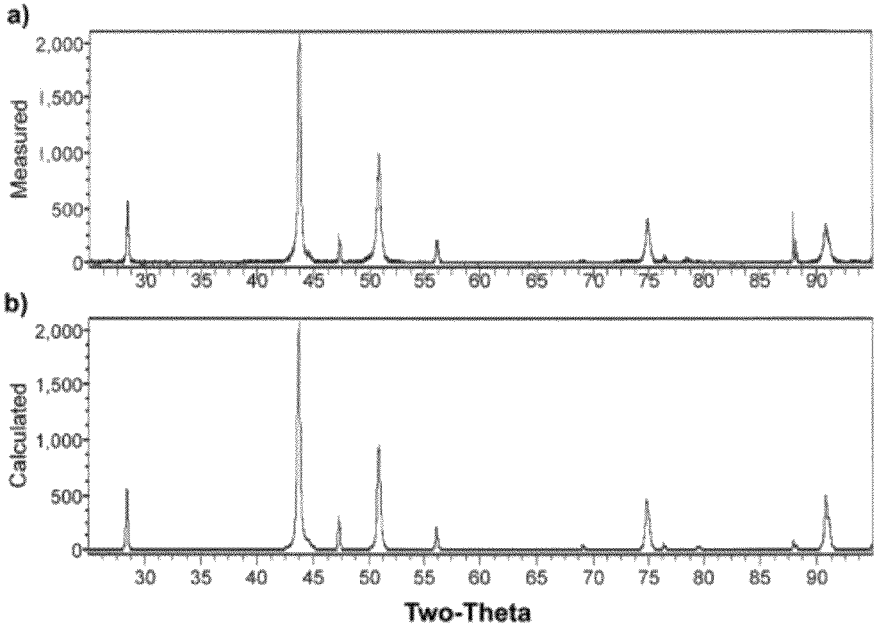
FIG. 20 X-ray diffraction data (intensity vs two-theta) for Alloy 1 sheet in the HIPed (1000°C for 1 hour) and heat treated condition (350°C for 20 minutes); a) Measured pattern, b) Rietveld calculated pattern with peaks identified.

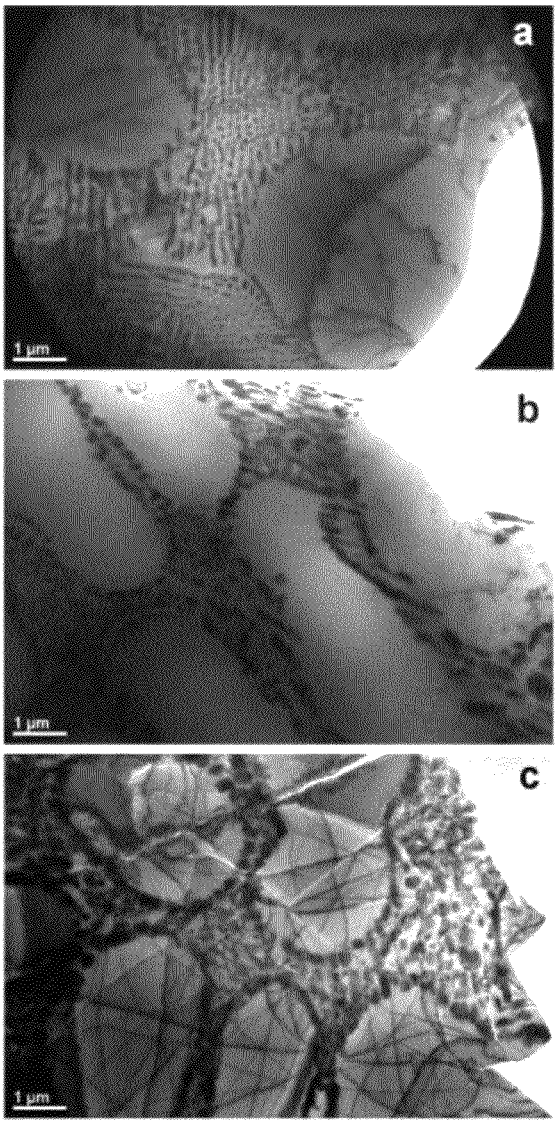
FIG. 21 TEM micrographs of the Alloy 1 sheet sample; a) As-Cast, b) HIPed at 1000°C for 1 hour, and c) HIPed at 1000°C for 1 hour and heat treated at 350°C for 20 minutes. Observations are consistent with SEM analysis results confirming

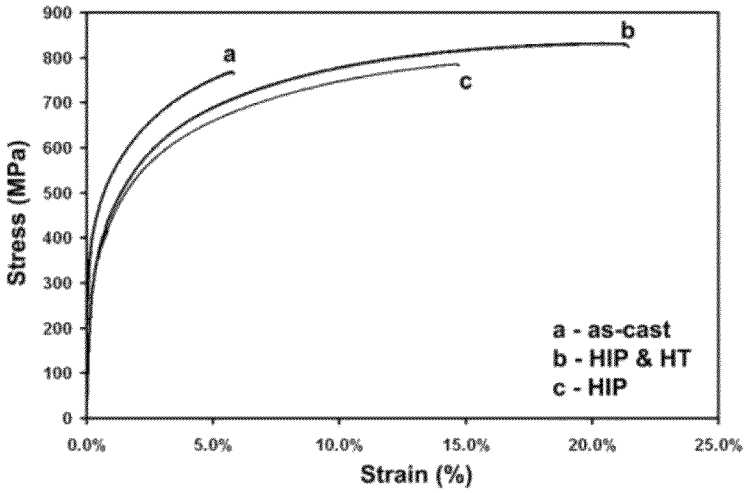
FIG. 22 Tensile properties of Alloy 1 sheet in various conditions; a) As-cast, b) After HIP cycle at 1000°C for 1 hour and heat treating at 350°C for 20 minutes, and c) After HIP cycle at 1000°C for 1 hour.

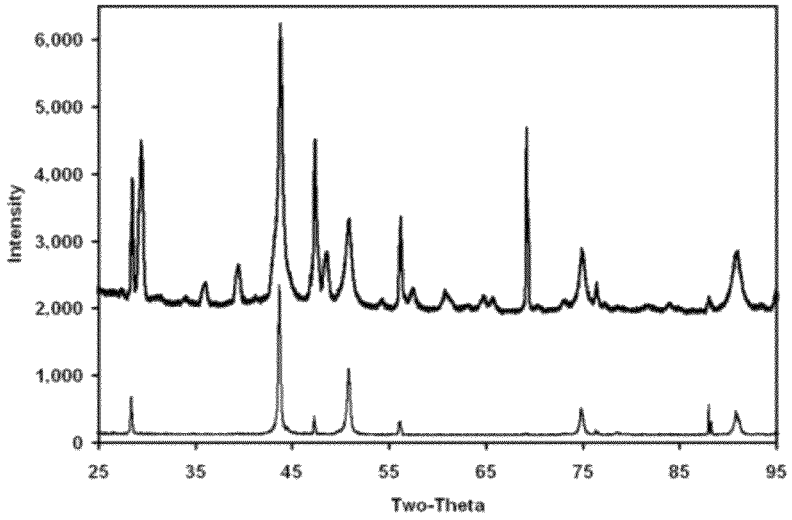
FIG. 23 Comparison between X-ray data for the Alloy 1 sheet after the HIP cycle at 1000°C for 1 hour and heat treatment at 350°C for 20 minutes: 1) Sheet gage section after tensile testing (top curve) and 2) Sheet prior to tensile testing (bottom curve).

FIG. 26 TEM micrographs of the Alloy 1 sheet HIPed at 1000°C for 1 hour and heat treated at 350°C for 20 minutes; a) Before tensile testing; b) After tensile testing.

FIG. 27 TEM micrograph of the gage section microstructure in tensile tested specimen from Alloy 1 sheet HIPed at 1000°C for 1 hour and heat treated at 350°C for 20 minutes.

FIG. 28 TEM micrograph of the gage section microstructure in tensile tested specimen from Alloy 1 sheet HIPed at 1000°C for 1 hour and heat treated at 350°C for 20 minutes at higher magnification. Dislocation cells are clearly seen in the deformed matrix grains.

FIG. 29 Picture of as-cast Alloy 14 sheet.

FIG. 30 SEM backscattered electron micrographs of the Alloy 14 sheet sample; a) As-Cast, b) HIPed at 1000°C for 1 hour, and c) HIPed at 1000°C for 1 hour and heat treated at 350°C for 20 minutes.

FIG. 31 X-ray diffraction data (intensity vs two-theta) for Alloy 14 sheet in the as-cast condition; a) Measured pattern, b) Rietveld calculated pattern with peaks identified.

FIG. 32 X-ray diffraction data (intensity vs two-theta) for Alloy 14 sheet in the HIPed condition (1000°C for 1 hour); a) Measured pattern, b) Rietveld calculated pattern with peaks identified.

FIG. 33 X-ray diffraction data (intensity vs two-theta) for Alloy 14 sheet in the HIPed (1000°C for 1 hour) and heat treated condition (350°C for 20 minutes); a) Measured pattern, b) Rietveld calculated pattern with peaks identified.

FIG. 34 TEM micrographs of the Alloy 14 sheet sample; a) As-Cast, b) HIPed at 1000°C for 1 hour, and c) Heat treated at 350°C for 20 minutes.

FIG. 35 Tensile properties of Alloy 14 sheet in various conditions: a) As-cast; b) After HIP cycle at 1000°C for 1 hour and heat treating at 350°C for 20 minutes; and c) After HIPing at 1000°C for 1 hour.

FIG. 36 Comparison between X-ray data for the Alloy 14 sheet after the HIP cycle at 1000°C for 1 hour: 1) Sheet gage section after tensile testing (top curve) and 2) Sheet prior to tensile testing (bottom curve).

Figure 37 X-ray diffraction data (intensity vs two-theta) for the gage section of tensile tested sample from Alloy 14 sheet in the HIPed condition (1000°C for 1 hour): a) Measured pattern, b) Rietveld calculated pattern with peaks identified.

FIG. 39 TEM electron micrographs of the Alloy 14 sheet HIPed at 1000°C for 1 hour; a) Before tensile testing; b) In the gage section after tensile testing to failure.

(a) Bright-field image (b) Dark-field image

FIG. 41 Picture of as-cast Alloy 19 sheet.

FIG. 42 SEM backscattered electron micrographs of the Alloy 19 sheet sample; a) As-Cast, b) HIPed at 1100°C for 1 hour, and c) HIPed at 1100°C for 1 hour and heat treated at 700°C for 20 minutes.

FIG. 43 X-ray diffraction data (intensity vs two-theta) for Alloy 19 sheet in the as-cast condition; a) Measured pattern, b) Rietveld calculated pattern with peaks identified.

FIG. 44 X-ray diffraction data (intensity vs two-theta) for Alloy 19 sheet in the HIPed condition (1100°C for 1 hour); a) Measured pattern, b) Rietveld calculated pattern with peaks identified.

FIG. 45 X-ray diffraction data (intensity vs two-theta) for Alloy 19 sheet in the HIPed (1100°C for 1 hour) and heat treated condition (700°C for 20 minutes); a) Measured pattern, b) Rietveld calculated pattern with peaks identified.

FIG. 46 TEM electron micrographs of the Alloy 19 sheet sample; a) As-Cast, b) HIPed at 1100°C for 1 hour, and c) HIPed at 1100°C for 1 hour and heat treated at 700°C for 20 minutes.

FIG. 47 Tensile properties of Alloy 19 sheet in various conditions; a) As-cast; b) After HIP cycle at 1100°C for 1 hour and heat treating at 700°C for 20 minutes; and c) After HIPing at 1100°C for 1 hour.

FIG. 48 Comparison between X-ray data for the Alloy 19 sheet after the HIP cycle at 1100°C for 1 hour and heat treatment at 700°C for 20 minutes: 1) Sheet gage section after tensile testing (top curve) and 2) Sheet prior to tensile testing (bottom curve).

Figure 49 X-ray diffraction data (intensity vs two-theta) for the gage section of tensile tested sample from Alloy 19 sheet after the HIPed cycle (1100°C for 1 hour) and heat treatment (700°C for 20 minutes): a) Measured pattern, b) Rietveld calculated pattern with peaks identified.

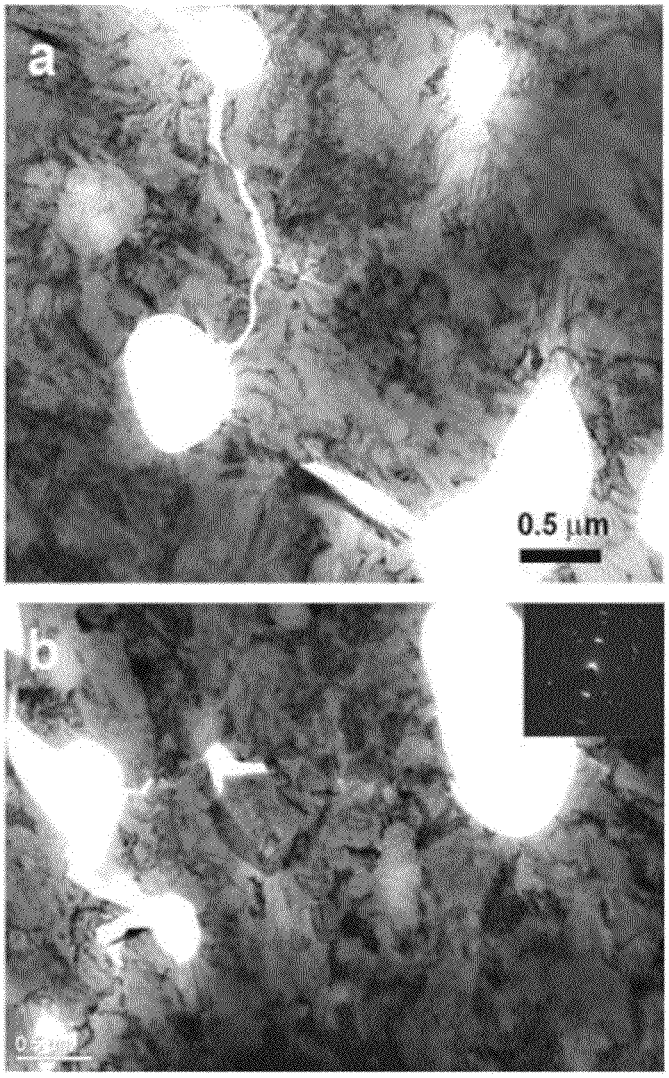
FIG. 51 TEM micrographs of the Alloy 19 sheet HIPed at 1100°C for 1 hour and heat treated at 700°C for 20 minutes: (a) before tensile test; (b) in a gage section after tensile testing to failure.

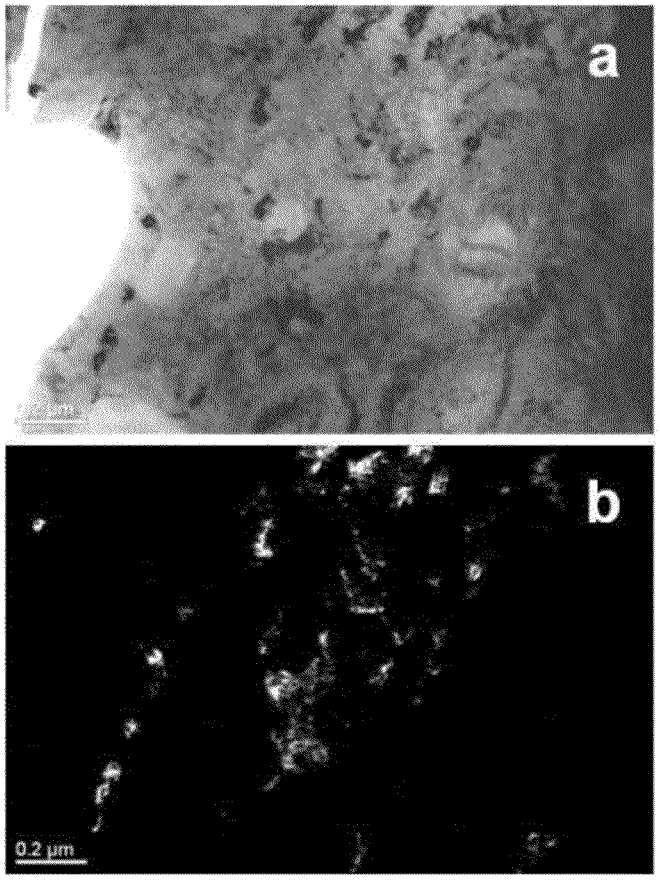
FIG. 52 TEM micrographs of the Alloy 19 tensile tested gage specimen HIPed at 1000°C for 1 hour and heat treated at 700°C for 20 minutes and tensile tested until failure: (a) bright-field image; (b) dark-field image.

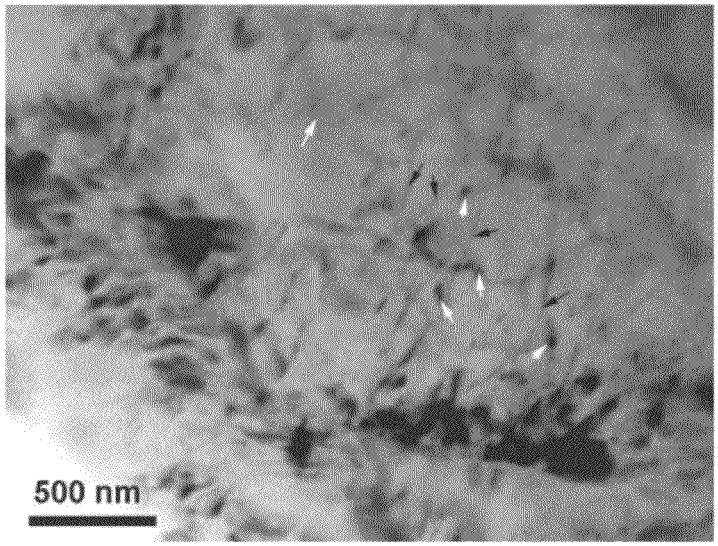
FIG. 53 TEM micrograph of the Alloy 19 tensile tested gage specimen which has been HIPed at 1100°C for 1 hour, heat treated at 700°C for 20 minutes and tensile tested until failure.

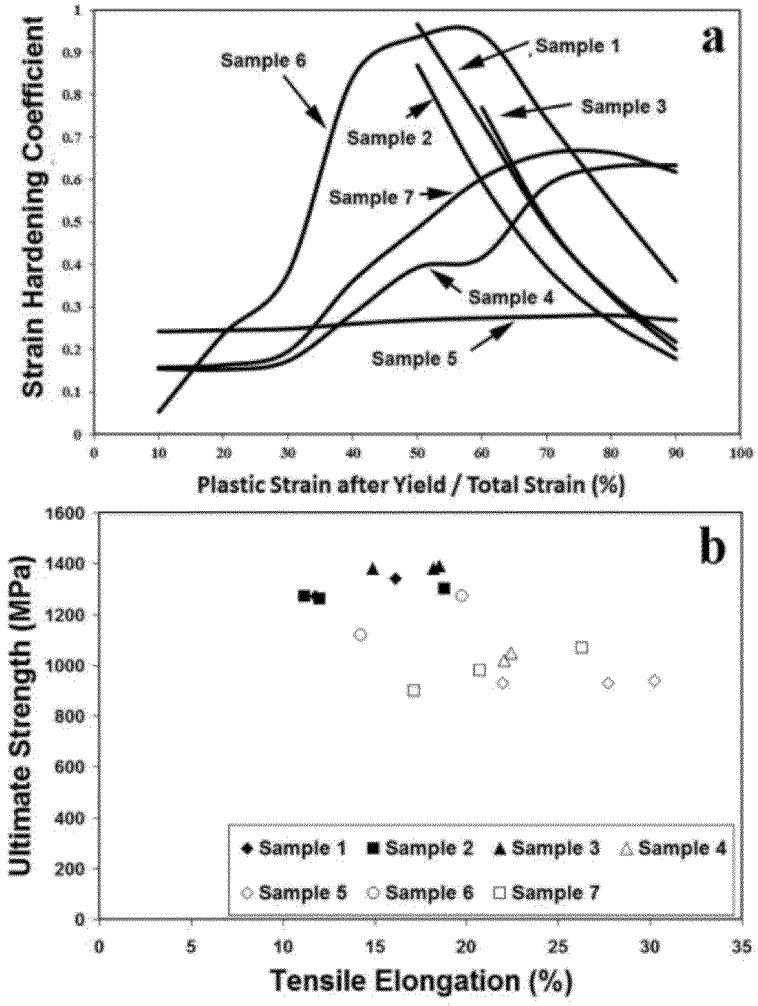
FIG. 54 (a) Strain hardening in alloy sheets with different mechanisms of structural formation and deformation; (b) Corresponding tensile properties for the same sheets.

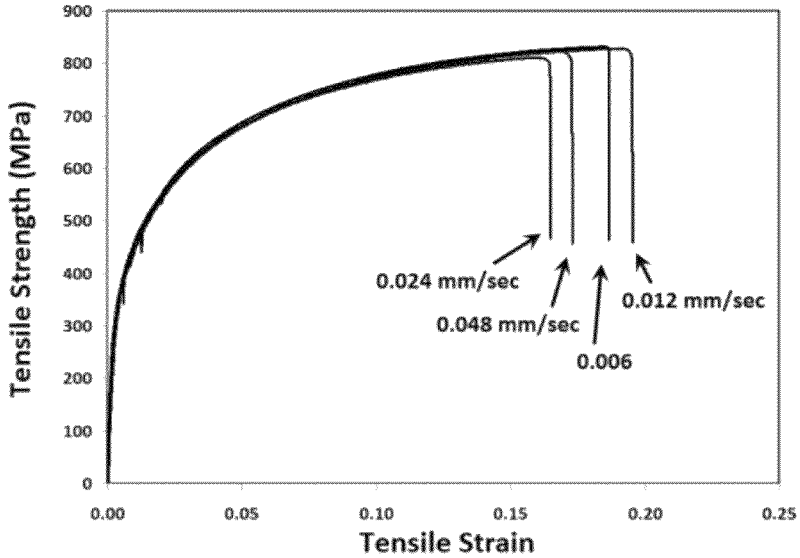
FIG. 55 Stress-strain curves for Alloy 1 sheet samples tested at different strain rates.

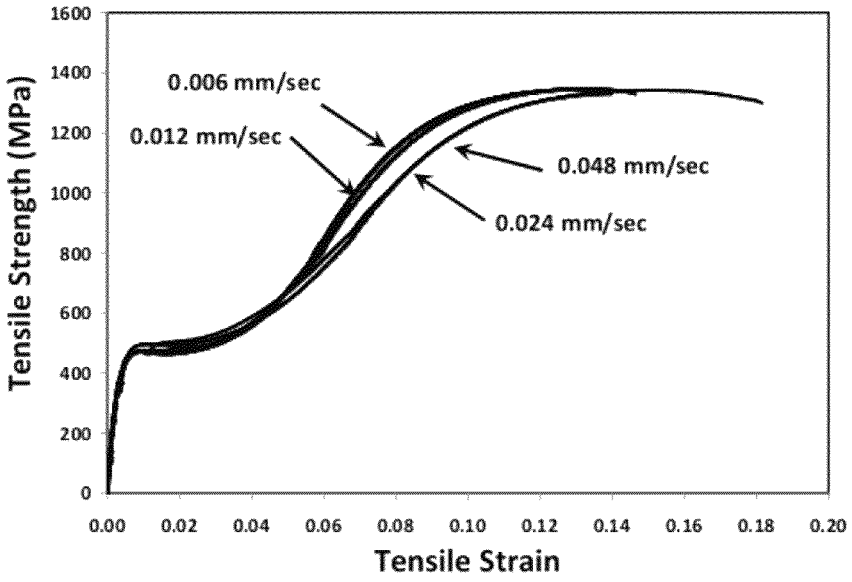
FIG. 56 Stress-strain curves for Alloy 19 sheet samples tested at different strain rates.

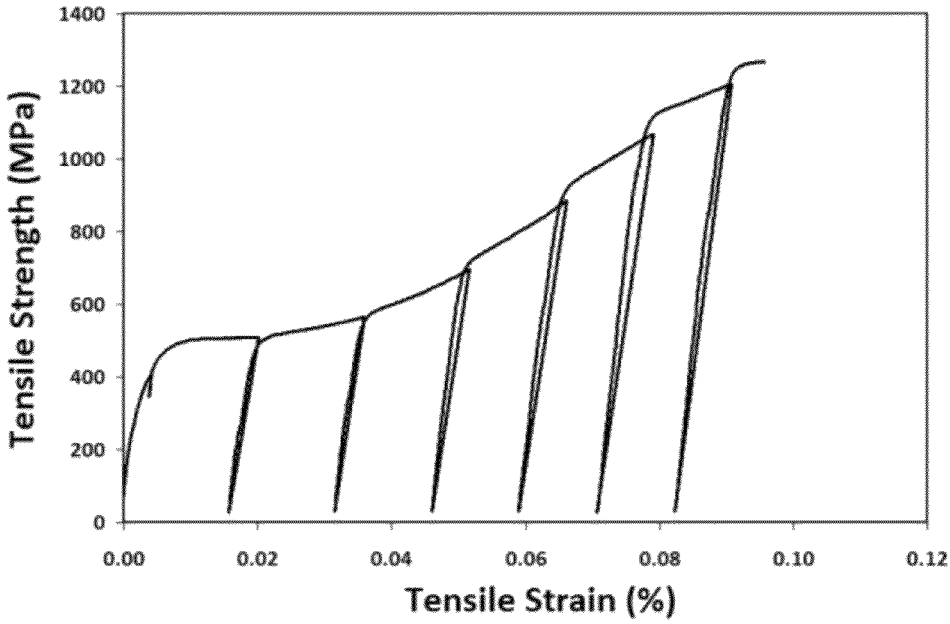
FIG. 57 Stress-strain curves for Alloy 19 sheet HIPed at 1150°C for 1 hour and tested in tension with incremental straining.

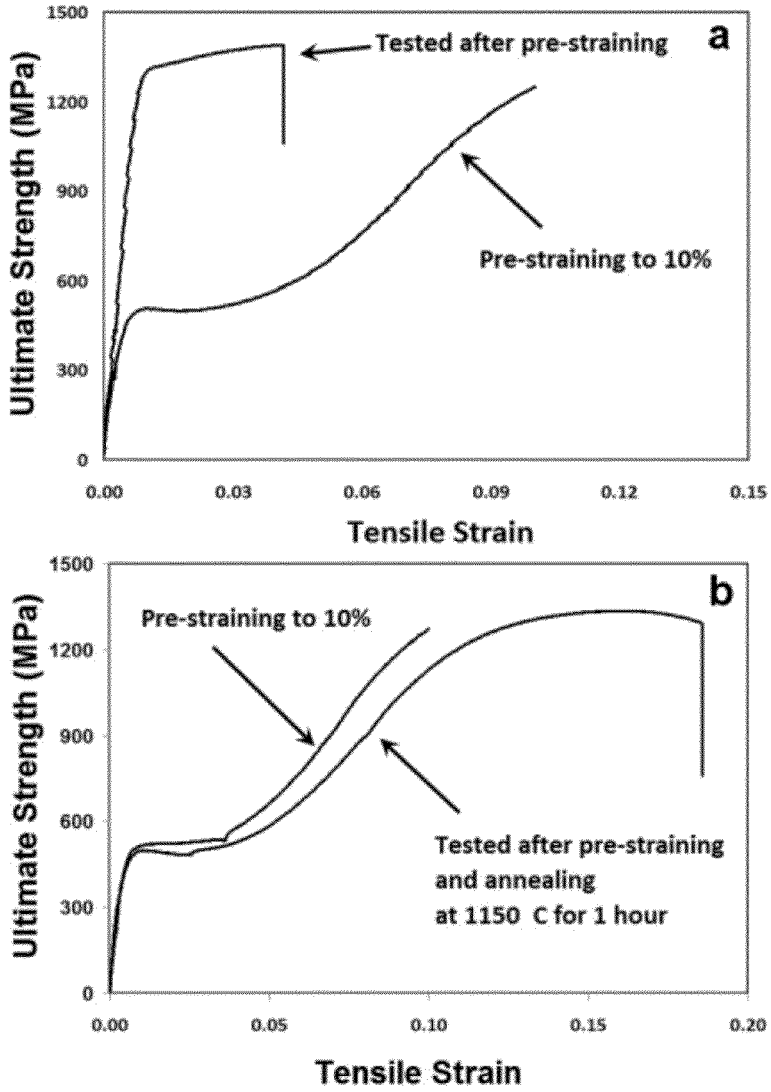
FIG. 58 Stress – strain curves for the Alloy 19 sheet tested (a) after pre-straining to 10% and (b) after pre-straining to 10% and subsequent annealing at 1150 °C for 1 hour.

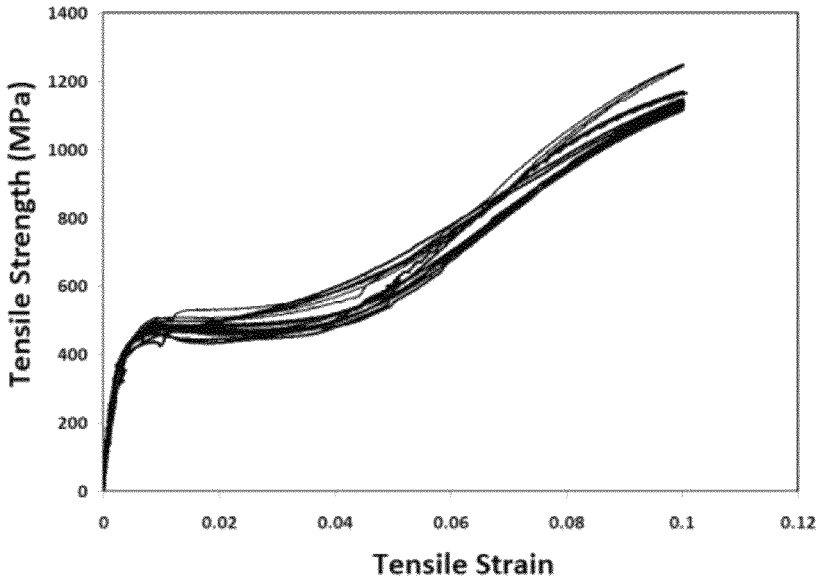
FIG. 59 Stress strain curves for Alloy 19 (HIPed at 1100°C for 1 hour and heat treated at 700°C for 1 hour) which has been subjected to 11 rounds of tensile testing to a 10% deformation followed by annealing between steps.

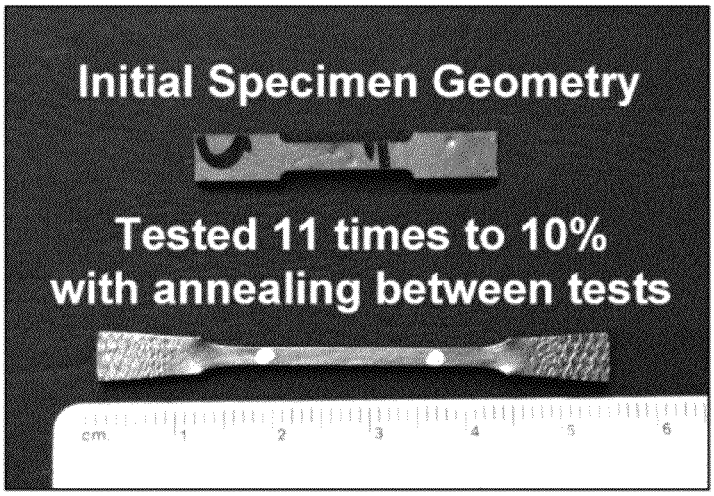
FIG. 60 Sample geometry of Alloy 19 (HIPed at 1100°C for 1 hour and heat treated at 700°C for 1 hour) before testing and after deformation to 10% eleven times with annealing between tests.

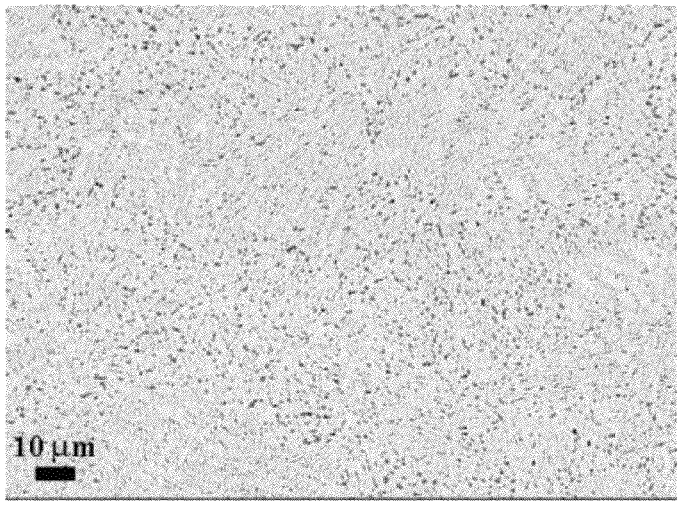
FIG. 61 SEM image of microstructure of the gage section of the tensile specimens from Alloy 19 sheet (HIPed at 1100 °C for 1 hour and heat treated at 700 °C for 1 hour) after pre-straining to 10%.

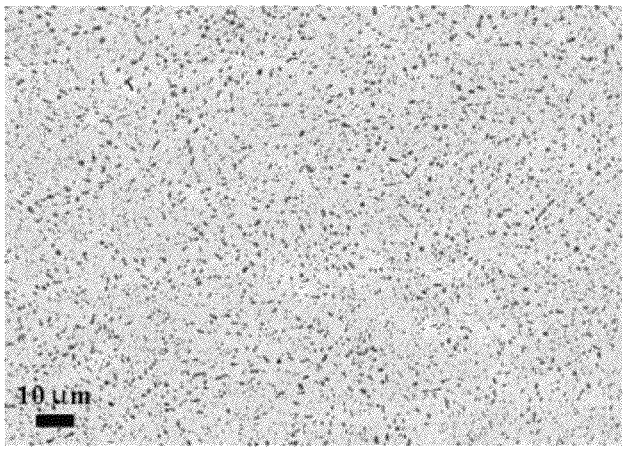
FIG. 62 SEM image of microstructure of the gage section of the tensile specimens from Alloy 19 sheet (HIPed at 1100°C for 1 hour and heat treated at 700°C for 1 hour) after pre-straining to 10% and annealing at 1150°C for 1 hour.

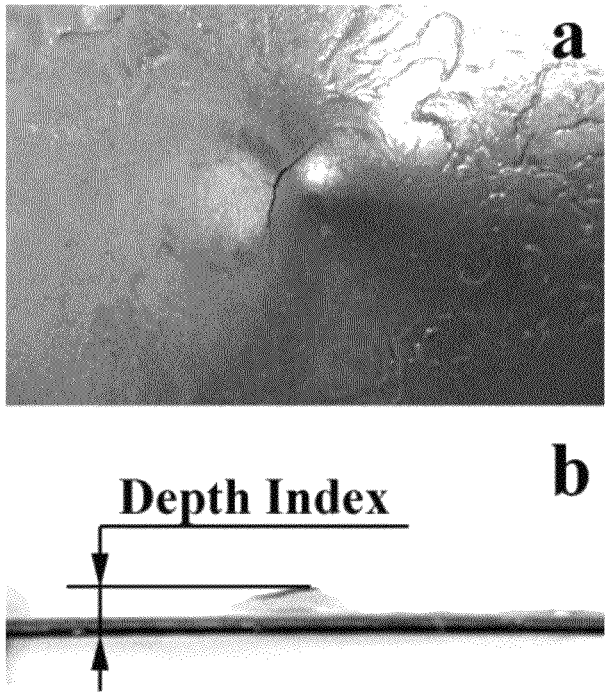
FIG. 63 (a) Plane and (b) side views of the plate from Alloy 3 after Erichsen test stopped at maximum load.

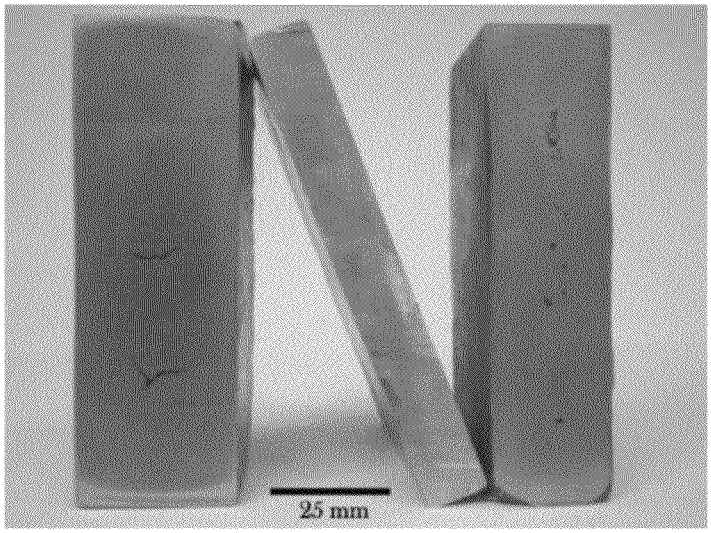
FIG. 64 As-cast sheets from Alloy 1 at three different thicknesses.

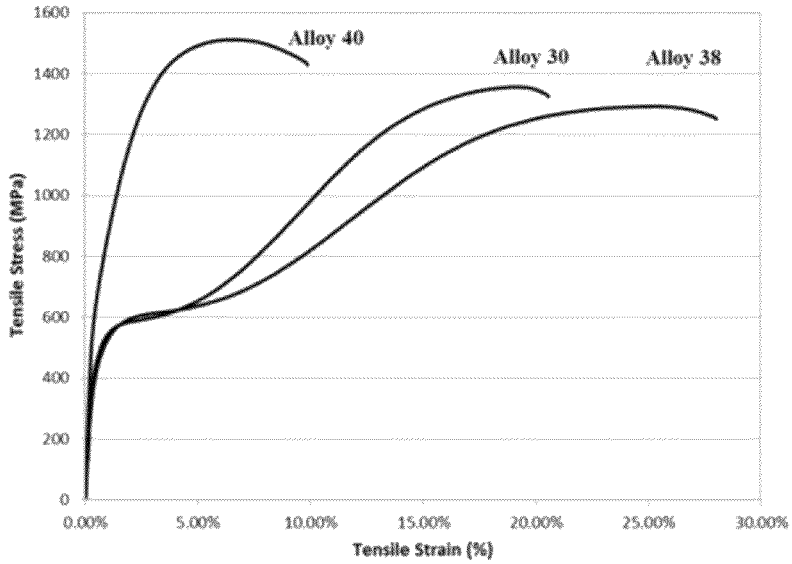
FIG. 65 Example stress-strain curves of selected alloys, demonstrating wide range of tensile response.
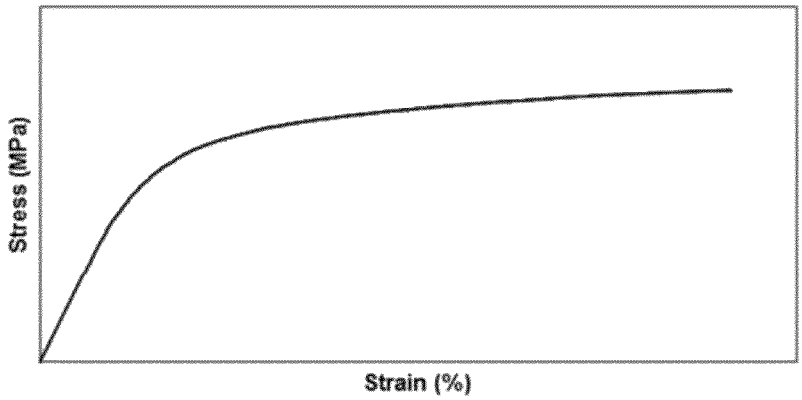
FIG. 66 Example of a ductile melt spun ribbon of a test alloy 47.

CLASSES OF MODAL STRUCTURED STEEL WITH STATIC REFINEMENT AND DYNAMIC STRENGTHENING AND METHOD OF MAKING THEREOF

CROSS REFERENCE TO RELATED APPLICATION

This application claims the benefit of U.S. Provisional Application Ser. No. 61/488,558 filed May 20, 2011 and U.S. Provisional Application Ser. No. 61/586,951 filed Jan. 16, 2012, the teachings of which are incorporated herein by reference.

FIELD OF INVENTION

This application deals with new modal structured steel alloys with application to a sheet production by chill surface processing. Two new classes of steel are provided involving the achievement of various levels of strength and ductility. Three new structure types have been identified which may be achieved by disclosed mechanisms.

BACKGROUND

Steels have been used by mankind for at least 3,000 years and are widely utilized in industry comprising over 80% by weight of all metallic alloys in industrial use. Existing steel technology is based on manipulating the eutectoid transformation. The first step is to heat up the alloy into the single phase region (austenite) and then cool or quench the steel at various cooling rates to form multiphase structures which are often combinations of ferrite, austenite, and cementite. Depending on how the steel is cooled, a wide variety of characteristic microstructures (i.e. pearlite, bainite, and martensite) can be obtained with a wide range of properties. This manipulation of the eutectoid transformation has resulted in the wide variety of steels available nowadays.

Currently, there are over 25,000 worldwide equivalents in 51 different ferrous alloy metal groups. For steel, which is produced in sheet form, broad classifications may be employed based on tensile strength characteristics. Low Strength Steels (LSS) may be defined as exhibiting tensile strengths less than 270 MPa and include types such as interstitial free and mild steels. High-Strength Steels (HSS) may be steel defined as exhibiting tensile strengths from 270 to 700 MPa and include types such as high strength low alloy, high strength interstitial free and bake hardenable steels. Advanced High-Strength Steels (AHSS) steels may have tensile strengths greater than 700 MPa and include types such as martensitic steels (MS), dual phase (DP) steels, transformation induced plasticity (TRIP) steels, and complex phase (CP) steels. As the strength level increases, the ductility of the steel generally decreases. For example, LSS, HSS and AHSS may indicate tensile elongations at levels of 25%-55%, 10%-45% and 4%-30%, respectively.

SUMMARY

The present disclosure relates to a method for producing a metallic alloy comprising Fe at a level of 53.5 to 72.1 atomic percent, Cr at 10.0 to 21.0 atomic percent, Ni at 2.8 to 14.50 atomic percent, B at 4.00 to 8.00 atomic percent, Si at 4.00 to 8.00 atomic percent. This may then be followed by melting the alloy and solidifying to provide a matrix grain size in the range of 500 nm to 20,000 nm and a boride grain size in the range of 25 nm to 500 nm. On may then mechanically stress the alloy and/or heat to form at least one of the following grain size distributions and mechanical property profiles, wherein the boride grains provide pinning phases that resist coarsening of said matrix grains:

(a) matrix grain size in the range of 500 nm to 20,000 nm, boride grain size in the range of 25 nm to 500 nm, precipitation grain size in the range of 1 nm to 200 nm wherein the alloy indicates a yield strength of 300 MPa to 840 MPa, tensile strength of 630 MPa to 1100 MPa and tensile elongation of 10 to 40%; or (b) matrix grain size in the range of 100 nm to 2000 nm and boride grain size in the range of 25 nm to 500 nm which has a yield strength of 300 MPa to 600 MPa.

The present disclosure also relates to a method for producing a metallic alloy comprising Fe at a level of 53.5 to 72.1 atomic percent, Cr at 10.0 to 21.0 atomic percent, Ni at 2.8 to 14.5 atomic percent, B at 4.0 to 8.0 atomic percent, Si at 4.0 to 8.0 atomic percent. This may be followed by melting the alloy and solidifying to provide a matrix grain size of 500 nm to 20,000 nm containing 10% to 70% by volume ferrite and a boride grain size in the range of 25 nm to 500 nm wherein the boride grains provide pinning phases that resist coarsening of the matrix grains upon application of heat and wherein the alloy has a yield strength of 300 MPa to 600 MPa. This may then be followed by heating the alloy wherein the grain size is in the range of 100 nm to 2000 nm, the boride grain size remains in the range of 25 nm to 500 nm and the level of ferrite increases to 20% to 80% by volume. One may then stress the alloy to a level that exceeds the yield strength of 300 MPa to 600 MPa wherein the grain size remains in the range of 100 nm to 2000 nm, the boride grain size remains in the range of 25 nm to 500 nm, along with the formation of precipitation grains in the range of 1 nm to 200 nm and the alloy has a tensile strength of 720 MPa to 1580 MPa and an elongation of 5% to 35%.

The present disclosure also relates to a metallic alloy comprising Fe at a level of 53.5 to 72.1 atomic percent, Cr at 10.0 to 21.0 atomic percent, Ni at 2.8 to 14.5 atomic percent, B at 4.0 to 8.0 atomic percent, and Si at 4.0 to 8.0 atomic percent. The alloy indicates a matrix grain size in the range of 500 nm to 20,000 nm and a boride grain size in the range of 25 nm to 500 nm wherein the alloy indicates at least one of the following:

(a) upon exposure to mechanical stress the alloy indicates a mechanical property profile providing a yield strength of 300 MPa to 840 MPa, tensile strength of 630 MPa to 1100 MPa, and tensile elongation of 10 to 40%; or (b) upon exposure to heat, followed by mechanical stress, the alloy indicates a mechanical property profile providing a yield strength of 300 MPa to 1300 MPa, tensile strength of 720 MPa to 1580 MPa, and tensile elongation of 5.0% to 35.0%.

The present disclosure also relates to a metallic alloy comprising Fe at a level of 53.5 to 72.1 atomic percent, Cr at 10.0 to 21.0 atomic percent, Ni at 2.8 to 14.5 atomic percent, B at 4.0 to 8.0 atomic percent and Si at 4.0 to 8.0 atomic percent. The alloy indicates a matrix grain size in the range of 500 nm to 20,000 nm and a boride grain size in the range of 25 nm to 500 nm wherein the alloy indicates at least one of the following:

(a) upon exposure to mechanical stress the alloy indicates a mechanical property profile providing a yield strength of 300 MPa to 840 MPa, tensile strength of 630 MPa to 1100 MPa, tensile elongation of 10% to 40%, a matrix grain size in the range of 500 nm to 20,000 nm, a boride grain size in the range of 25 nm to 500 nm and a precipitation grain size in the range of 1.0 nm to 200 nm; or (b) upon exposure to heat followed by mechanical stress, the alloy indicates a mechanical property profile providing a yield strength of 300 MPa to 1300 MPa, tensile strength of 720 MPa to 1580 MPa, tensile elongation of 5% to 35% and a matrix grain size in the range of 100 nm to 2000 nm, a boride grain size in the range of 25 nm to 500 nm, and a precipitation grain size in the range of 1 nm to 200 nm.

BRIEF DESCRIPTION OF THE DRAWINGS

The detailed description below may be better understood with reference to the accompanying FIGS. which are provided for illustrative purposes and are not to be considered as limiting any aspect of this invention.

FIG. 4 illustrates a representative stress-strain curve of material containing modal phase formation.

FIG. 6 illustrates a photograph of Alloy 19 sheet under specified conditions.

FIG. 7 illustrates a comparison of stress-strain curves of indicated steel types as compared to Dual Phase (DP) steels.

FIG. 8 illustrates a comparison of stress-strain curves of indicated steel types as compared to Complex Phase (CP) steels.

FIG. 9 illustrates a comparison of stress-strain curves of indicated steel types as compared to Transformation Induced Plasticity (TRIP) steels.

FIG. 10 illustrates a comparison of stress-strain curves of indicated steel-types as compared to Martensitic (MS) steels.

FIG. 11 illustrates a SEM micrograph of Modal Structure herein of Alloy 2.

FIG. 14 illustrates a SEM micrograph of Modal Structure of Alloy 1 after HIP cycle at 1000° C. for 1 hour and annealing at 350° C. for 20 minutes.

FIG. 15 is an SEM micrograph of Modal Structure herein in Alloy 14.

FIG. 16 is picture of as-cast Alloy 1 sheet.

FIG. 17 is an SEM backscattered electron micrograph of Alloy 1 under the indicated conditions of formation.

FIG. 18 is X-ray diffraction data for Alloy 1 sheet.

FIG. 19 is X-ray diffraction data for Alloy 1 sheet in the HIPed condition.

FIG. 20 is X-ray diffraction data for Alloy 1 sheet in the HIPed condition.

FIG. 21 is TEM micrographs of Alloy 1 under the indicated conditions.

FIG. 22 is a stress-strain plot of Alloy 1 under the indicated conditions of formation.

FIG. 23 is a comparison of X-ray data for Alloy 1 under the indicated conditions.

FIG. 51 is a TEM micrograph of Alloy 19 under the indicated conditions.

FIG. 52 is a TEM micrograph of Alloy 19 tensile tested gage specimen under the indicated conditions.

FIG. 53 is a TEM micrograph of Alloy 19 tensile tested gage specimen under the indicated conditions.

FIG. 54(*a*) illustrates stain hardening in alloy sheets with different mechanisms of structural formation.

FIG. 54(*b*) illustrates tensile properties for the sheets in FIG. 54(*a*).

FIG. 55 is a stress-strain curve for Alloy 1 sheet at different strain rates.

FIG. 56 is a stress-strain curve for Alloy 19 at different strain rates.

FIG. 57 is a stress-strain curve for Alloy 19 sheet under the indicated conditions.

FIG. 58(*a*) is a stress-strain curve for Alloy 19 sheet after prestraining to 10%.

FIG. 58(*b*) is a stress-strain curve for Alloy 19 sheet after prestraining to 10% and subsequent annealing at 1150° C. for 1 hour.

FIG. 59 is a stress-strain curve for Alloy 19 under the indicated conditions.

FIG. 60 illustrates the sample geometry of Alloy 19 under the indicated conditions.

FIG. 61 is a SEM image of microstructure of the gage section of the tensile specimens of Alloy 19 under the indicated conditions.

FIG. 62 is a SEM image of the gage section of the tensile specimens from Alloy 19 under the indicated conditions.

FIG. 63(*a*) is a plane view of the plate of Alloy 3 after Erichsen test stopped at maximum load.

FIG. 63(*b*) is a side view of the plate of Alloy 3 after Erichsen test stopped at maximum load.

FIG. 64 is a photograph of the as-cast sheets from Alloy 1 at three different thicknesses.

FIG. 65 is an example of a stress-strain curve of the indicated selected alloys.

FIG. 66 is a stress-strain curve of ductile melt-spun ribbon of test Alloy 47.

DETAILED DESCRIPTION

Steel Strip/Sheet Sizes

Through chill surface processing, steel sheet, as described in this application, with thickness in range of 0.3 mm to 150 mm can be produced in cast thickness and with widths in the range of 100 to 5000 mm. These thickness ranges and width ranges may be adjusted in these ranges to 0.1 mm increments. Preferably, one may use twin roll casting which can provide sheet production at thicknesses from 0.3 to 5 mm and from 100 mm to 5000 mm in width. Preferably, one may also utilize thin slab casting which can provide sheet production at thicknesses from 0.5 to 150 mm and from 100 mm to 5000 mm in width. Cooling rates in the sheet would be dependent on the process but may vary from $11\times10^{3}$ to $4\times10^{-2}$K/s. Cast parts through various chill surface methods with thickness up to 150 mm, or in the range of 1 mm to 150 mm are also contemplated herein from various methods including, permanent mold casting, investment casting, die casting, etc. Also, powder metallurgy through either conventional press and sintering or through HIPing/forging is a contemplated route to make partial or fully dense parts and devices utilizing the chemistries, structures, and mechanisms described in this application (i.e. the Class 1 or Class 2 Steel described herein).

Production Routes

Twin Roll Casting Description

Figure 1:
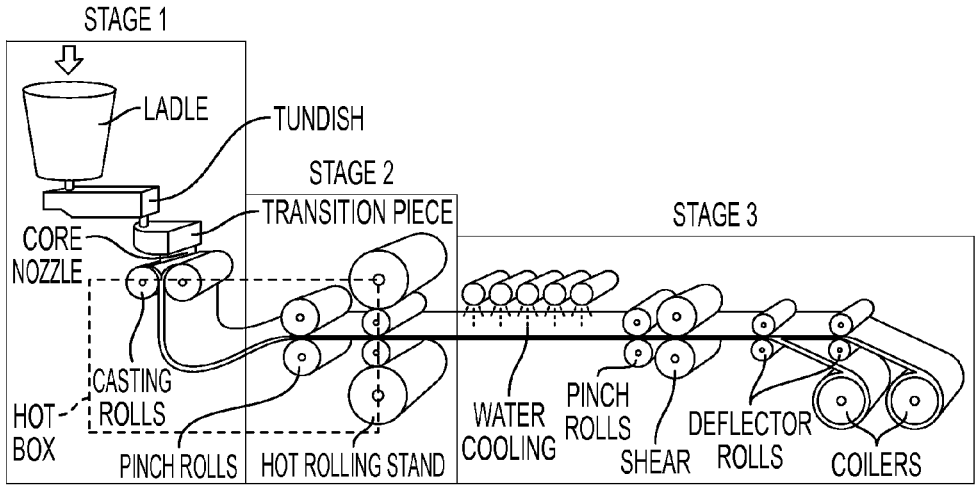
FIG. 1 illustrates an exemplary twin-roll process.

One of the examples of steel production by chill surface processing would be the twin roll process to produce steel sheet. A schematic of the Nucor/Castrip process is shown in FIG. 1. As shown, the process can be broken up into three stages; Stage 1—Casting, Stage 2—Hot Rolling, and Stage 3—Strip Coiling. During Stage 1, the sheet is formed as the solidifying metal is brought together in the roll nip between the rollers which are generally made out of copper or a copper alloy. Typical thickness of the steel at this stage is 1.7 to 1.8 mm in thickness but by changing the roll separation distance can be varied from 0.8 to 3.0 mm in thickness. During Stage 2, the as-produced sheet is hot rolled, typically from 700 to 1200° C. which acts to eliminate macrodefects such as the formation of pores, dispersed shrinkage, blowholes, pinholes, slag inclusions etc. from the production process as well as allowing solutionizing of key alloying elements, austenitization, etc. The thickness of the hot rolled sheet can be varied depending on the targeted market but is generally in the range from 0.3 to 2.0 mm in thickness. During Stage 3, the temperature of the sheet and time at temperature typically from 300 to 700° C. can be controlled by adding water cooling and changing the length of the run-out of the sheet prior to coiling. Besides hot rolling, Stage 2 could also be done by alternate thermomechanical processing strategies such as hot isostatic processing, forging, sintering etc. Stage 3, besides controlling the thermal conditions during the strip coiling process, could also be done by post processing heat treating in order to control the final microstructure in the sheet.

Thin Slab Casting Description

Figure 2:
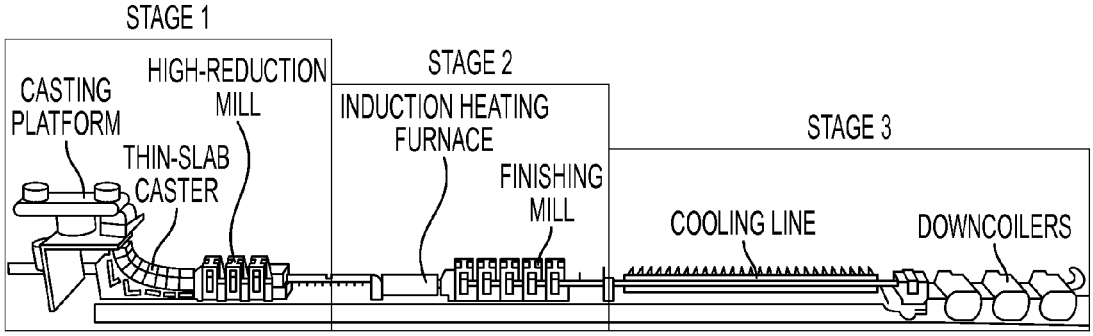
FIG. 2 illustrates an exemplary thin slab casting process.

Another example of steel production by chill surface processing would be the thin slab casting process to produce steel sheet. A schematic of the Arvedi ESP process is shown in FIG. 2. In an analogous fashion to the twin roll process, the thin slab casting process can be separated into three stages. In Stage 1, the liquid steel is both cast and rolled in an almost simultaneous fashion. The solidification process begins by forcing the liquid melt through a copper or copper alloy mold to produce initial thickness typically from 50 to 110 mm in thickness but this can be varied (i.e. 20 to 150 mm) based on liquid metal processability and production speed. Almost immediately after leaving the mold and while the inner core of the steel sheet is still liquid, the sheet undergoes reduction using a multistep rolling stand which reduces the thickness significantly down to 10 mm depending on final sheet thickness targets. In Stage 2, the steel sheet is heated by going through one or two induction furnaces and during this stage the temperature profile and the metallurgical structure is homogenized. In Stage 3, the sheet is further rolled to the final gage thickness target which may be in the 0.5 to 15 mm thickness range. Immediately after rolling, the strip is cooled on a run-out table to control the development of the final microstructure of the sheet prior to coiling into a steel roll.

While the three stage process of forming sheet in either twin roll casting or thin slab casting is part of the process, the response of the alloys herein to these stages is unique based on the mechanisms and structure types described herein and the resulting novel combinations of properties. Accordingly, in the present disclosure, sheet may be understood as metal formed into a relatively flat geometry of a selected thickness and width and slab may be understood as a length of metal that may be further processed into sheet material. Sheet may therefore be available as a relatively flat material or as a coiled stip.

Class 1 And Class 2 Steel

The alloys herein are such that they are capable of formation of what is described herein as Class 1 Steel or Class 2 Steel which are preferably crystalline (non-glassy) with identifiable crystalline grain size morphology. The ability of the alloys to form Class 1 or Class 2 Steels herein is described in detail herein. However, it is useful to first consider a description of the general features of Class 1 and Class 2 Steels, which is now provided below.

Class 1 Steel

Figure 3A:
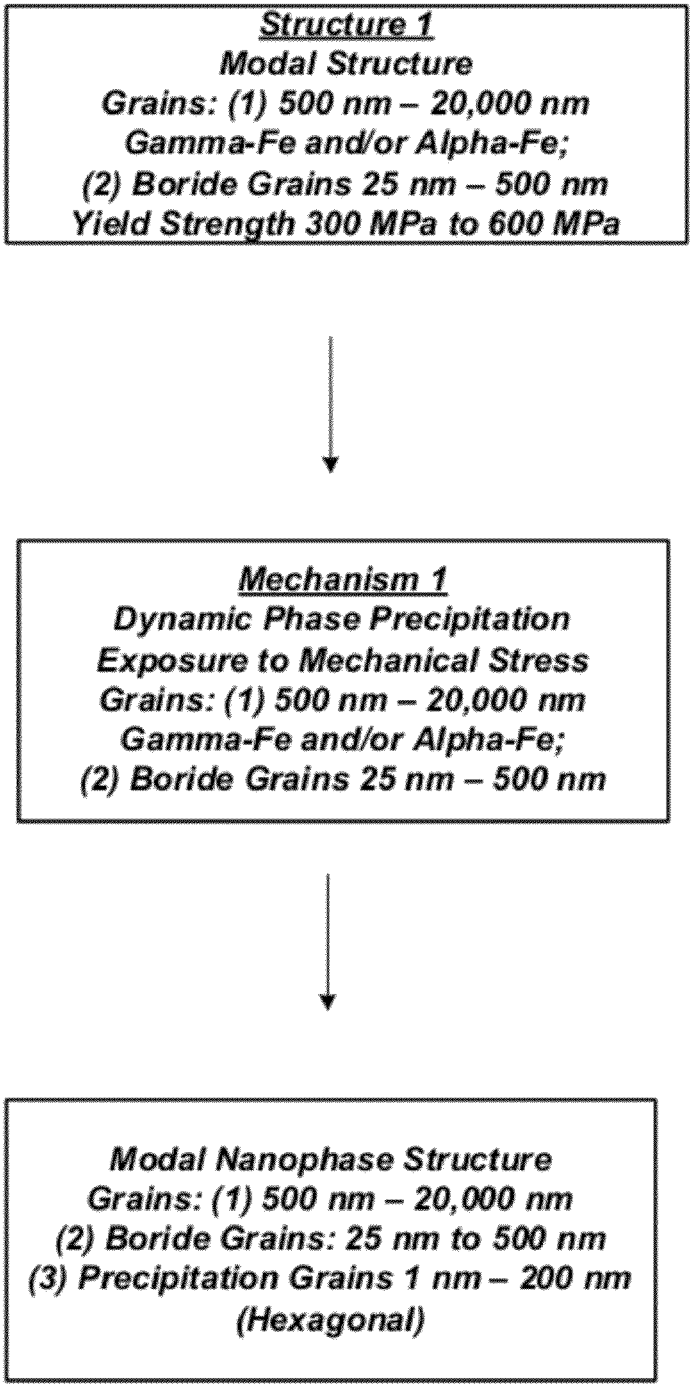
FIG. 3A illustrates structures and mechanisms regarding the formation of Class 1 Steel herein.

The formation of Class 1 Steel herein is illustrated in FIG. 3A. As shown therein, a modal structure is initially formed which modal structure is the result of starting with a liquid melt of the alloy and solidifying by cooling, which provides nucleation and growth of particular phases having particular grain sizes. Reference herein to modal may therefore be understood as a structure having at least two grain size distributions. Grain size herein may be understood as the size of a single crystal of a specific particular phase preferably identifiable by methods such as scanning electron microscopy or transmission electron microscopy. Accordingly, Structure 1 of the Class 1 Steel may be preferably achieved by processing through either laboratory scale procedures as shown and/or through industrial scale methods involving chill surface processing methodology such as twin roll processing or thin slab casting The modal structure of Class 1 Steel will therefore initially indicate, when cooled from the melt, the following grain sizes: (1) matrix grain size of 500 nm to 20,000 nm containing austenite and/or ferrite; (2) boride grain size of 25 nm to 500 nm (i.e. non-metallic grains such as $M_2B$ where M is the metal and is covalently bonded to B). The boride grains may also preferably be "pinning" type phases which is reference to the feature that the matrix grains will effectively be stabilized by the pinning phases which resist coarsening at elevated temperature. Note that the metal boride grains have been identified as exhibiting the $M_2B$ stoichiometry but other stoichiometries are possible and may provide pinning including $M_3B$, MB ($M_1B_1$), $M_{23}B_6$, and $M_7B_3$.

The modal structure of Class 1 Steel may be deformed by thermomechanical deformation and through heat treatment, resulting in some variation in properties, but the modal structure may be maintained.

When the Class 1 Steel noted above is exposed to a mechanical stress, the observed stress versus strain diagram is illustrated in FIG. 4. It is therefore observed that the modal structure undergoes what is identified as dynamic nanophase precipitation leading to a second type structure for the Class 1 Steel. Such dynamic nanophase precipitation is therefore triggered when the alloy experiences a yield under stress, and it has been found that the yield strength of Class 1 Steels which undergo dynamic nanophase precipitation may preferably occur at 300 MPa to 840 MPa. Accordingly, it may be appreciated that dynamic nanophase precipitation occurs due to the application of mechanical stress that exceeds such indicated yield strength. Dynamic nanophase precipitation itself may be understood as the formation of a further identifiable phase in the Class 1 Steel which is termed a precipitation phase with an associated grain size. That is, the result of such dynamic nanophase precipitation is to form an alloy which still indicates identifiable matrix grain size of 500 nm to 20,000 nm, boride pinning grain size of 25 nm to 500 nm, along with the formation of precipitation grains which contain hexagonal phases and grains of 1.0 nm to 200 nm. As noted above, the grain sizes therefore do not coarsen when the alloy is stressed, but does lead to the development of the precipitation grains as noted.

Reference to the hexagonal phases may be understood as a dihexagonal pyramidal class hexagonal phase with a $P6_3mc$ space group (#186) and/or a ditrigonal dipyramidal class with a hexagonal P6bar2C space group (#190). In addition, the mechanical properties of such second type structure of the Class 1 Steel are such that the tensile strength is observed to fall in the range of 630 MPa to 1100 MPa, with an elongation of 10-40%. Furthermore, the second type structure of the Class 1 Steel is such that it exhibits a strain hardening coefficient between 0.1 to 0.4 that is nearly flat after undergoing the indicated yield. The strain hardening coefficient is reference to the value of n In the formula $\sigma=K\epsilon^n$, where $\sigma$ represents the applied stress on the material, c is the strain and K is the strength coefficient. The value of the strain hardening exponent n lies between 0 and 1. A value of 0 means that the alloy is a perfectly plastic solid (i.e. the material undergoes non-reversible changes to applied force), while a value of 1 represents a 100% elastic solid (i.e. the material undergoes reversible changes to an applied force).

Table 1 below provides a comparison and performance summary for Class 1 Steel herein.

TABLE 1

Comparison of Structure and Performance for Class 1 Steel

| | Class 1 Steel | |
|---|---|---|
| Property/ Mechanism | Structure Type #1 Modal Structure | Structure Type #2 Modal Nanophase Structure |
| Structure Formation | Starting with a liquid melt, solidifying this liquid melt and forming directly | Dynamic Nanophase Precipitation occurring through the application of mechanical stress |
| Transformations | Liquid solidification followed by nucleation and growth | Stress induced transformation involving phase formation and precipitation |
| Enabling Phases | Austenite and/or ferrite with boride pinning | Austenite, optionally ferrite, boride pinning phases, and hexagonal phase(s) precipitation |
| Matrix Grain Size | 500 to 20,000 nm Austenite and/or ferrite | 500 to 20,000 nm Austenite optionally ferrite |
| Boride Grain Size | 25 to 500 nm Non metallic (e.g. metal boride) | 25 to 500 nm Non-metallic (e.g. metal boride) |
| Precipitation Grain Sizes | — | 1 nm to 200 nm Hexagonal phase(s) |
| Tensile Response | Intermediate structure; transforms into Structure #2 when undergoing yield | Actual with properties achieved based on structure type #2 |
| Yield Strength | 300 to 600 MPa | 300 to 840 MPa |
| Tensile Strength | — | 630 to 1100 MPa |
| Total Elongation | — | 10 to 40% |
| Strain Hardening Response | — | Exhibits a strain hardening coefficient between 0.1 to 0.4 and a strain hardening coefficient as a function of strain which is nearly flat or experiencing a slow increase until failure |

Class 2 Steel

Figure 3B:
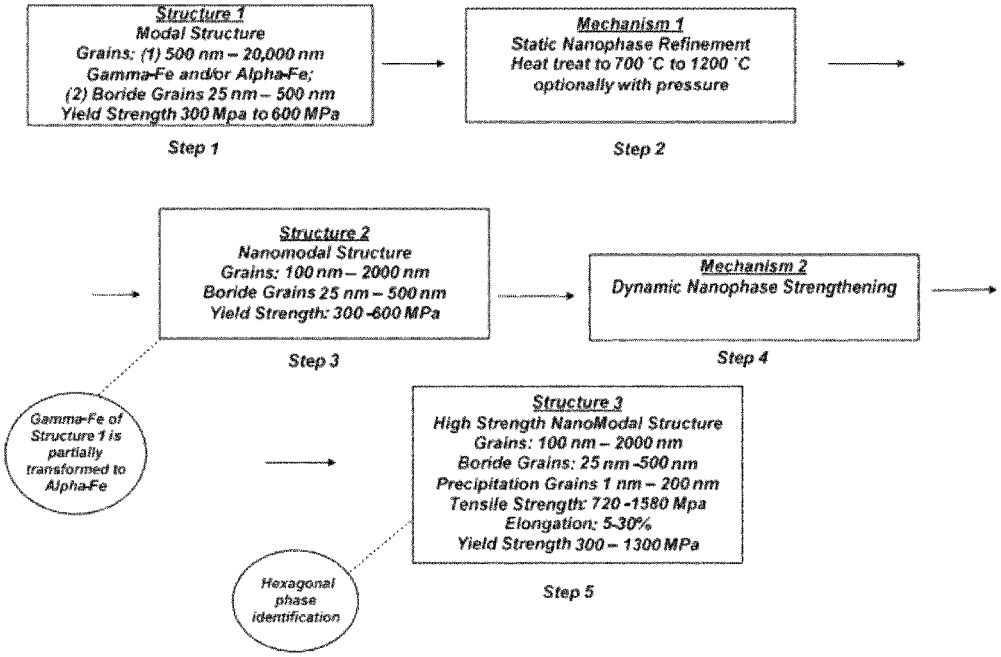
FIG. 3B illustrates structures and mechanism regarding the formation of Class 2 Steel herein.

As shown in FIG. 3B, Class 2 steel may also be formed herein from the identified alloys, which unlike Class 1 Steel, involves two new structure types after starting with Structure type #1 of Class 1 Steel, but followed by two new mechanisms identified herein as static nanophase refinement and dynamic nanophase strengthening. The new structure types for Class 2 Steel are described herein as nanomodal structure and high strength nanomodal structure. Accordingly, Class 2 Steel herein may be characterized as follow: Structure #1—Modal Structure (Step #1), Mechanism #1—Static Nanophase Refinement (Step #2), Structure #2—NanoModal Structure (Step #3), Mechanism #2—Dynamic Nanophase Strengthening (Step #4), and Structure #3—High Strength NanoModal Structure (Step #5). Structure #1 involving the formation of the modal structure in the Class 2 Steel is the same as for Class 1 Steel above and may again be achieved in the alloys with the referenced chemistries in this application by processing through either laboratory scale procedures as disclosed herein and/or through industrial scale methods involving chill surface processing methodology such as twin roll processing or thin slab casting. Reference to Structure 1—Modal Structure of Class 2 Steel herein may therefore again be understood as having grain sizes in the range of 500 nm to 20,000 nm and an identifiable boride grain size of 25 nm to 500 nm (which is metal boride grain phase such as exhibiting the $M_2B$ stoichiometry or also other stoichiometries such as $M_3B$, MB ($M_1B_1$), $M_{23}B_6$, and $M_7B_3$, and which is unaffected by mechanism 1 or 2 noted above). Reference to grain size is again to be understood as the size of a single crystal of a specific particular phase preferably identifiable by methods such as scanning electron microscopy or transmission electron microscopy. Furthermore, Structure 1 of Class 2 steel herein includes austenite and/or ferrite along with such boride phases. In addition the boride phase, as in Class 1 Steel is preferably a pinning phase.

Figure 5:
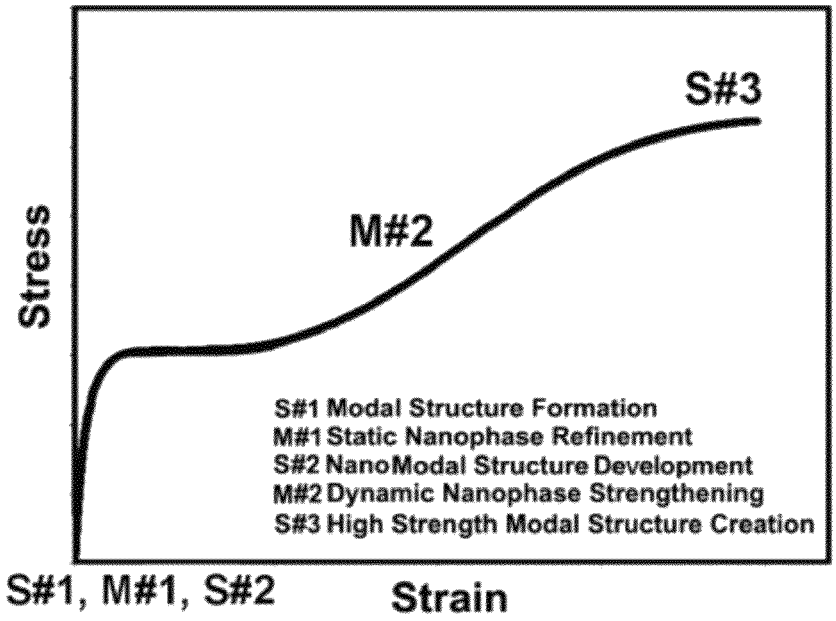
FIG. 5 illustrates a representative stress-strain curve for the indicated structures and associated mechanisms of formation.
Figure 12:
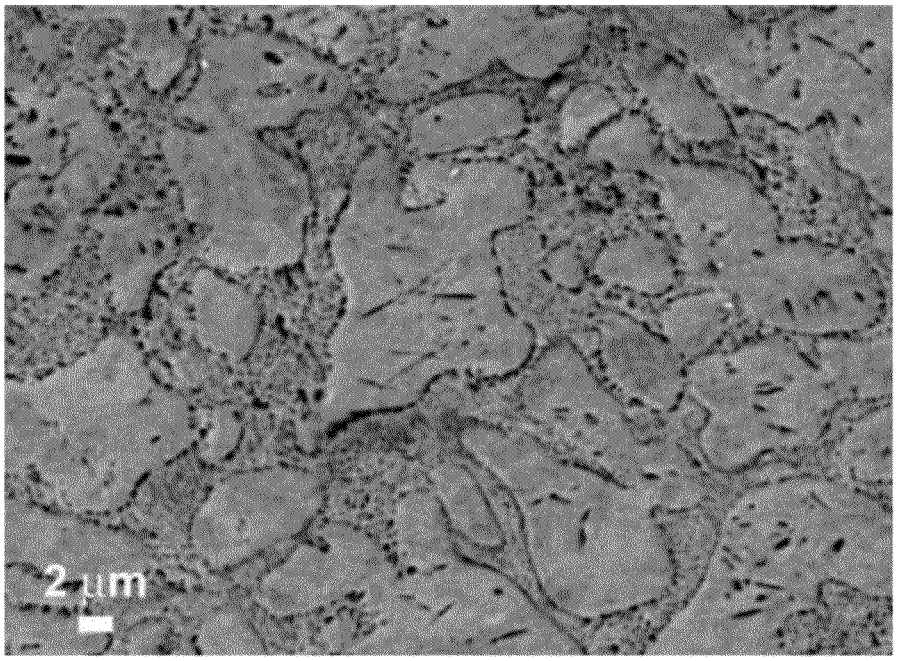
FIG. 12 illustrates a SEM micrograph of Modal Structure herein of Alloy 11 after HIP cycle at 1000° C. for 1 hour.
Figure 13:
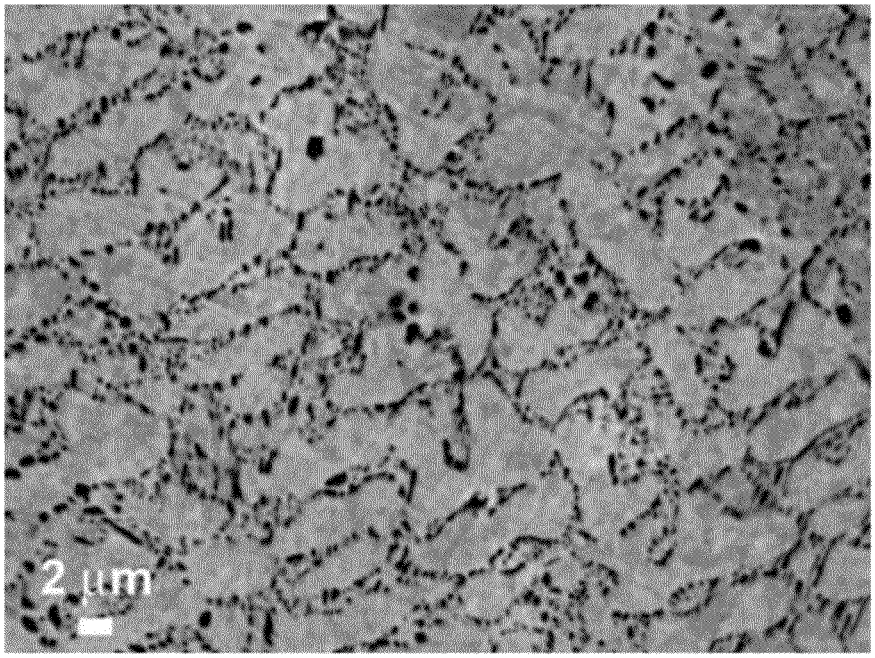
FIG. 13 illustrates a SEM micrograph of Modal Structure herein of Alloy 18 after HIP cycle at 1100° C. for 1 hour.

In FIG. 5, a stress strain curve is shown that represents the alloys herein which undergo a deformation behavior of a representative Class 2 steel. The modal structure is again preferably first created (Structure #1) and then after the creation, the modal structure may now be refined (i.e. the grain size distribution is altered) through Mechanism #1, which is a Static Nanophase Refinement mechanism, leading to Structure #2. Static Nanophase Refinement is reference to the feature that the matrix grain sizes of Structure 1 which initially fall in the range of 500 nm to 20,000 nm are reduced in size to provide Structure 2 which has matrix grain sizes that typically fall in the range of 100 nm to 2000 nm. Note that the boride pinning phase does not change significantly in size and thus resists coarsening during the heat treatments. Due to the presence of these boride pinning sites, the motion of a grain boundaries leading to coarsening would be expected to be retarded by a process called Zener pinning or Zener drag. The boride phases which are non-metallic would exhibit a high interfacial energy which is lowered by existing at grain or phase boundaries. Thus, while grain growth of the matrix may be energetically favorable due to the reduction of total interfacial area, the presence of the boride pinning phase will counteract this driving force of coarsening due to the high interfacial energies of these phases. Structure 2 also displays completely different behavior when tested in tension and has the potential to achieve much higher strengths than a Class 1 Steel.

Characteristic of the Static Nanophase Refinement mechanism in Class 2 steel, the micron scale austenite phase (gamma-Fe) which was noted as falling in the range of 500 nm to 20,000 nm is partially or completely transformed into new phases (e.g. ferrite or alpha-Fe). The volume fraction of ferrite initially present in the modal structure of Class 2 steel is 10 to 70%. The volume fraction of ferrite (alpha-iron) in Structure 2 as a result of Static Nanophase Refinement is typically from 20 to 80%. The static transformation preferably occurs during elevated temperature heat treatment and thus involves a unique refinement mechanism since grain coarsening and not grain refinement is the conventional material response at elevated temperature. Accordingly, grain coarsening does not occur with the alloys of Class 2 Steel herein during the Static Nanophase Refinement mechanism. Structure 2 is uniquely able to transform to Structure #3 during Dynamic Nanophase Strengthening and as a result Structure#3 is formed and indicates tensile strength values in the range from 720 to 1580 MPa tensile strength and 5 to 35% total elongation.

Expanding upon the above, in the case of the alloys herein that provide Class 2 Steel, when such alloys exceed their yield point, plastic deformation at constant stress occurs followed by a dynamic phase transformation leading toward the creation of Structure #3. More specifically, after enough strain is induced, an inflection point occurs where the slope of the stress versus strain curve changes and increases (FIG. 5) and the strength increases with strain indicating an activation of Mechanism #2 (Dynamic Nanophase Strengthening). An increase in strain hardening coefficient is also found at the beginning of deformation. The value of the strain hardening exponent n lies between 0.2 to 1.0 for Structure 3 in the Class 2 Steel.

With further straining during Dynamic Nanophase Strengthening, the strength continues to increase but with a gradual decrease in strain hardening coefficient value up to nearly failure. Some strain softening occurs near the breaking point which may be due to reductions in localized cross sectional area at necking. Note that the strengthening transformation that occurs at the material straining under the stress generally defines Mechanism #2 as a dynamic process, leading to Structure #3. By dynamic, it is meant that the process may occur through the application of a stress which exceeds the yield strength of the material. The tensile properties that can be achieved for alloys that achieve Structure 3 include tensile strength values in the range from 720 to 1580 MPa tensile strength and 5 to 35% total elongation. The level of tensile properties achieved is also dependant on the amount of transformation occurring as the strain is increased corresponding to the characteristic stress strain curve for a Class 2 steel.

Thus, depending on the level of transformation, a tunable yield strength may also now be developed in Class 2 Steel herein depending on the level of deformation and in Structure 3 the yield strength can ultimately vary from 300 MPa to 1300 MPa. That is, conventional steels outside the scope of the alloys here exhibit only relatively low levels of strain hardening, thus their yield strengths can be varied only over small ranges (e.g., 100 to 200 MPa) depending on the prior deformation history. In Class 2 steels herein, the yield strength can be varied over a wide range (e.g. 300 to 600 MPa) as applied to Structure 2, allowing tunable variations to enable both the designer and end users in a variety of applications to achieve Structure 3, and utilize Structure 3 in various applications such as crash management in automobile body structures.

With regards to this dynamic mechanism shown in FIG. 3B, a new precipitation phase is observed that indicates identifiable grain sizes of 1 nm to 200 nm. In addition, there is the further identification in said precipitation phase a dihexagonal pyramidal class hexagonal phase with a $P6_3mc$ space group (#186) and/or a ditrigonal dipyramidal class with a hexagonal P6bar2C space group (#190). Accordingly, the dynamic transformation can occur partially or completely and results in the formation of a microstructure with novel nanoscale/near nanoscale phases providing relatively high strength in the material. That is, Structure #3 may be understood as a microstructure having a matrix grain size generally from 100 nm to 2000 nm which are pinned by boride phases which are in the range of 25 to 500 nm and with precipitate phases which are in the range of 1 nm to 200 nm.

Note that dynamic recrystallization is a known process but differs from Mechanism #2 since it involves the formation of large grains from small grains so that it is not a refinement mechanism but a coarsening mechanism. Additionally, as new undeformed grains are replaced by deformed grains no phase changes occur in contrast to the mechanisms presented here and this also results in a corresponding reduction in strength in contrast to the strengthening mechanism here. Note also that metastable austenite in steels is known to transform to martensite under mechanical stress but, preferably, no evidence for martensite or body centered tetragonal iron phases are found in the new steel alloys described in this application. Table 2 below provides a comparison of the structure and performance features of Class 2 Steel herein.

With respect to Class 2 Steel herein, Mechanism #1 which is the Static Nanophase Refinement (SNR) occurs after MS is formed and during further elevated temperature exposure. Accordingly, Static Nanophase Refinement may also occur during Stage 1, Stage 2 or Stage 3 (after MS formation) of either of the above referenced twin roll or thin slab casting sheet production process. It has been observed that Static Nanophase Refinement may preferably occur when the alloys are subject to heating at temperature in the range of 700° C. to 1200° C. The percentage level of SNR that occurs in the material may depend on the specific chemistry and involved thermal cycle that determines the volume fraction of NanoModal Structure (NMS) specified as Structure #2. However, preferably, the percentage level by volume of MS that is converted to NMS is in the range of 20 to 90%.

TABLE 2

Comparison Of Structure and Performance of Class 2 Steel

| Property/ Mechanism | Class 2 Steel: Structure Type #1 Modal Structure | Structure Type #2 NanoModal Structure | Structure Type #3 High Strength NanoModal Structure |
|---|---|---|---|
| Structure Formation | Starting with a liquid melt, solidifying this liquid melt and forming directly | Static Nanophase Refinement mechanism occurring during heat treatment | Dynamic Nanophase Strengthening mechanism occurring through application of mechanical stress |
| Transformations | Liquid solidification followed by nucleation and growth | Solid state phase transformation of supersaturated gamma iron | Stress induced transformation involving phase formation and precipitation |
| Enabling Phases | Austenite and/or ferrite with boride pinning phases | Ferrite, austenite, boride pinning phases | Ferrite, optionally austenite, boride pinning phases, and hexagonal phase(s) precipitation |
| Matrix Grain Size | 500 to 20,000 nm Austenite and/or ferrite | Grain Refinement (100 nm to 2000 nm) Austenite phase to ferrite phase | Grain size remains refined at 100 nm to 2000 nm/ Hexagonal phase formation |
| Boride Grain Size | 25 to 500 nm borides (e.g. metal boride) | 25 to 500 nm borides (e.g. metal boride) | 25 to 500 nm borides (e.g. metal boride) |
| Precipitation Grain Sizes | — | — | 1 nm to 200 nm Hexagonal phase(s) |
| Tensile Response | Actual with properties achieved based on structure type #1 | Intermediate structure; transforms into Structure #3 when undergoing yield | Actual with properties achieved based on formation of structure type #3 and fraction of transformation. |
| Yield Strength | 300 to 600 MPa | 300 to 600 MPa | 300 to 1300 MPa |
| Tensile Strength | — | — | 720 to 1580 MPa |
| Total Elongation | — | — | 5 to 35% |
| Strain Hardening Response | — | After yield point, exhibit a strain softening at initial straining as a result of phase transformation, followed by a significant strain hardening affect leading to a distinct maxima | Strain hardening coefficient may vary from 0.2 to 1.0 depending on amount of deformation and transformation |

Mechanisms During Production

The formation of Modal Structure (MS) in either Class 1 or Class 2 Steel herein can be made to occur at various stages of the production process. For example, the MS of the sheet may form during Stage 1, 2, or 3 of either the above referenced twin roll or thin slab casting sheet production processes. Accordingly, the formation of MS may depend specifically on the solidification sequence and thermal cycles (i.e. temperatures and times) that the sheet is exposed to during the production process. The MS may be preferably formed by heating the alloys herein at temperatures in the range of above their melting point and in a range of 1100° C. to 2000° C. and cooling below the melting temperature of the alloy, which corresponds to preferably cooling in the range of $11\times10^{3}$ to $4\times10^{-2}$K/s.

Mechanism #2 which is Dynamic Nanophase Strengthening (DNS) may also occur during Stage 1, Stage 2 or Stage 3 (after MS formation) of either of the above referenced twin roll or thin slab casting sheet production process. Dynamic Nanophase Strengthening may therefore occur in Class 2 Steel that has undergone Static Nanophase Refinement. Dynamic Nanophase Strengthening may therefore also occur during the production process of sheet but may also be done during any stage of post processing involving application of stresses exceeding the yield strength. Tables 6 and 8 relate to tensile measurements where Dynamic NanoPhase Strengthening is occurring since the heat treatment(s) caused the creation of the NanoModal Structure. The amount of DNS that occurs may depend on the volume fraction of static nanophase refinement in the material prior deformation and on stress level induced in the sheet. The strengthening may also occur during subsequent post processing into final parts involving hot or cold forming of the sheet. Thus Structure #3 herein (see Table 2 above) may occur at various processing stages in the sheet production or upon post processing and additionally may occur to different levels of strengthening depending on the alloy chemistry, deformation parameters and thermal cycle(s). Preferably, DNS may occur under the following range of conditions, after achieving structure type #2 and then exceeding the yield strength of the structure which is in the range of 300 to 1300 MPa.

Figure 3C:
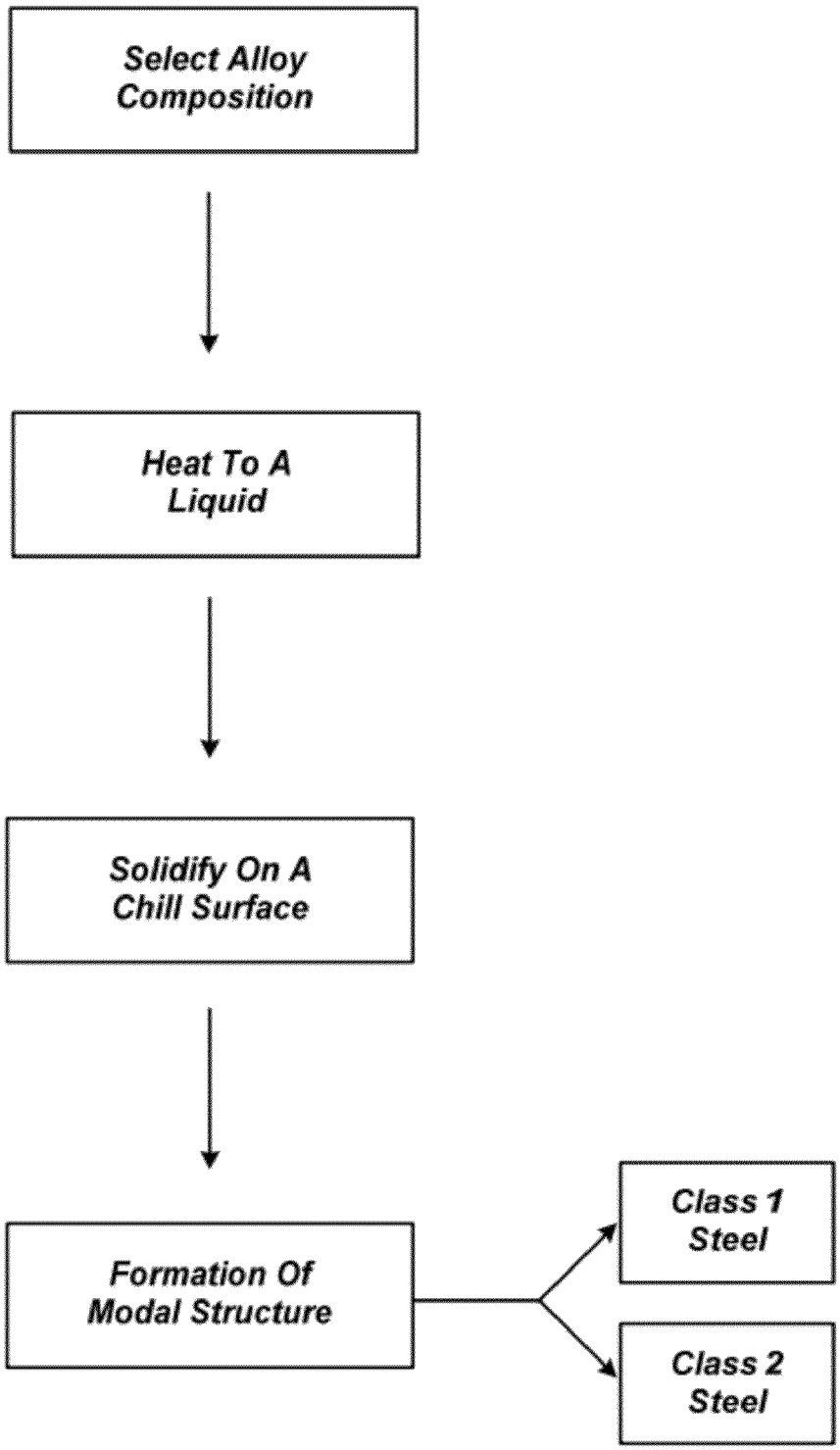
FIG. 3C illustrates a general scheme for the formation of Class 1 and Class 2 Steel herein.

FIG. 3C illustrates in general that starting with a particular chemical composition for the alloys herein, and heating to a liquid, and solidifying on a chill surface, and forming modal structure, one may then convert to either Class 1 Steel or Class 2 Steel as noted herein.

EXAMPLES

Preferred Alloy Chemistries and Sample Preparation

The chemical composition of the alloys studied is shown in Table 2 which provides the preferred atomic ratios utilized. These chemistries have been used for material processing through sheet casting in a Pressure Vacuum Caster (PVC). Using high purity elements [>99 wt %], 35 g alloy feedstocks of the targeted alloys were weighed out according to the atomic ratios provided in Table 2. The feedstock material was then placed into the copper hearth of an arc-melting system. The feedstock was arc-melted into an ingot using high purity argon as a shielding gas. The ingots were flipped several times and re-melted to ensure homogeneity. After mixing, the ingots were then cast in the form of a finger approximately 12 mm wide by 30 mm long and 8 mm thick. The resulting fingers were then placed in a PVC chamber, melted using RF induction and then ejected onto a copper die designed for casting 3 by 4 inches sheets with thickness of 1.8 mm.

TABLE 2

Chemical Composition of the Alloys

| Alloy | Fe | Cr | Ni | B | Si | V | Zr | C | W | Mn |
|---|---|---|---|---|---|---|---|---|---|---|
| Alloy 1 | 59.35 | 17.43 | 14.05 | 4.77 | 4.40 | — | — | — | — | |
| Alloy 2 | 57.75 | 17.43 | 14.05 | 4.77 | 6.00 | — | — | — | — | |
| Alloy 3 | 58.35 | 17.43 | 14.05 | 4.77 | 4.40 | 1.00 | — | — | — | |
| Alloy 4 | 54.52 | 17.43 | 14.05 | 7.00 | 7.00 | — | — | — | — | |
| Alloy 5 | 56.52 | 17.43 | 14.05 | 7.00 | 5.00 | — | — | — | — | |
| Alloy 6 | 55.52 | 17.43 | 14.05 | 7.00 | 5.00 | 1.00 | — | — | — | |
| Alloy 7 | 53.52 | 17.43 | 14.05 | 7.00 | 5.00 | 3.00 | — | — | — | |
| Alloy 8 | 53.52 | 17.43 | 14.05 | 7.00 | 7.00 | 1.00 | — | — | — | |
| Alloy 9 | 55.52 | 17.43 | 14.05 | 7.00 | 5.00 | — | 1.00 | — | — | |
| Alloy 10 | 57.35 | 17.43 | 14.05 | 4.77 | 4.40 | — | — | 2.00 | — | |
| Alloy 11 | 66.35 | 17.43 | 7.05 | 4.77 | 4.40 | — | — | — | — | |
| Alloy 12 | 58.35 | 17.43 | 14.05 | 4.77 | 4.40 | — | — | — | 1.00 | |
| Alloy 13 | 57.22 | 17.43 | 14.05 | 5.00 | 6.30 | — | — | — | — | |
| Alloy 14 | 64.22 | 17.43 | 7.05 | 5.00 | 6.30 | — | — | — | — | |
| Alloy 15 | 63.22 | 17.43 | 7.05 | 5.00 | 6.30 | — | — | — | 1.00 | |
| Alloy 16 | 68.70 | 15.00 | 5.00 | 5.00 | 6.30 | — | — | — | — | |
| Alloy 17 | 64.75 | 17.43 | 7.05 | 4.77 | 6.00 | — | — | — | — | |
| Alloy 18 | 65.45 | 17.43 | 9.05 | 4.47 | 5.60 | — | — | — | — | |
| Alloy 19 | 63.62 | 17.43 | 12.05 | 5.30 | 6.60 | — | — | — | — | |
| Alloy 20 | 62.22 | 17.43 | 9.05 | 5.00 | 6.30 | — | — | — | — | |
| Alloy 21 | 60.22 | 17.43 | 11.05 | 5.00 | 6.30 | — | — | — | — | |
| Alloy 22 | 62.22 | 19.43 | 7.05 | 5.00 | 6.30 | — | — | — | — | |
| Alloy 23 | 66.22 | 15.43 | 7.05 | 5.00 | 6.30 | — | — | — | — | |
| Alloy 24 | 62.75 | 17.43 | 9.05 | 4.77 | 6.00 | — | — | — | — | |
| Alloy 25 | 62.20 | 17.62 | 4.14 | 5.30 | 6.60 | | | | | 4.14 |
| Alloy 26 | 60.35 | 20.70 | 3.53 | 5.30 | 6.60 | | | | | 3.52 |
| Alloy 27 | 61.10 | 19.21 | 3.90 | 5.30 | 6.60 | | | | | 3.89 |
| Alloy 28 | 61.32 | 20.13 | 3.33 | 5.30 | 6.60 | | | | | 3.32 |
| Alloy 29 | 63.83 | 17.97 | 3.15 | 5.30 | 6.60 | | | | | 3.15 |
| Alloy 30 | 63.08 | 15.95 | 4.54 | 5.30 | 6.60 | | | | | 4.53 |
| Alloy 31 | 64.93 | 16.92 | 3.13 | 5.30 | 6.60 | | | | | 3.12 |
| Alloy 32 | 64.45 | 15.86 | 3.90 | 5.30 | 6.60 | | | | | 3.89 |
| Alloy 33 | 62.11 | 20.31 | 2.84 | 5.30 | 6.60 | | | | | 2.84 |
| Alloy 34 | 62.20 | 17.62 | 6.21 | 5.30 | 6.60 | | | | | 2.07 |
| Alloy 35 | 60.35 | 20.70 | 5.29 | 5.30 | 6.60 | | | | | 1.76 |
| Alloy 36 | 61.10 | 19.21 | 5.85 | 5.30 | 6.60 | | | | | 1.94 |
| Alloy 37 | 61.32 | 20.13 | 4.99 | 5.30 | 6.60 | | | | | 1.66 |
| Alloy 38 | 63.83 | 17.97 | 4.73 | 5.30 | 6.60 | | | | | 1.57 |
| Alloy 39 | 63.08 | 15.95 | 6.80 | 5.30 | 6.60 | | | | | 2.27 |
| Alloy 40 | 64.93 | 16.92 | 4.69 | 5.30 | 6.60 | | | | | 1.56 |
| Alloy 41 | 64.45 | 15.86 | 5.85 | 5.30 | 6.60 | | | | | 1.94 |
| Alloy 42 | 62.11 | 20.31 | 4.26 | 5.30 | 6.60 | | | | | 1.42 |
| Alloy 43 | 72.10 | 12.20 | 4.50 | 7.20 | 4.00 | | | | | |
| Alloy 44 | 62.38 | 17.40 | 7.92 | 7.40 | 4.20 | | | 0.20 | | 0.50 |
| Alloy 45 | 65.99 | 13.58 | 6.58 | 7.60 | 4.40 | | | 0.35 | | 1.50 |
| Alloy 46 | 58.76 | 17.22 | 9.77 | 7.80 | 4.60 | | | 0.55 | | 1.30 |
| Alloy 47 | 58.95 | 11.35 | 13.40 | 8.00 | 4.80 | | | 2.25 | | 1.25 |
| Alloy 48 | 62.28 | 10.00 | 12.56 | 4.80 | 8.00 | | | 0.36 | | 2.00 |
| Alloy 49 | 53.82 | 20.22 | 11.60 | 4.60 | 7.80 | | | 1.21 | | 0.75 |
| Alloy 50 | 61.21 | 21.00 | 4.90 | 4.40 | 7.60 | | | 0.89 | | |
| Alloy 51 | 62.00 | 17.50 | 6.25 | 4.20 | 7.40 | | | 2.55 | | 0.10 |

TABLE 2-continued

| Chemical Composition of the Alloys | | | | | | | | | | |
|---|---|---|---|---|---|---|---|---|---|---|
| Alloy | Fe | Cr | Ni | B | Si | V | Zr | C | W | Mn |
| Alloy 52 | 59.71 | 14.30 | 13.74 | 4.00 | 7.20 | | | 0.65 | | 0.40 |
| Alloy 53 | 57.85 | 13.90 | 12.25 | 7.00 | 7.00 | | | 0.25 | | 1.75 |
| Alloy 54 | 56.90 | 15.25 | 14.50 | 6.00 | 6.00 | | | | | 1.35 |
| Alloy 55 | 65.82 | 12.22 | 7.22 | 5.00 | 6.00 | | | 2.60 | | 1.14 |
| Alloy 56 | 58.72 | 18.26 | 8.99 | 4.26 | 7.22 | | | 1.00 | | 1.55 |
| Alloy 57 | 61.30 | 17.30 | 6.50 | 7.15 | 4.55 | | | 3.00 | | 0.20 |
| Alloy 58 | 65.80 | 14.89 | 8.66 | 4.35 | 4.05 | | | 2.25 | | |
| Alloy 59 | 63.99 | 12.89 | 10.25 | 8.00 | 4.22 | | | | | 0.65 |
| Alloy 60 | 71.24 | 10.55 | 5.22 | 7.55 | 4.55 | | | | | 0.89 |
| Alloy 61 | 61.88 | 11.22 | 12.55 | 7.45 | 5.22 | | | 0.56 | | 1.12 |

Accordingly, in the broad context of the present disclosure, the alloy chemistries that may preferably be suitable for formation of the Class 1 or Class 2 Steel herein include the following elements whose atomic ratios add up to 100. That is, the alloys may include Fe, Cr, Ni, B and Si. The alloys may optionally include V, Zr, C, W or Mn. Preferably, with respect to atomic ratios, the alloys may contain Fe at 53.5 to 72.1, Cr at 10.0 to 21.0, Ni at 2.8 to 14.50, B at 4.00 to 8.00 and Si at 4.00 to 8.00, and optionally V at 1.0 to 3.0, Zr at 1.00, C at 0.2 to 3.00, W at 1.00, or Mn at 0.20 to 4.6. Accordingly, the levels of the particular elements may be adjusted to total 100 as noted above.

The atomic ratio of Fe present may therefore be 53.5, 53.6, 53.7, 54.8, 53.9, 53.0 53.1, 53.2, 53.3, 53.4, 53.5, 53.6, 53.7, 53.8, 53.9, 54.0, 54.1, 54.2, 54.3, 54.4, 54.5, 54.6, 54.7, 54.8, 54.9, 55.0, 55.1, 55.2, 55.3, 55.4, 55.5, 55.6, 55.7, 55.8, 55.9, 56.0, 56.1, 56.2, 56.3, 56.4, 56.5, 56.6, 56.7, 56.8, 56.9 57.0, 57.1, 57.2, 57.3, 57.4, 57.5, 57.6, 57.7, 57.8, 57.9, 58.0, 58.1, 58.2, 58.3, 58.4, 58.5, 58.6, 58.7, 58.8, 58.9, 59.0, 59.1, 59.2, 59.3, 59.4, 59.5, 59.6, 59.7, 59.8, 60.0, 60.1, 60.2, 60.3, 60.4, 60.5, 60.6, 60.7, 60.8, 60.9 61.0, 61.1, 61.2, 61.3, 61.4, 61.5, 61.6, 61.7, 61.8, 61.9, 62.0, 62.1, 62.2, 62.3, 62.4, 62.5, 62.6, 62.7, 62.8, 62.9, 63.0, 63.1, 63.2, 63.3, 63.4, 63.5, 63.6, 63.7, 63.8, 63.9, 64.0, 64.1, 64.2, 64.3, 64.4, 64.5, 64.6, 64.7, 64.8, 64.9, 65.0, 65.1, 65.2, 65.3, 65.4, 65.5, 65.6, 65.7, 65.8, 65.9, 66.0, 66.1, 66.2, 66.3, 66.4, 66.5, 66.6, 66.7, 66.8, 66.9, 67.0, 67.1, 67.2, 67.3, 67.4, 67.5, 67.6, 67.7, 67.8, 67.9, 68.0, 68.1, 68.2, 68.3, 68.4, 68.5, 68.6, 68.7, 68.8, 68.9, 69.0, 70.0, 70.1, 70.2, 70.3, 70.4, 70.5, 70.6, 70.7, 70.8, 70.9, 71.0, 71.1, 71.2, 71.3, 71.4, 71.5, 71.6, 71.7, 71.8, 71.9, 72.0, 72.1. The atomic ratio of Cr may therefore be 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0, 16.1, 16.2, 16.3, 16.4, 16.5, 16.6, 16.7, 16.8, 16.9, 17.0, 17.1, 17.2, 17.3, 17.4, 17.5, 17.6, 17.7, 17.8, 17.9, 18.0, 18.1, 18.2, 18.3, 18.4, 18.5, 18.6, 18.7, 18.8, 18.9, 19.0, 19.1, 19.2, 19.3, 19.4, 19.5, 19.6, 19.7, 19.8, 19.9, 20.0, 20.1, 20.2, 20.3, 20.4, 20.5, 20.6, 20.7, 20.8, 20.9, 21.0. The atomic ratio of Ni may therefore be 2.8, 2.9 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.50. The atomic ratio of B may therefore be 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0. The atomic ratio of Si may therefore be 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0. The atomic ratio of Si may therefore be 4.0, 5.0, 6.0, 7.0, 8.0. The atomic ratio of the optional elements such as V may therefore be 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0. The atomic ratio of C may therefore be 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0. The atomic ratio of W may therefore be 1.0. The atomic ratio of Mn may therefore be 0.20, 0.3, 0.4, 0.5, 0.6, 0.7, 0.8, 0.9 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6.

The alloys may herein may also be more broadly described as an Fe based alloy (greater than or equal to 50.00 atomic percent) and including B and Si at levels of 4.00 atomic percent to 8.00 atomic percent and capable of forming the indicated structures (Class 1 and/or Class 2 Steel) and/or undergoing the indicated transformations upon exposure to mechanical stress and/or mechanical stress in the presence of heat treatment. Such alloys may be further defined by the mechanical properties that are achieved for the identified structures with respect to tensile strength and tensile elongation characteristics.

Alloy Properties

Thermal analysis was done on the as-solidified cast sheet samples on a NETZSCH DSC 404F3 PEGASUS V5 system. Differential thermal analysis (DTA) and differential scanning calorimetry (DSC) was performed at a heating rate of 10° C./minute with samples protected from oxidation through the use of flowing ultrahigh purity argon. In Table 3, elevated temperature DTA results are shown indicating the melting behavior for the alloys. As can be seen from the tabulated results in Table 3, the melting occurs in 1 to 3 stages with initial melting observed from ~1184° C. depending on alloy chemistry. Final melting temperature is up to ~1340° C. Variations in melting behavior may also reflect a complex phase formation at chill surface processing of the alloys depending on their chemistry.

TABLE 3

Differential Thermal Analysis Data for Melting Behavior

| Alloy | Onset (° C.) | Peak #1 (° C.) | Peak #2 (° C.) | Peak #3 (° C.) |
|---|---|---|---|---|
| Alloy 1 | 1234 | 1258 | 1331 | — |
| Alloy 2 | 1233 | 1252 | 1318 | — |
| Alloy 3 | 1230 | 1254 | 1325 | — |
| Alloy 4 | 1187 | 1233 | — | — |
| Alloy 5 | 1204 | 1246 | 1268 | — |
| Alloy 6 | 1203 | 1241 | — | — |
| Alloy 7 | 1207 | 1237 | — | — |
| Alloy 8 | 1184 | 1232 | — | — |
| Alloy 9 | 1190 | 1203 | 1235 | — |
| Alloy 10 | 1188 | 1195 | 1246 | 1314 |
| Alloy 11 | 1243 | 1256 | 1345 | — |
| Alloy 12 | 1221 | 1248 | 1330 | — |
| Alloy 13 | 1221 | 1248 | 1305 | — |
| Alloy 14 | 1231 | 1251 | 1330 | — |
| Alloy 15 | 1225 | 1241 | 1321 | — |
| Alloy 16 | 1225 | 1241 | 1338 | — |
| Alloy 17 | 1227 | 1245 | 1335 | — |
| Alloy 18 | 1225 | 1244 | 1340 | — |
| Alloy 19 | 1222 | 1239 | 1309 | — |
| Alloy 20 | 1221 | 1245 | 1309 | — |
| Alloy 21 | 1209 | 1242 | 1299 | — |
| Alloy 22 | 1223 | 1250 | 1315 | — |
| Alloy 23 | 1209 | 1234 | 1316 | — |
| Alloy 24 | 1222 | 1241 | 1316 | — |

The density of the alloys was measured on arc-melt ingots using the Archimedes method in a specially constructed balance allowing weighing in both air and distilled water. The density of each alloy is tabulated in Table 4 and was found to vary from 7.53 g/cm$^3$ to 7.77 g/cm$^3$. Experimental results have revealed that the accuracy of this technique is ±0.01 g/cm$^3$.

TABLE 4

Summary of Density Results (g/cm$^3$)

| Alloy | Density (avg) |
|---|---|
| Alloy 1 | 7.73 |
| Alloy 2 | 7.68 |
| Alloy 3 | 7.73 |
| Alloy 4 | 7.60 |
| Alloy 5 | 7.65 |
| Alloy 6 | 7.64 |
| Alloy 7 | 7.60 |
| Alloy 8 | 7.57 |
| Alloy 9 | 7.66 |
| Alloy 10 | 7.70 |
| Alloy 11 | 7.63 |
| Alloy 12 | 7.91 |
| Alloy 13 | 7.67 |
| Alloy 14 | 7.61 |
| Alloy 15 | 7.77 |
| Alloy 16 | 7.49 |
| Alloy 17 | 7.62 |
| Alloy 18 | 7.64 |
| Alloy 19 | 7.58 |
| Alloy 20 | 7.64 |
| Alloy 21 | 7.65 |
| Alloy 22 | 7.60 |
| Alloy 23 | 7.53 |
| Alloy 24 | 7.65 |

The tensile specimens were cut from the sheets using wire electrical discharge machining (EDM). The tensile properties were measured on an Instron mechanical testing frame (Model 3369), utilizing Instron's Bluehill control and analysis software. All tests were run at room temperature in displacement control with the bottom fixture held ridged and the top fixture moving; the load cell is attached to the top fixture. In Table 5, a summary of the tensile test results including total tensile strain, yield stress, ultimate tensile strength, Elastic Modulus and strain hardening exponent value are shown for as-cast sheets. The mechanical characteristic values depend on alloy chemistry and processing condition as will be discussed herein. As can be seen the ultimate tensile strength values vary from 590 to 1290 MPa. The tensile elongation varies from 0.79 to 11.27%. Elastic Modulus is measured in a range from 127 to 283 GPa. Strain hardening coefficient was calculated in a range from 0.13 to 0.44

TABLE 5

Summary on Tensile Test Results for As-Cast Sheets

| | Yield Stress (MPa) | Ultimate Tensile Strength (MPa) | Tensile Elongation (%) | Elastic Modulus (GPa) | Strain Hardening Exponent | Type of Behavior |
|---|---|---|---|---|---|---|
| Alloy 1 | 430 | 830 | 4.66 | 177 | 0.28 | Class 1 |
| | 490 | 720 | 2.63 | 175 | 0.23 | Class 1 |
| | 440 | 770 | 5.87 | 163 | 0.23 | Class 1 |
| Alloy 2 | 500 | 810 | 4.06 | 161 | 0.25 | Class 1 |
| | 400 | 840 | 3.71 | 165 | 0.27 | Class 1 |
| | 500 | 770 | 5.29 | 172 | 0.23 | Class 1 |
| | 400 | 840 | 6.10 | 169 | 0.27 | Class 1 |
| Alloy 3 | 500 | 950 | 9.77 | 156 | 0.24 | Class 1 |
| | 500 | 900 | 6.49 | 171 | 0.25 | Class 1 |
| | 500 | 920 | 10.53 | 181 | 0.25 | Class 1 |
| | 400 | 890 | 11.27 | 177 | 0.24 | Class 1 |
| Alloy 4 | 590 | 960 | 2.53 | 173 | 0.29 | Class 1 |
| | 600 | 970 | 2.77 | 185 | 0.29 | Class 1 |
| | 600 | 710 | 0.79 | 197 | 0.32 | Class 1 |
| Alloy 5 | 480 | 840 | 1.74 | 162 | 0.31 | Class 1 |
| | 620 | 1010 | 3.34 | 190 | 0.26 | Class 1 |
| | 600 | 910 | 2.45 | 205 | 0.25 | Class 1 |
| | 540 | 760 | 1.43 | 160 | 0.32 | Class 1 |
| Alloy 6 | 570 | 810 | 1.57 | 191 | N/A | Class 1 |
| | 580 | 930 | 2.45 | 189 | 0.28 | Class 1 |
| | 620 | 1030 | 2.99 | 201 | 0.26 | Class 1 |
| Alloy 7 | 560 | 860 | 1.86 | 178 | 0.28 | Class 1 |
| | 530 | 730 | 1.01 | 283 | N/A | Class 1 |
| | 560 | 940 | 2.85 | 187 | 0.28 | Class 1 |
| Alloy 8 | 600 | 930 | 2.20 | 182 | 0.29 | Class 1 |
| | 620 | 760 | 0.97 | 190 | 0.32 | Class 1 |
| Alloy 9 | 430 | 640 | 1.30 | 144 | N/A | Class 1 |
| Alloy 10 | 560 | 1030 | 3.56 | 184 | 0.31 | Class 1 |
| Alloy 11 | 500 | 890 | 5.83 | 172 | 0.23 | Class 1 |
| | 500 | 820 | 5.83 | 180 | 0.19 | Class 1 |
| Alloy 12 | 430 | 870 | 8.35 | 172 | 0.27 | Class 1 |
| | 390 | 590 | 1.97 | 172 | 0.28 | Class 1 |
| Alloy 13 | 470 | 800 | 3.73 | 170 | 0.26 | Class 1 |
| | 410 | 720 | 2.32 | 185 | 0.31 | Class 1 |
| Alloy 14 | 670 | 840 | 1.19 | 178 | N/A | Class 1 |
| Alloy 15 | 690 | 930 | 1.87 | 164 | 0.24 | Class 1 |
| Alloy 16 | 770 | 1010 | 1.06 | 186 | 0.44 | Class 2 |
| | 900 | 1290 | 1.56 | 185 | 0.44 | Class 2 |
| Alloy 17 | 590 | 780 | 1.30 | 203 | N/A | Class 1 |
| | 710 | 820 | 1.02 | 196 | N/A | Class 1 |
| | 670 | 820 | 1.20 | 181 | N/A | Class 1 |
| | 650 | 860 | 2.02 | 243 | 0.15 | Class 1 |
| Alloy 18 | 540 | 830 | 5.24 | 127 | 0.15 | Class 1 |
| | 560 | 1010 | 7.93 | 164 | 0.23 | Class 1 |
| | 550 | 940 | 7.36 | 168 | 0.19 | Class 1 |
| | 570 | 840 | 5.14 | 178 | 0.13 | Class 1 |
| | 570 | 850 | 5.84 | 177 | 0.15 | Class 1 |
| | 660 | 1020 | 7.07 | 174 | 0.18 | Class 1 |
| Alloy 19 | 670 | 910 | 1.90 | 181 | 0.23 | Class 1 |
| | 630 | 840 | 1.41 | 161 | N/A | Class 1 |
| | 620 | 730 | 1.02 | 155 | N/A | Class 1 |
| | 610 | 960 | 2.34 | 212 | 0.27 | Class 1 |
| | 760 | 990 | 2.09 | 202 | 0.18 | Class 1 |
| Alloy 20 | 540 | 1040 | 6.23 | 193 | 0.26 | Class 1 |
| | 560 | 1040 | 6.85 | 195 | 0.23 | Class 1 |
| | 520 | 850 | 2.59 | 174 | 0.29 | Class 1 |
| | 460 | 890 | 3.25 | 173 | 0.29 | Class 1 |

TABLE 5-continued

Summary on Tensile Test Results for As-Cast Sheets

| | Yield Stress (MPa) | Ultimate Tensile Strength (MPa) | Tensile Elon-gation (%) | Elastic Modulus (GPa) | Strain Hardening Exponent | Type of Behavior |
|---|---|---|---|---|---|---|
| Alloy 21 | 450 | 880 | 6.69 | 148 | 0.27 | Class 1 |
| | 450 | 850 | 2.96 | 200 | 0.30 | Class 1 |
| | 450 | 770 | 2.72 | 175 | 0.30 | Class 1 |
| | 410 | 640 | 1.98 | 163 | 0.30 | Class 1 |
| Alloy 22 | 600 | 800 | 1.19 | 191 | N/A | Class 1 |
| | 840 | 1060 | 2.15 | 140 | 0.24 | Class 1 |
| | 750 | 1100 | 2.30 | 181 | 0.25 | Class 1 |
| | 730 | 1000 | 1.99 | 178 | 0.25 | Class 1 |
| Alloy 23 | 420 | 810 | 2.82 | 148 | 0.36 | Class 1 |
| | 410 | 700 | 2.80 | 146 | 0.30 | Class 1 |
| Alloy 24 | 490 | 850 | 3.05 | 180 | 0.27 | Class 1 |
| | 510 | 970 | 6.87 | 184 | 0.23 | Class 1 |

Alloy Properties after Thermal Mechanical Treatment

Each sheet from each alloy was subjected to Hot Isostatic Pressing (HIP) using an American Isostatic Press Model 645 machine with a molybdenum furnace and with a furnace chamber size of 4 inch diameter by 5 inch height. The sheets were heated at 10° C./min until the target temperature was reached and were exposed to gas pressure for specified time which was held at 1 hour for these studies. HIP cycle parameters are listed in Table 6. The preferred aspect of the HIP cycle was to remove macrodefects such as pores (0.5 to 100 μm) and small inclusions (0.5 to 100 μm) by mimicking hot rolling at Stage 2 of Twin Roll Casting process or at Stage 1 or Stage 2 of Thin Slab Casting process. An example sheet before and after HIP cycle is shown in FIG. 6. As it can be seen, the HIP cycle which is a thermomechanical deformation process allows the elimination of some fraction of internal and external macrodefects and smoothes the surface of the sheet.

TABLE 6

HIP Cycle Parameters

| HIP Cycle ID | HIP Cycle Temperature [° C.] | HIP Cycle Pressure [psi] | HIP Cycle Time [hr] |
|---|---|---|---|
| Ha | 700 | 30,000 | 1 |
| Hb | 850 | 30,000 | 1 |
| Hd | 900 | 30,000 | 1 |
| Hc | 1000 | 30,000 | 1 |
| He | 1100 | 30,000 | 1 |
| Hf | 1150 | 30,000 | 1 |

The tensile specimens were cut from the sheets after HIPing using wire electrical discharge machining (EDM). The tensile properties were measured on an Instron mechanical testing frame (Model 3369), utilizing Instron's Bluehill control and analysis software. All tests were run at room temperature in displacement control with the bottom fixture held ridged and the top fixture moving with the load cell attached to the top fixture. In Table 7, a summary of the tensile test results including total tensile strain, yield stress, ultimate tensile strength, Elastic Modulus and strain hardening exponent value are shown for the cast sheets after HIP cycle. Mechanical characteristic values strongly depend on alloy chemistry and HIP cycle parameters. As can be seen the ultimate tensile strength values vary from 630 to 1440 MPa. The tensile elongation value varies from 1.11 to 24.41%. Elastic Modulus was measured in a range from 121 to 230 GPa. Strain hardening coefficient was calculated from the yield strength to the tensile strength resulting in ranges from 0.13 to 0.99 depending on alloy chemistry, structural formation, and different heat treatments.

TABLE 7

Summary on Tensile Test Results for HIPed Sheets

| Alloy | HIP Cycle ID | Yield Stress (MPa) | Ultimate Tensile Strength (MPa) | Tensile Elon-gation (%) | Elastic Modulus (GPa) | Strain Hardening Exponent | Type of Behavior |
|---|---|---|---|---|---|---|---|
| Alloy 1 | Ha | 460 | 870 | 4.12 | 163 | 0.27 | Class 1 |
| | | 460 | 990 | 10.82 | 186 | 0.25 | Class 1 |
| | Hb | 400 | 750 | 5.10 | 147 | 0.28 | Class 1 |
| | | 410 | 770 | 5.03 | 173 | 0.27 | Class 1 |
| | | 400 | 800 | 6.79 | 132 | N/A | Class 1 |
| | | 380 | 690 | 4.25 | 147 | 0.27 | Class 1 |
| | Hc | 340 | 790 | 14.64 | 170 | 0.27 | Class 1 |
| | | 370 | 850 | 18.46 | 160 | 0.29 | Class 1 |
| Alloy 2 | Ha | 410 | 800 | 5.80 | 162 | N/A | Class 1 |
| | | 410 | 860 | 7.99 | 142 | 0.27 | Class 1 |
| | Hb | 400 | 850 | 5.76 | 173 | 0.27 | Class 1 |
| | | 500 | 910 | 9.17 | 165 | 0.25 | Class 1 |
| | | 500 | 910 | 8.28 | 192 | 0.24 | Class 1 |
| | Hc | 400 | 910 | 21.16 | 168 | 0.25 | Class 1 |
| | | 400 | 900 | 19.65 | 190 | 0.25 | Class 1 |
| Alloy 3 | Ha | 450 | 920 | 6.54 | 166 | 0.27 | Class 1 |
| | | 450 | 950 | 8.37 | 181 | 0.25 | Class 1 |
| | Hb | 420 | 890 | 17.77 | 164 | 0.25 | Class 1 |
| | | 430 | 920 | 12.24 | 172 | 0.26 | Class 1 |
| | Hc | 380 | 790 | 8.49 | 160 | 0.26 | Class 1 |
| | | 360 | 790 | 13.40 | 194 | 0.26 | Class 1 |
| Alloy 4 | Ha | 610 | 1000 | 3.00 | 174 | 0.29 | Class 1 |
| | | 600 | 950 | 2.04 | 187 | 0.31 | Class 1 |
| | Hb | 510 | 830 | 1.80 | 183 | 0.34 | Class 1 |
| | | 560 | 870 | 2.11 | 177 | 0.31 | Class 1 |
| | Hc | 470 | 940 | 7.13 | 167 | 0.27 | Class 1 |
| | | 460 | 970 | 9.35 | 168 | 0.27 | Class 1 |
| Alloy 5 | Ha | 580 | 970 | 2.75 | 180 | 0.29 | Class 1 |
| | | 580 | 950 | 2.85 | 171 | 0.28 | Class 1 |
| | Hb | 510 | 970 | 4.32 | 208 | 0.27 | Class 1 |
| | | 560 | 910 | 3.26 | 155 | 0.29 | Class 1 |
| | Hc | 470 | 970 | 10.06 | 177 | 0.25 | Class 1 |
| | | 470 | 950 | 8.36 | 212 | 0.25 | Class 1 |
| Alloy 6 | Ha | 600 | 990 | 2.99 | 177 | 0.28 | Class 1 |
| | | 570 | 900 | 2.17 | 183 | 0.30 | Class 1 |
| | Hb | 580 | 1000 | 3.51 | 184 | 0.28 | Class 1 |
| | | 540 | 880 | 2.29 | 169 | 0.30 | Class 1 |
| | Hc | 490 | 930 | 5.81 | 184 | 0.27 | Class 1 |
| | | 490 | 970 | 8.89 | 191 | 0.25 | Class 1 |
| | | 470 | 910 | 5.01 | 179 | 0.28 | Class 1 |
| Alloy 7 | Ha | 590 | 810 | 1.16 | 196 | N/A | Class 1 |
| | | 590 | 970 | 2.43 | 193 | 0.29 | Class 1 |
| | Hb | 580 | 970 | 2.95 | 176 | 0.29 | Class 1 |
| | | 600 | 790 | 1.11 | 180 | N/A | Class 1 |
| | | 560 | 1010 | 3.89 | 176 | 0.29 | Class 1 |
| | Hc | 470 | 820 | 2.7S | 175 | 0.31 | Class 1 |
| | | 480 | 890 | 4.42 | 175 | 0.27 | Class 1 |
| Alloy 8 | Ha | 590 | 1030 | 2.86 | 186 | 0.31 | Class 1 |
| | Hb | 570 | 1020 | 3.17 | 177 | 0.30 | Class 1 |
| | Hc | 490 | 860 | 3.13 | 192 | 0.30 | Class 1 |
| | | 500 | 780 | 2.20 | 190 | 0.28 | Class 1 |
| | | 530 | 860 | 2.86 | 173 | 0.30 | Class 1 |
| Alloy 10 | Hb | 530 | 1030 | 4.47 | 180 | 0.31 | Class 1 |
| | | 530 | 1010 | 4.36 | 167 | 0.31 | Class 1 |
| Alloy 11 | Hb | 410 | 800 | 4.02 | 179 | 0.49 | Class 2 |
| | | 410 | 950 | 4.71 | 194 | 0.76 | Class 2 |
| | Hc | 540 | 1060 | 2.13 | 174 | 0.51 | Class 2 |
| | | 510 | 1330 | 7.97 | 133 | 0.43 | Class 2 |
| | | 520 | 1320 | 7.39 | 169 | 0.35 | Class 2 |

TABLE 7-continued

Summary on Tensile Test Results for HIPed Sheets

| Alloy | HIP Cycle ID | Yield Stress (MPa) | Ultimate Tensile Strength (MPa) | Tensile Elon-gation (%) | Elastic Modulus (GPa) | Strain Hardening Exponent | Type of Behavior |
|---|---|---|---|---|---|---|---|
| Alloy 12 | Ha | 430 | 770 | 2.87 | 131 | 0.29 | Class 1 |
| | | 450 | 890 | 7.05 | 121 | 0.28 | Class 1 |
| | Hb | 440 | 890 | 5.51 | 159 | 0.28 | Class 1 |
| | | 450 | 870 | 5.02 | 170 | 0.28 | Class 1 |
| | Hc | 400 | 870 | 12.73 | 177 | 0.24 | Class 1 |
| | | 440 | 880 | 12.88 | 145 | 0.24 | Class 1 |
| Alloy 13 | Hb | 460 | 850 | 5.13 | 149 | 0.27 | Class 1 |
| | | 380 | 820 | 5.57 | 154 | 0.30 | Class 1 |
| | Hc | 420 | 860 | 9.95 | 158 | 0.26 | Class 1 |
| | | 420 | 830 | 8.14 | 169 | 0.26 | Class 1 |
| | | 400 | 890 | 15.8 | 189 | 0.25 | Class 1 |
| Alloy 14 | Ha | 750 | 870 | 1.12 | 171 | 0.22 | Class 1 |
| | | 710 | 910 | 2.38 | 180 | 0.13 | Class 1 |
| | | 720 | 870 | 1.50 | 174 | 0.17 | Class 1 |
| | Hb | 620 | 850 | 4.45 | 209 | 0.14 | Class 2 |
| | Hc | 520 | 1340 | 10.76 | 143 | 0.79 | Class 2 |
| | | 500 | 1290 | 10.10 | 166 | 0.80 | Class 2 |
| | | 490 | 1220 | 9.15 | 159 | 0.70 | Class 2 |
| | Hd | 460 | 1310 | 11.30 | 140 | 0.98 | Class 2 |
| | | 440 | 1310 | 12.00 | 184 | 0.97 | Class 2 |
| | | 450 | 1320 | 12.54 | 154 | 0.94 | Class 2 |
| | He | 580 | 1230 | 8.54 | 155 | 0.67 | Class 2 |
| | | 410 | 830 | 5.09 | 166 | 0.40 | Class 2 |
| Alloy 15 | Ha | 870 | 1080 | 1.51 | 203 | N/A | Class 2 |
| | | 850 | 1180 | 2.98 | 186 | 0.21 | Class 2 |
| | | 860 | 1130 | 1.94 | 173 | 0.23 | Class 2 |
| | Hb | 720 | 960 | 1.98 | 171 | 0.22 | Class 1 |
| | | 730 | 920 | 1.59 | 183 | 0.22 | Class 1 |
| | Hc | 550 | 1090 | 10.23 | 184 | 0.54 | Class 2 |
| | | 540 | 1140 | 10.94 | 191 | 0.56 | Class 2 |
| | | 550 | 880 | 7.56 | 200 | 0.35 | Class 2 |
| Alloy 16 | Hb | 940 | 1290 | 2.01 | 168 | 0.26 | Class 2 |
| | Hc | 990 | 1260 | 1.57 | 178 | N/A | Class 2 |
| | | 980 | 1270 | 1.77 | 183 | N/A | Class 2 |
| Alloy 17 | He | 500 | 1150 | 7.32 | 191 | 0.60 | Class 2 |
| | | 500 | 1200 | 8.04 | 148 | 0.61 | Class 2 |
| | | 480 | 1140 | 7.12 | 169 | 0.55 | Class 2 |
| | Hc | 490 | 1280 | 10.39 | 157 | 0.95 | Class 2 |
| | | 430 | 1280 | 10.68 | 163 | 0.93 | Class 2 |
| | | 480 | 1310 | 10.86 | 169 | 0.99 | Class 2 |
| | Hd | 440 | 1340 | 16.13 | 185 | 0.96 | Class 2 |
| | | 430 | 1270 | 11.74 | 178 | 0.98 | Class 2 |
| Alloy 18 | He | 490 | 1280 | 8.70 | 148 | 0.73 | Class 2 |
| | | 470 | 1000 | 5.80 | 154 | 0.55 | Class 2 |
| | Hc | 430 | 1230 | 9.66 | 223 | 0.70 | Class 2 |
| | | 490 | 1290 | 10.81 | 160 | 0.99 | Class 2 |
| | | 460 | 1300 | 11.29 | 156 | 0.95 | Class 2 |
| | Hd | 440 | 1270 | 16.70 | 154 | 0.89 | Class 2 |
| | | 450 | 1240 | 12.39 | 139 | 0.99 | Class 2 |
| | | 420 | 1270 | 13.51 | 157 | 0.95 | Class 2 |
| Alloy 19 | He | 550 | 1250 | 8.36 | 135 | 0.60 | Class 2 |
| | | 570 | 1200 | 8.20 | 175 | 0.54 | Class 2 |
| | Hc | 480 | 1260 | 10.12 | 143 | 0.93 | Class 2 |
| | | 510 | 1130 | 8.55 | 145 | 0.88 | Class 2 |
| | Hd | 460 | 1300 | 13.11 | 125 | 0.77 | Class 2 |
| | | 490 | 1380 | 14.98 | 146 | 0.79 | Class 2 |
| | | 440 | 1340 | 13.23 | 230 | 0.98 | Class 2 |
| | Hf | 430 | 1260 | 12.41 | 124 | 0.68 | Class 2 |
| | | 440 | 1260 | 11.69 | 141 | 0.99 | Class 2 |
| | | 390 | 1350 | 17.98 | 201 | 0.90 | Class 2 |
| | | 440 | 1290 | 13.11 | 136 | 0.97 | Class 2 |
| | | 430 | 1030 | 8.83 | 186 | 0.95 | Class 2 |
| Alloy 20 | He | 500 | 990 | 14.26 | 175 | 0.19 | Class 1 |
| | | 490 | 950 | 12.42 | 170 | 0.20 | Class 1 |
| | | 470 | 880 | 5.57 | 178 | 0.23 | Class 1 |
| | Hc | 470 | 990 | 17.66 | 171 | 0.21 | Class 2 |
| | | 480 | 950 | 15.49 | 183 | 0.19 | Class 2 |
| | | 480 | 950 | 15.69 | 169 | 0.20 | Class 2 |
| | Hd | 410 | 810 | 12.11 | 162 | 0.21 | Class 2 |
| | | 430 | 920 | 16.83 | 155 | 0.22 | Class 2 |

TABLE 7-continued

Summary on Tensile Test Results for HIPed Sheets

| Alloy | HIP Cycle ID | Yield Stress (MPa) | Ultimate Tensile Strength (MPa) | Tensile Elon-gation (%) | Elastic Modulus (GPa) | Strain Hardening Exponent | Type of Behavior |
|---|---|---|---|---|---|---|---|
| Alloy 21 | He | 440 | 910 | 5.82 | 186 | 0.26 | Class 1 |
| | | 470 | 940 | 5.88 | 224 | 0.26 | Class 1 |
| | | 470 | 880 | 5.07 | 168 | 0.28 | Class 1 |
| | He | 390 | 910 | 18.40 | 169 | 0.26 | Class 1 |
| | | 440 | 920 | 10.96 | 176 | 0.25 | Class 1 |
| | | 440 | 910 | 8.94 | 178 | 0.26 | Class 1 |
| | Hd | 380 | 890 | 19.38 | 192 | 0.26 | Class 1 |
| | | 380 | 900 | 21.69 | 153 | 0.27 | Class 1 |
| | | 360 | 910 | 24.41 | 145 | 0.27 | Class 1 |
| Alloy 22 | He | 650 | 1050 | 9.17 | 170 | 0.16 | Class 2 |
| | | 620 | 1020 | 8.79 | 172 | 0.15 | Class 2 |
| | | 600 | 1040 | 9.08 | 188 | 0.16 | Class 2 |
| | Hc | 540 | 1080 | 12.36 | 171 | 0.63 | Class 2 |
| | | 540 | 980 | 11.05 | 163 | 0.41 | Class 2 |
| | | 530 | 830 | 8.18 | 147 | 0.33 | Class 2 |
| | Hd | 480 | 1270 | 19.38 | 158 | 0.83 | Class 2 |
| Alloy 23 | He | 650 | 1390 | 3.37 | 179 | 0.45 | Class 2 |
| | | 630 | 1430 | 3.84 | 175 | 0.46 | Class 2 |
| | Hc | 620 | 1250 | 2.59 | 140 | 0.51 | Class 2 |
| | | 570 | 910 | 1.43 | 142 | N/A | Class 2 |
| | | 690 | 1150 | 1.74 | 198 | 0.44 | Class 2 |
| | Hd | 550 | 1400 | 7.12 | 154 | 0.44 | Class 2 |
| | | 630 | 1440 | 5.14 | 167 | 0.34 | Class 2 |
| | | 660 | 1370 | 3.49 | 190 | 0.43 | Class 2 |
| Alloy 24 | He | 470 | 960 | 11.80 | 172 | 0.21 | Class 1 |
| | | 510 | 860 | 3.91 | 206 | 0.25 | Class 1 |
| | | 440 | 910 | 6.09 | 196 | 0.23 | Class 1 |
| | Hc | 450 | 920 | 15.94 | 174 | 0.20 | Class 2 |
| | | 460 | 930 | 16.05 | 156 | 0.21 | Class 2 |
| | | 450 | 990 | 19.24 | 148 | 0.22 | Class 2 |
| | Hd | 400 | 1010 | 23.05 | 165 | 0.26 | Class 2 |
| | | 410 | 960 | 19.83 | 186 | 0.24 | Class 2 |
| | | 440 | 1000 | 22.30 | 178 | 0.24 | Class 2 |

Sheet Properties of HIPed and Heat Treated Sheets

After HIPing, the sheet material was heat treated in a box furnace at parameters specified in Table 8. The preferred aspect of the heat treatment after HIP cycle was to estimate thermal stability and property changes of the alloys by mimicking Stage 3 of the Twin Roll Casting process and also Stage 3 of the Thin Slab Casting process.

TABLE 8

Heat Treatment Parameters

| Heat Treatment (ID) | Type | Temperature (° C.) | Time (min) | Cooling |
|---|---|---|---|---|
| T1 | Age Hardening/Spinodal Decomposition | 350 | 20 | In air |
| T2 | Age Hardening/Spinodal Decomposition | 475 | 20 | In air |
| T3 | Age Hardening/Spinodal Decomposition | 600 | 20 | In air |
| T4 | Age Hardening/Spinodal Decomposition | 700 | 20 | In air |
| T5 | Age Hardening/Spinodal Decomposition | 700 | 60 | In air |
| T6 | Age Hardening/Spinodal Decomposition | 700 | 60 | With furnace |

The tensile specimens were cut from the sheets after HIP cycle and heat treatment using wire electrical discharge machining (EDM). Tensile properties were measured on an Instron mechanical testing frame (Model 3369), utilizing Instron's Bluehill control and analysis software. All tests were run at room temperature in displacement control with the bottom fixture held ridged and the top fixture moving; the load cell is attached to the top fixture. In Table 9, a summary of the tensile test results including tensile elongation, yield stress, ultimate tensile strength, Elastic Modulus and strain hardening exponent value are shown for the cast sheets after HIP cycle and heat treatment. As can be seen the tensile strength values vary from 530 to 1580 MPa. The tensile elongation varies from 0.71 to 30.24% and was observed to depend on alloy chemistry, HIP cycle, and heat treatment parameters which preferably determine microstructural formation in the sheets. Note that further increases in ductility up to 50% would be expected based on optimization of processing to eliminate further defects, especially casting defects which are present as pores in some of these sheets. Elastic Modulus was measured in a range from 104 to 267 GPa. Mechanical characteristic values strongly depend on alloy chemistry, HIP cycle parameters and heat treatment parameters. Strain hardening coefficient was calculated from the yield strength to the tensile strength resulting in ranges from 0.11 to 0.99 depending on alloy chemistry, structural formation, and different heat treatments.

TABLE 9

Summary on Tensile Test Results for Cast Sheets after HIP Cycle and Heat Treatment

| Alloy | HIP Cycle ID | Heat Treatment ID | Yield Stress (MPa) | Ultimate Tensile Strength (MPa) | Tensile Elongation (%) | Elastic Modulus (GPa) | Strain Hardening Exponent | Type of Behavior |
|---|---|---|---|---|---|---|---|---|
| Alloy 1 | Ha | T1 | 430 | 800 | 3.46 | 180 | 0.28 | Class 1 |
| | | | 430 | 850 | 4.81 | 184 | 0.27 | Class 1 |
| | | T2 | 440 | 790 | 2.60 | 200 | 0.29 | Class 1 |
| | | | 440 | 730 | 2.19 | 197 | 0.27 | Class 1 |
| | | T3 | 440 | 800 | 3.48 | 176 | 0.28 | Class 1 |
| | | | 410 | 870 | 7.14 | 165 | 0.28 | Class 1 |
| | Hb | T1 | 430 | 720 | 3.45 | 182 | 0.26 | Class 1 |
| | | | 400 | 820 | 7.20 | 181 | 0.27 | Class 1 |
| | | T2 | 370 | 770 | 5.79 | 166 | 0.28 | Class 1 |
| | | | 410 | 860 | 8.25 | 187 | 0.26 | Class 1 |
| | | T3 | 390 | 830 | 7.36 | 174 | 0.28 | Class 1 |
| | | | 390 | 770 | 5.70 | 165 | 0.29 | Class 1 |
| | Hc | T1 | 350 | 830 | 21.53 | 159 | 0.26 | Class 1 |
| | | | 340 | 810 | 21.35 | 148 | 0.26 | Class 1 |
| | | | 350 | 800 | 17.88 | 165 | 0.26 | Class 1 |
| | | T2 | 360 | 640 | 3.74 | 207 | 0.27 | Class 1 |
| | | | 390 | 840 | 17.59 | 129 | 0.25 | Class 1 |
| | | T3 | 340 | 800 | 21.63 | 143 | 0.27 | Class 1 |
| | | | 370 | 840 | 19.72 | 193 | 0.26 | Class 1 |
| | | | 360 | 680 | 5.45 | 198 | 0.27 | Class 1 |
| Alloy 2 | Ha | T1 | 400 | 810 | 4.49 | 168 | 0.27 | Class 1 |
| | | | 400 | 840 | 6.10 | 153 | 0.28 | Class 1 |
| | | T2 | 400 | 740 | 3.30 | 207 | 0.29 | Class 1 |
| | | | 400 | 770 | 3.39 | 146 | 0.19 | Class 1 |
| | | T3 | 400 | 880 | 9.79 | 196 | 0.27 | Class 1 |
| | | | 400 | 660 | 2.57 | 146 | 0.29 | Class 1 |
| | | | 500 | 940 | 10.18 | 199 | 0.24 | Class 1 |
| | Hb | T1 | 500 | 970 | 13.69 | 183 | 0.24 | Class 1 |
| | | | 500 | 890 | 8.50 | 162 | 0.26 | Class 1 |
| | | | 400 | 770 | 4.02 | 173 | 0.28 | Class 1 |
| | | T2 | 500 | 800 | 4.58 | 173 | 0.25 | Class 1 |
| | | | 500 | 940 | 10.32 | 133 | 0.25 | Class 1 |
| | | | 400 | 930 | 20.92 | 187 | 0.25 | Class 1 |
| | | T3 | 400 | 940 | 11.11 | 168 | 0.25 | Class 1 |
| | | | 500 | 810 | 4.96 | 118 | 0.28 | Class 1 |
| | | | 400 | 840 | 12.72 | 172 | 0.26 | Class 1 |
| | Hc | T1 | 400 | 900 | 18.96 | 188 | 0.25 | Class 1 |
| | | | 400 | 680 | 4.96 | 151 | 0.29 | Class 1 |
| | | | 400 | 880 | 16.00 | 182 | 0.25 | Class 1 |
| | | T2 | 400 | 830 | 12.07 | 163 | 0.26 | Class 1 |
| | | | 400 | 860 | 11.52 | 198 | 0.25 | Class 1 |
| | | T3 | 400 | 900 | 19.25 | 185 | 0.26 | Class 1 |
| | | | 400 | 770 | 10.96 | 155 | 0.26 | Class 1 |
| | | | 400 | 850 | 18.48 | 168 | 0.26 | Class 1 |
| Alloy 3 | Ha | T1 | 430 | 850 | 5.94 | 174 | 0.28 | Class 1 |
| | | | 420 | 860 | 7.01 | 165 | 0.27 | Class 1 |
| | | | 430 | 720 | 3.16 | 172 | 0.29 | Class 1 |
| | | T2 | 430 | 790 | 4.01 | 168 | 0.28 | Class 1 |
| | | | 420 | 790 | 4.08 | 173 | 0.28 | Class 1 |
| | | | 430 | 720 | 2.03 | 193 | 0.30 | Class 1 |
| | | T3 | 400 | 680 | 1.84 | 188 | 0.29 | Class 1 |
| | | | 400 | 850 | 4.96 | 174 | 0.30 | Class 1 |
| | | | 410 | 750 | 3.20 | 155 | 0.30 | Class 1 |

TABLE 9-continued

Summary on Tensile Test Results for Cast Sheets after HIP Cycle and Heat Treatment

| Alloy | HIP Cycle ID | Heat Treatment ID | Yield Stress (MPa) | Ultimate Tensile Strength (MPa) | Tensile Elongation (%) | Elastic Modulus (GPa) | Strain Hardening Exponent | Type of Behavior |
|---|---|---|---|---|---|---|---|---|
| | Hb | T1 | 420 | 930 | 10.74 | 182 | 0.25 | Class 1 |
| | | | 420 | 930 | 12.71 | 182 | 0.25 | Class 1 |
| | | | 410 | 900 | 11.31 | 172 | 0.27 | Class 1 |
| | | T2 | 420 | 910 | 11.57 | 178 | 0.26 | Class 1 |
| | | | 410 | 920 | 12.26 | 183 | 0.26 | Class 1 |
| | | | 420 | 890 | 8.01 | 173 | 0.27 | Class 1 |
| | | T3 | 420 | 880 | 7.83 | 183 | 0.27 | Class 1 |
| | | | 400 | 890 | 8.52 | 196 | 0.27 | Class 1 |
| | | | 400 | 900 | 11.96 | 172 | 0.27 | Class 1 |
| | Hc | T1 | 360 | 680 | 5.67 | 158 | 0.27 | Class 1 |
| | | | 370 | 690 | 4.27 | 169 | 0.28 | Class 1 |
| | | | 360 | 830 | 14.38 | 169 | 0.26 | Class 1 |
| | | T2 | 350 | 730 | 7.76 | 158 | 0.27 | Class 1 |
| | | | 360 | 820 | 19.95 | 167 | 0.25 | Class 1 |
| | | T3 | 360 | 530 | 2.68 | 176 | 0.28 | Class 1 |
| | | | 370 | 830 | 18.76 | 166 | 0.26 | Class 1 |
| Alloy 4 | Ha | T1 | 600 | 820 | 1.21 | 183 | N/A | Class 1 |
| | | | 600 | 1020 | 3.26 | 180 | 0.28 | Class 1 |
| | | | 580 | 870 | 1.79 | 186 | 0.32 | Class 1 |
| | | T2 | 600 | 880 | 1.67 | 177 | N/A | Class 1 |
| | | | 620 | 830 | 1.11 | 197 | N/A | Class 1 |
| | | | 580 | 1040 | 3.32 | 182 | 0.29 | Class 1 |
| | | T3 | 620 | 1030 | 2.67 | 191 | 0.28 | Class 1 |
| | | | 600 | 1060 | 3.24 | 187 | 0.30 | Class 1 |
| | | | 590 | 980 | 3.44 | 164 | 0.29 | Class 1 |
| | Hb | T1 | 530 | 940 | 2.84 | 170 | 0.31 | Class 1 |
| | | | 580 | 960 | 2.77 | 156 | 0.31 | Class 1 |
| | | T2 | 540 | 940 | 2.89 | 196 | 0.30 | Class 1 |
| | | | 570 | 1050 | 4.73 | 182 | 0.28 | Class 1 |
| | | T3 | 540 | 1030 | 4.74 | 175 | 0.29 | Class 1 |
| | | | 540 | 970 | 3.13 | 189 | 0.31 | Class 1 |
| | Hc | T1 | 510 | 970 | 6.85 | 167 | 0.26 | Class 1 |
| | | | 490 | 930 | 5.29 | 196 | 0.27 | Class 1 |
| | | | 480 | 970 | 6.60 | 191 | 0.27 | Class 1 |
| | | T2 | 500 | 990 | 7.93 | 176 | 0.26 | Class 1 |
| | | | 490 | 950 | 6.36 | 173 | 0.27 | Class 1 |
| | | T3 | 490 | 970 | 8.16 | 187 | 0.26 | Class 1 |
| | | | 500 | 940 | 5.59 | 167 | 0.28 | Class 1 |
| Alloy 5 | Hb | T1 | 500 | 850 | 2.81 | 168 | 0.30 | Class 1 |
| | | | 520 | 830 | 2.42 | 165 | 0.30 | Class 1 |
| | | T2 | 490 | 850 | 3.08 | 171 | 0.30 | Class 1 |
| | | | 540 | 850 | 2.31 | 166 | 0.29 | Class 1 |
| | | T3 | 500 | 880 | 3.52 | 171 | 0.29 | Class 1 |
| | Hc | T1 | 450 | 710 | 2.29 | 186 | 0.29 | Class 1 |
| | | | 490 | 950 | 7.98 | 186 | 0.25 | Class 1 |
| | | | 470 | 880 | 5.75 | 199 | 0.26 | Class 1 |
| | | T2 | 460 | 940 | 7.65 | 197 | 0.26 | Class 1 |
| | | | 470 | 970 | 11.06 | 170 | 0.25 | Class 1 |
| | | | 460 | 950 | 9.12 | 190 | 0.26 | Class 1 |
| | | T3 | 480 | 950 | 8.95 | 191 | 0.25 | Class 1 |
| | | | 460 | 960 | 10.44 | 180 | 0.25 | Class 1 |
| Alloy 6 | Ha | T1 | 550 | 880 | 2.15 | 194 | 0.29 | Class 1 |
| | | T2 | 570 | 940 | 2.63 | 185 | 0.29 | Class 1 |
| | | T3 | 540 | 910 | 2.69 | 205 | 0.28 | Class 1 |
| | | | 600 | 980 | 2.66 | 203 | 0.28 | Class 1 |
| | Hb | T1 | 540 | 790 | 1.54 | 194 | N/A | Class 1 |
| | | | 560 | 920 | 2.45 | 198 | 0.28 | Class 1 |
| | | | 500 | 800 | 1.78 | 183 | 0.31 | Class 1 |
| | | T2 | 550 | 790 | 1.44 | 180 | N/A | Class 1 |
| | | | 530 | 880 | 2.38 | 170 | 0.30 | Class 1 |
| | | | 540 | 820 | 1.97 | 191 | 0.29 | Class 1 |
| | | T3 | 520 | 970 | 3.87 | 186 | 0.28 | Class 1 |
| | | | 550 | 970 | 3.24 | 180 | 0.30 | Class 1 |
| | Hc | T1 | 460 | 950 | 8.93 | 199 | 0.25 | Class 1 |
| | | | 480 | 950 | 7.21 | 173 | 0.26 | Class 1 |
| | | T2 | 490 | 970 | 8.62 | 180 | 0.25 | Class 1 |
| | | | 480 | 960 | 7.20 | 186 | 0.26 | Class 1 |
| | | | 480 | 940 | 6.98 | 177 | 0.27 | Class 1 |
| | | T3 | 460 | 940 | 9.55 | 193 | 0.25 | Class 1 |
| | | | 460 | 960 | 7.55 | 172 | 0.26 | Class 1 |
| | | | 470 | 980 | 8.63 | 170 | 0.26 | Class 1 |

TABLE 9-continued

Summary on Tensile Test Results for Cast Sheets after HIP Cycle and Heat Treatment

| Alloy | HIP Cycle ID | Heat Treatment ID | Yield Stress (MPa) | Ultimate Tensile Strength (MPa) | Tensile Elongation (%) | Elastic Modulus (GPa) | Strain Hardening Exponent | Type of Behavior |
|---|---|---|---|---|---|---|---|---|
| Alloy 7 | Ha | T1 | 570 | 950 | 2.46 | 191 | 0.30 | Class 1 |
| | | | 570 | 770 | 1.21 | 178 | N/A | Class 1 |
| | | T2 | 620 | 900 | 2.13 | 188 | 0.26 | Class 1 |
| | | | 570 | 910 | 2.04 | 203 | 0.29 | Class 1 |
| | | T3 | 580 | 930 | 2.35 | 187 | 0.30 | Class 1 |
| | | | 590 | 960 | 2.55 | 192 | 0.28 | Class 1 |
| | Hb | T1 | 560 | 990 | 3.36 | 167 | 0.30 | Class 1 |
| | | | 520 | 720 | 1.24 | 175 | N/A | Class 1 |
| | | T2 | 510 | 830 | 1.83 | 177 | 0.33 | Class 1 |
| | | | 500 | 840 | 2.58 | 136 | 0.34 | Class 1 |
| | | | 520 | 840 | 2.07 | 213 | 0.30 | Class 1 |
| | | T3 | 540 | 850 | 1.84 | 195 | 0.31 | Class 1 |
| | Hc | T1 | 480 | 800 | 2.38 | 202 | 0.29 | Class 1 |
| | | | 480 | 950 | 6.07 | 167 | 0.27 | Class 1 |
| | | T2 | 500 | 820 | 2.38 | 209 | 0.29 | Class 1 |
| | | | 450 | 680 | 1.60 | 158 | N/A | Class 1 |
| | | T3 | 480 | 840 | 3.01 | 152 | 0.32 | Class 1 |
| | | | 500 | 930 | 5.16 | 156 | 0.28 | Class 1 |
| Alloy 8 | Ha | T1 | 580 | 950 | 2.17 | 229 | 0.30 | Class 1 |
| | | T2 | 620 | 910 | 1.61 | 186 | N/A | Class 1 |
| | | | 640 | 1030 | 2.53 | 172 | 0.30 | Class 1 |
| | | T3 | 650 | 930 | 1.68 | 185 | N/A | Class 1 |
| | Hb | T1 | 580 | 1030 | 3.27 | 183 | 0.30 | Class 1 |
| | | | 590 | 1040 | 4.10 | 149 | 0.30 | Class 1 |
| | | T2 | 560 | 970 | 3.20 | 151 | 0.31 | Class 1 |
| | | | 560 | 980 | 2.77 | 181 | 0.31 | Class 1 |
| | | | 580 | 850 | 1.72 | 172 | 0.32 | Class 1 |
| | | T3 | 540 | 910 | 2.16 | 166 | 0.33 | Class 1 |
| | | | 580 | 1040 | 3.59 | 201 | 0.29 | Class 1 |
| | Hc | T1 | 500 | 950 | 4.55 | 186 | 0.28 | Class 1 |
| | | | 510 | 810 | 2.04 | 181 | 0.31 | Class 1 |
| | | T2 | 500 | 770 | 1.87 | 169 | 0.31 | Class 1 |
| | | | 520 | 990 | 6.06 | 177 | 0.28 | Class 1 |
| | | T3 | 470 | 580 | 0.90 | 138 | N/A | Class 1 |
| | | | 510 | 1000 | 7.32 | 162 | 0.27 | Class 1 |
| | | | 350 | 560 | 1.07 | 213 | N/A | Class 1 |
| Alloy 10 | Hb | T1 | 550 | 960 | 3.09 | 170 | 0.32 | Class 1 |
| | | | 530 | 800 | 1.76 | 176 | 0.32 | Class 1 |
| | | T2 | 510 | 1040 | 5.16 | 161 | 0.31 | Class 1 |
| | | | 540 | 720 | 1.32 | 183 | 0.31 | Class 1 |
| | | T3 | 530 | 850 | 2.23 | 171 | 0.32 | Class 1 |
| Alloy 11 | Hb | T1 | 500 | 1180 | 6.85 | 170 | 0.87 | Class 2 |
| | | | 480 | 920 | 4.94 | 172 | 0.50 | Class 2 |
| | | T2 | 490 | 1040 | 6.18 | 166 | 0.88 | Class 2 |
| | | | 460 | 900 | 4.75 | 179 | 0.66 | Class 2 |
| | | T3 | 470 | 1050 | 5.81 | 182 | 0.87 | Class 2 |
| | | | 430 | 1050 | 5.21 | 160 | 0.81 | Class 2 |
| | Hc | T1 | 700 | 1290 | 5.84 | 161 | 0.34 | Class 2 |
| | | | 880 | 1360 | 5.24 | 186 | 0.25 | Class 2 |
| | | | 840 | 1390 | 7.44 | 187 | 0.28 | Class 2 |
| | | T2 | 480 | 1070 | 5.12 | 170 | 0.52 | Class 2 |
| | | | 990 | 1140 | 2.44 | 166 | N/A | Class 2 |
| | | | 860 | 1410 | 6.66 | 163 | 0.40 | Class 2 |
| | | T3 | 530 | 1260 | 8.65 | 169 | 0.49 | Class 2 |
| | | | 400 | 1190 | 5.40 | 169 | 0.92 | Class 2 |
| | | | 430 | 1070 | 3.49 | 159 | 0.67 | Class 2 |
| Alloy 12 | Hb | T1 | 460 | 880 | 4.58 | 161 | 0.28 | Class 1 |
| | | | 420 | 780 | 3.71 | 181 | 0.28 | Class 1 |
| | | T2 | 430 | 780 | 3.48 | 169 | 0.30 | Class 1 |
| | | | 440 | 820 | 4.49 | 163 | 0.28 | Class 1 |
| | | T3 | 420 | 740 | 2.75 | 193 | 0.30 | Class 1 |
| | | | 400 | 830 | 4.17 | 185 | 0.28 | Class 1 |
| | Hc | T1 | 380 | 850 | 10.45 | 177 | 0.26 | Class 1 |
| | | | 370 | 880 | 16.32 | 185 | 0.25 | Class 1 |
| | | T2 | 420 | 870 | 10.49 | 146 | 0.25 | Class 1 |
| | | | 400 | 850 | 8.48 | 176 | 0.26 | Class 1 |
| | | T3 | 400 | 850 | 10.38 | 168 | 0.26 | Class 1 |
| | | | 390 | 850 | 10.28 | 159 | 0.25 | Class 1 |
| Alloy 13 | Hb | T1 | 470 | 800 | 2.98 | 168 | 0.29 | Class 1 |
| | | | 490 | 560 | 1.33 | 181 | N/A | Class 1 |
| | | T2 | 430 | 780 | 4.09 | 176 | 0.27 | Class 1 |
| | | T3 | 430 | 620 | 1.74 | 183 | N/A | Class 1 |
| | | | 470 | 800 | 2.98 | 168 | 0.29 | Class 1 |

TABLE 9-continued

Summary on Tensile Test Results for Cast Sheets after HIP Cycle and Heat Treatment

| Alloy | HIP Cycle ID | Heat Treatment ID | Yield Stress (MPa) | Ultimate Tensile Strength (MPa) | Tensile Elongation (%) | Elastic Modulus (GPa) | Strain Hardening Exponent | Type of Behavior |
|---|---|---|---|---|---|---|---|---|
| | Hc | T1 | 400 | 890 | 15.28 | 168 | 0.25 | Class 1 |
| | | | 420 | 880 | 12.08 | 158 | 0.25 | Class 1 |
| | | T2 | 410 | 860 | 11.06 | 170 | 0.26 | Class 1 |
| | | | 410 | 840 | 10.23 | 187 | 0.25 | Class 1 |
| | | T3 | 400 | 860 | 12.88 | 155 | 0.26 | Class 1 |
| | | | 410 | 880 | 12.70 | 148 | 0.26 | Class 1 |
| | | | 400 | 890 | 16.48 | 163 | 0.25 | Class 1 |
| Alloy 14 | Ha | T1 | 730 | 840 | 1.39 | 157 | N/A | Class 1 |
| | | | 700 | 940 | 4.32 | 172 | 0.11 | Class 1 |
| | | | 740 | 980 | 4.73 | 168 | 0.11 | Class 1 |
| | | T2 | 690 | 820 | 1.07 | 186 | N/A | Class 1 |
| | | | 710 | 910 | 2.57 | 167 | 0.13 | Class 1 |
| | | T3 | 680 | 810 | 1.61 | 153 | N/A | Class 1 |
| | | | 670 | 850 | 2.68 | 154 | 0.15 | Class 1 |
| | Hb | T1 | 630 | 1040 | 6.77 | 163 | 0.47 | Class 2 |
| | | | 620 | 1010 | 6.42 | 178 | 0.46 | Class 2 |
| | | T2 | 640 | 980 | 6.04 | 158 | 0.41 | Class 2 |
| | | | 640 | 1120 | 7.54 | 151 | 0.57 | Class 2 |
| | | T3 | 600 | 690 | 1.22 | 182 | 0.54 | Class 2 |
| | | | 650 | 1090 | 7.00 | 156 | 0.54 | Class 2 |
| | | | 620 | 1070 | 6.78 | 171 | 0.56 | Class 2 |
| | Hc | T1 | 520 | 1150 | 8.28 | 164 | 0.66 | Class 2 |
| | | | 520 | 1350 | 11.00 | 179 | 0.88 | Class 2 |
| | | | 500 | 1190 | 8.75 | 134 | 0.87 | Class 2 |
| | | T2 | 520 | 1320 | 10.04 | 191 | 0.77 | Class 2 |
| | | | 470 | 1170 | 8.49 | 169 | 0.88 | Class 2 |
| | | T3 | 490 | 1350 | 10.24 | 122 | 0.82 | Class 2 |
| | | | 490 | 1160 | 7.96 | 170 | 0.93 | Class 2 |
| | | | 500 | 1400 | 12.67 | 174 | 0.87 | Class 2 |
| | Hd | T1 | 420 | 1250 | 12.52 | 129 | 0.99 | Class 2 |
| | | | 440 | 1320 | 12.87 | 159 | 0.93 | Class 2 |
| | | | 410 | 910 | 7.73 | 128 | 0.81 | Class 2 |
| | | T2 | 370 | 930 | 8.07 | 148 | 0.88 | Class 2 |
| | | | 420 | 1050 | 8.66 | 126 | 0.91 | Class 2 |
| | | T3 | 430 | 1320 | 13.55 | 129 | 0.94 | Class 2 |
| | | | 440 | 1300 | 12.30 | 139 | 0.98 | Class 2 |
| | | | 440 | 830 | 6.59 | 186 | 0.80 | Class 2 |
| | | T4 | 400 | 1160 | 9.22 | 92 | 0.97 | Class 2 |
| | | | 400 | 1280 | 11.15 | 137 | 0.95 | Class 2 |
| | | | 380 | 1330 | 12.98 | 123 | 0.95 | Class 2 |
| | | T5 | 410 | 1300 | 10.35 | 140 | 0.97 | Class 2 |
| | | T6 | 410 | 1320 | 11.23 | 167 | 0.93 | Class 2 |
| | | | 380 | 1310 | 13.50 | 160 | 0.91 | Class 2 |
| | He | T1 | 560 | 1100 | 7.37 | 164 | 0.59 | Class 2 |
| | | | 590 | 1040 | 6.66 | 159 | 0.53 | Class 2 |
| | | T2 | 560 | 1140 | 7.70 | 159 | 0.61 | Class 2 |
| | | | 560 | 960 | 5.96 | 169 | 0.50 | Class 2 |
| | | T3 | 530 | 1050 | 6.60 | 167 | 0.60 | Class 2 |
| | | | 550 | 1070 | 6.80 | 148 | 0.63 | Class 2 |
| Alloy 15 | Hc | T1 | 600 | 1100 | 10.15 | 158 | 0.64 | Class 2 |
| | | | 560 | 950 | 8.66 | 187 | 0.46 | Class 2 |
| | | T2 | 600 | 1040 | 9.68 | 176 | 0.56 | Class 2 |
| | | | 550 | 1000 | 9.23 | 174 | 0.53 | Class 2 |
| | | T3 | 360 | 1120 | 10.73 | 146 | 0.71 | Class 2 |
| | | | 560 | 940 | 8.27 | 189 | 0.54 | Class 2 |
| Alloy 16 | Hb | T1 | 1130 | 1570 | 4.18 | 235 | 0.19 | Class 2 |
| | | T2 | 960 | 1160 | 0.71 | 222 | N/A | Class 2 |
| | | | 1280 | 1580 | 2.41 | 193 | 0.21 | Class 2 |
| | | T3 | 1070 | 1200 | 1.65 | 202 | 0.15 | Class 2 |
| | | | 1130 | 1300 | 1.71 | 220 | 0.16 | Class 2 |
| | | | 1140 | 1420 | 6.06 | 209 | 0.13 | Class 2 |
| | Hc | T1 | 1070 | 1270 | 1.26 | 175 | N/A | Class 2 |
| | | | 990 | 1160 | 0.70 | 203 | N/A | Class 2 |
| | | | 750 | 1420 | 2.42 | 183 | 0.21 | Class 2 |
| | | T2 | 1110 | 1210 | 0.74 | 198 | N/A | Class 2 |
| | | | 1290 | 1500 | 1.58 | ISO | 0.24 | Class 2 |
| | | | 1070 | 1260 | 0.86 | 328 | 0.30 | Class 2 |
| | | T3 | 980 | 1170 | 2.79 | 189 | 0.14 | Class 2 |
| | | | 1080 | 1260 | 4.14 | 222 | 0.10 | Class 2 |
| | | | 1080 | 1200 | 2.04 | 190 | 0.12 | Class 2 |

TABLE 9-continued

Summary on Tensile Test Results for Cast Sheets after HIP Cycle and Heat Treatment

| Alloy | HIP Cycle ID | Heat Treatment ID | Yield Stress (MPa) | Ultimate Tensile Strength (MPa) | Tensile Elongation (%) | Elastic Modulus (GPa) | Strain Hardening Exponent | Type of Behavior |
|---|---|---|---|---|---|---|---|---|
| Alloy 17 | He | T4 | 550 | 1300 | 9.21 | 166 | 0.76 | Class 2 |
| | | | 550 | 1280 | 8.89 | 184 | 0.77 | Class 2 |
| | | | 510 | 1210 | 7.80 | 142 | 0.69 | Class 2 |
| | | T5 | 530 | 1310 | 9.80 | 154 | 0.73 | Class 2 |
| | | | 540 | 1230 | 7.98 | 176 | 0.80 | Class 2 |
| | | | 470 | 1200 | 7.89 | 176 | 0.68 | Class 2 |
| | | T6 | 550 | 1170 | 7.72 | 125 | 0.52 | Class 2 |
| | | | 490 | 1200 | 7.69 | 170 | 0.54 | Class 2 |
| | | | 510 | 1350 | 10.27 | 127 | 0.62 | Class 2 |
| | Hd | T4 | 430 | 1320 | 13.06 | 186 | 0.97 | Class 2 |
| | | | 440 | 1310 | 13.81 | 157 | 0.92 | Class 2 |
| | | | 420 | 1280 | 10.20 | 165 | 0.93 | Class 2 |
| | | T5 | 400 | 1300 | 16.03 | 116 | 0.92 | Class 2 |
| | | | 390 | 1300 | 13.44 | 182 | 0.98 | Class 2 |
| | | | 400 | 1300 | 12.58 | 169 | 0.99 | Class 2 |
| | | T6 | 400 | 1290 | 11.11 | 132 | 0.98 | Class 2 |
| | | | 400 | 1300 | 12.21 | 160 | 0.89 | Class 2 |
| | Hc | T4 | 490 | 1260 | 9.74 | ISO | 0.87 | Class 2 |
| | | | 480 | 1360 | 12.92 | 176 | 0.90 | Class 2 |
| | | | 490 | 1300 | 10.75 | 148 | 0.78 | Class 2 |
| | | T5 | 430 | 1170 | 9.07 | 121 | 0.79 | Class 2 |
| | | | 470 | 1340 | 11.37 | 128 | 0.83 | Class 2 |
| | | | 460 | 1360 | 12.03 | 164 | 0.98 | Class 2 |
| | | T6 | 450 | 1360 | 12.07 | 170 | 0.97 | Class 2 |
| | | | 470 | 1290 | 10.06 | 157 | 0.99 | Class 2 |
| | | | 440 | 1290 | 11.53 | 135 | 0.79 | Class 2 |
| Alloy 18 | He | T4 | 470 | 1340 | 9.49 | 150 | 0.72 | Class 2 |
| | | | 500 | 1290 | 8.55 | 151 | 0.74 | Class 2 |
| | | | 490 | 1380 | 11.44 | 146 | 0.73 | Class 2 |
| | | T5 | 450 | 1360 | 10.41 | 162 | 0.66 | Class 2 |
| | | | 440 | 1290 | 8.51 | 161 | 0.64 | Class 2 |
| | | | 440 | 1330 | 9.71 | 159 | 0.67 | Class 2 |
| | | T6 | 480 | 1240 | 7.49 | 180 | 0.67 | Class 2 |
| | | | 420 | 1350 | 10.16 | 194 | 0.68 | Class 2 |
| | | | 480 | 1320 | 9.60 | 114 | 0.69 | Class 2 |
| | Hc | T4 | 450 | 1270 | 10.40 | 185 | 0.98 | Class 2 |
| | | | 460 | 1320 | 11.56 | 172 | 0.99 | Class 2 |
| | | T5 | 430 | 1250 | 9.00 | 177 | 0.90 | Class 2 |
| | | | 450 | 1290 | 9.57 | 182 | 0.99 | Class 2 |
| | | T6 | 430 | 1310 | 15.40 | 152 | 0.84 | Class 2 |
| | | | 420 | 1330 | 16.03 | 147 | 0.88 | Class 2 |
| | Hd | T4 | 420 | 1170 | 9.99 | 144 | 0.98 | Class 2 |
| | | | 440 | 1290 | 16.05 | 104 | 0.91 | Class 2 |
| | | | 370 | 1240 | 11.34 | 163 | 0.98 | Class 2 |
| | | T5 | 380 | 1290 | 14.91 | 131 | 0.86 | Class 2 |
| | | | 400 | 1290 | 12.67 | 118 | 0.86 | Class 2 |
| | | | 400 | 1290 | 14.93 | 136 | 0.89 | Class 2 |
| | | T6 | 380 | 1260 | 12.01 | 120 | 0.86 | Class 2 |
| | | | 360 | 1300 | 18.80 | 112 | 0.83 | Class 2 |
| | | | 360 | 1270 | 11.15 | 146 | 0.86 | Class 2 |
| Alloy 19 | He | T4 | 570 | 1200 | 7.80 | 162 | 0.68 | Class 2 |
| | | | 590 | 1260 | 8.18 | 154 | 0.71 | Class 2 |
| | | | 580 | 1290 | 8.49 | 175 | 0.67 | Class 2 |
| | | T5 | 560 | 1270 | 8.23 | 139 | 0.68 | Class 2 |
| | | | 550 | 1070 | 6.68 | 188 | 0.65 | Class 2 |
| | | | 570 | 950 | 5.80 | 172 | 0.50 | Class 2 |
| | | T6 | 540 | 1310 | 9.16 | 150 | 0.77 | Class 2 |
| | | | 560 | 1100 | 6.82 | 170 | 0.63 | Class 2 |
| | Hc | T4 | 480 | 1160 | 8.44 | 138 | 0.86 | Class 2 |
| | | | 530 | 1160 | 8.35 | 143 | 0.79 | Class 2 |
| | | T5 | 480 | 1300 | 8.72 | 172 | 0.98 | Class 2 |
| | | | 390 | 900 | 6.03 | 154 | 0.72 | Class 2 |
| | | T6 | 450 | 1030 | 6.18 | 169 | 0.56 | Class 2 |
| | | | 470 | 1270 | 7.93 | 150 | 0.71 | Class 2 |
| | | | 380 | 940 | 5.83 | 160 | 0.50 | Class 2 |
| | Hd | T4 | 480 | 1390 | 18.51 | 141 | 0.84 | Class 2 |
| | | | 460 | 1380 | 18.19 | 174 | 0.87 | Class 2 |
| | | | 500 | 1380 | 14.89 | 116 | 0.89 | Class 2 |
| | | T5 | 450 | 1370 | 16.27 | 180 | 0.88 | Class 2 |
| | | | 470 | 1330 | 10.96 | 205 | 0.97 | Class 2 |
| | | | 400 | 1370 | 17.69 | 195 | 0.91 | Class 2 |

TABLE 9-continued

Summary on Tensile Test Results for Cast Sheets after HIP Cycle and Heat Treatment

| Alloy | HIP Cycle ID | Heat Treatment ID | Yield Stress (MPa) | Ultimate Tensile Strength (MPa) | Tensile Elongation (%) | Elastic Modulus (GPa) | Strain Hardening Exponent | Type of Behavior |
|---|---|---|---|---|---|---|---|---|
| | | T6 | 430 | 1370 | 16.60 | 122 | 0.81 | Class 2 |
| | | | 430 | 1360 | 15.02 | 139 | 0.81 | Class 2 |
| | | | 450 | 1350 | 14.64 | 150 | 0.83 | Class 2 |
| | Hf | T4 | 430 | 1360 | 18.66 | 145 | 0.91 | Class 2 |
| | | | 430 | 1220 | 13.4 | 267 | N/A | Class 2 |
| | | | 380 | 1350 | 14.75 | 256 | 0.95 | Class 2 |
| | | T5 | 400 | 1350 | 15.29 | 153 | 0.97 | Class 2 |
| | | | 360 | 1350 | 14.19 | 171 | 0.98 | Class 2 |
| | | | 390 | 1240 | 9.48 | 143 | 0.80 | Class 2 |
| | | T6 | 370 | 1340 | 18.48 | 136 | 0.82 | Class 2 |
| | | | 390 | 1340 | 13.95 | 128 | 0.90 | Class 2 |
| | | | 360 | 1330 | 17.02 | 135 | 0.79 | Class 2 |
| Alloy 20 | He | T4 | 490 | 920 | 6.94 | 169 | 0.20 | Class 1 |
| | | | 520 | 1050 | 17.47 | 179 | 0.19 | Class 1 |
| | | | 490 | 1010 | 16.92 | 181 | 0.19 | Class 1 |
| | | T5 | 500 | 970 | 12.71 | 185 | 0.17 | Class 2 |
| | | | 540 | 980 | 13.52 | 168 | 0.19 | Class 2 |
| | | | 500 | 910 | 7.49 | 171 | 0.21 | Class 2 |
| | | T6 | 460 | 860 | 4.72 | 154 | 0.26 | Class 2 |
| | | | 500 | 990 | 14.58 | 129 | 0.19 | Class 2 |
| | | | 530 | 990 | 13.22 | 155 | 0.19 | Class 2 |
| | Hc | T4 | 470 | 960 | 15.19 | 156 | 0.19 | Class 2 |
| | | | 410 | 1090 | 22.28 | 176 | 0.27 | Class 2 |
| | | | 440 | 970 | 16.18 | 167 | 0.20 | Class 2 |
| | | T5 | 470 | 950 | 15.12 | 178 | 0.20 | Class 2 |
| | | | 460 | 910 | 13.33 | 180 | 0.17 | Class 2 |
| | | | 470 | 960 | 14.78 | 165 | 0.19 | Class 2 |
| | | T6 | 460 | 880 | 12.17 | 166 | 0.17 | Class 2 |
| | | | 500 | 1060 | 18.71 | 198 | 0.25 | Class 2 |
| | | | 500 | 1070 | 17.52 | 174 | 0.26 | Class 2 |
| | Hd | T4 | 440 | 950 | 17.41 | 167 | 0.23 | Class 2 |
| | | | 450 | 920 | 16.55 | 181 | 0.22 | Class 2 |
| | | | 470 | 990 | 20.19 | 138 | 0.28 | Class 2 |
| | | T5 | 420 | 1050 | 22.42 | 179 | 0.31 | Class 2 |
| | | | 440 | 1020 | 22.04 | 179 | 0.31 | Class 2 |
| | | T6 | 420 | 950 | 19.50 | 168 | 0.27 | Class 2 |
| | | | 440 | 1010 | 20.63 | 174 | 0.30 | Class 2 |
| Alloy 21 | He | T4 | 420 | 960 | 8.18 | 182 | 0.25 | Class 1 |
| | | | 500 | 990 | 8.99 | 215 | 0.24 | Class 1 |
| | | T5 | 460 | 900 | 5.94 | 195 | 0.26 | Class 1 |
| | | | 470 | 970 | 8.64 | 248 | 0.24 | Class 1 |
| | | | 490 | 960 | 7.79 | 165 | 0.26 | Class 1 |
| | | T6 | 410 | 1000 | 10.11 | 221 | 0.25 | Class 1 |
| | | | 460 | 980 | 10.63 | 186 | 0.25 | Class 1 |
| | | | 510 | 990 | 8.73 | 141 | 0.26 | Class 1 |
| | Hc | T4 | 430 | 970 | 15.00 | 184 | 0.23 | Class 1 |
| | | | 410 | 880 | 9.42 | 172 | 0.24 | Class 1 |
| | | | 430 | 910 | 9.18 | 159 | 0.25 | Class 1 |
| | | T5 | 430 | 930 | 13.58 | 170 | 0.25 | Class 1 |
| | | | 430 | 950 | 13.24 | 170 | 0.24 | Class 1 |
| | | | 430 | 920 | 10.24 | 162 | 0.26 | Class 1 |
| | | T6 | 430 | 880 | 7.08 | 177 | 0.27 | Class 1 |
| | | | 430 | 960 | 14.89 | 171 | 0.25 | Class 1 |
| | | | 430 | 970 | 17.95 | 184 | 0.25 | Class 1 |
| | Hd | T4 | 400 | 920 | 26.12 | 185 | 0.25 | Class 1 |
| | | | 380 | 910 | 24.16 | 156 | 0.26 | Class 1 |
| | | T5 | 390 | 940 | 30.24 | 165 | 0.26 | Class 1 |
| | | | 410 | 930 | 21.97 | 126 | 0.25 | Class 1 |
| | | | 390 | 930 | 27.70 | 140 | 0.25 | Class 1 |
| | | T6 | 360 | 860 | 14.74 | 179 | 0.25 | Class 1 |
| | | | 370 | 910 | 19.52 | 157 | 0.26 | Class 1 |
| | | | 390 | 930 | 25.58 | 181 | 0.25 | Class 1 |
| Alloy 22 | He | T4 | 610 | 910 | 6.11 | 204 | 0.11 | Class 2 |
| | | | 630 | 1100 | 9.88 | 156 | 0.19 | Class 2 |
| | | | 650 | 930 | 7.05 | 187 | 0.12 | Class 2 |
| | | T5 | 670 | 1100 | 10.01 | 165 | 0.37 | Class 2 |
| | | | 420 | 980 | 7.55 | 221 | 0.22 | Class 2 |
| | | | 590 | 1020 | 8.33 | 189 | 0.27 | Class 2 |
| | | T6 | 660 | 860 | 3.86 | 149 | 0.13 | Class 2 |
| | | | 620 | 980 | 8.15 | 121 | 0.16 | Class 2 |
| | | | 650 | 1170 | 10.95 | 169 | 0.20 | Class 2 |

TABLE 9-continued

Summary on Tensile Test Results for Cast Sheets after HIP Cycle and Heat Treatment

| Alloy | HIP Cycle ID | Heat Treatment ID | Yield Stress (MPa) | Ultimate Tensile Strength (MPa) | Tensile Elongation (%) | Elastic Modulus (GPa) | Strain Hardening Exponent | Type of Behavior |
|---|---|---|---|---|---|---|---|---|
| | Hc | T4 | 550 | 1260 | 15.93 | 160 | 0.68 | Class 2 |
| | | | 530 | 1260 | 15.88 | 163 | 0.68 | Class 2 |
| | | T5 | 530 | 1250 | 14.60 | 168 | 0.76 | Class 2 |
| | | | 530 | 970 | 10.06 | 165 | 0.55 | Class 2 |
| | | T6 | 520 | 1180 | 14.95 | 132 | 0.60 | Class 2 |
| | | | 580 | 1320 | 18.91 | 120 | 0.71 | Class 2 |
| | | | 510 | 840 | 7.91 | 189 | 0.16 | Class 2 |
| | Hd | T4 | 480 | 1270 | 19.77 | 140 | 0.80 | Class 2 |
| | | | 470 | 1120 | 14.22 | 154 | 0.74 | Class 2 |
| | | | 500 | 1270 | 19.73 | 118 | 0.81 | Class 2 |
| | | T5 | 410 | 930 | 10.57 | 176 | 0.82 | Class 2 |
| | | | 430 | 1010 | 11.95 | 177 | 0.79 | Class 2 |
| | | | 480 | 1140 | 13.78 | 130 | 0.79 | Class 2 |
| | | T6 | 480 | 1260 | 19.48 | 143 | 0.80 | Class 2 |
| | | | 460 | 880 | 10.01 | 154 | 0.47 | Class 2 |
| | | | 490 | 1210 | 16.19 | 155 | 0.76 | Class 2 |
| Alloy 23 | He | T4 | 510 | 1100 | 3.90 | 240 | 0.45 | Class 2 |
| | | | 530 | 1170 | 4.36 | 183 | 0.50 | Class 2 |
| | | T5 | 670 | 1320 | 6.29 | 173 | 0.43 | Class 2 |
| | | | 680 | 1120 | 4.58 | 165 | 0.23 | Class 2 |
| | | | 620 | 1010 | 3.66 | 242 | 0.25 | Class 2 |
| | | T6 | 620 | 1100 | 2.18 | 172 | 0.46 | Class 2 |
| | | | 650 | 1390 | 4.57 | 142 | 0.41 | Class 2 |
| | | | 630 | 1250 | 3.11 | 146 | 0.47 | Class 2 |
| | Hc | T4 | 500 | 960 | 3.24 | 166 | 0.46 | Class 2 |
| | | T6 | 730 | 1090 | 4.68 | 138 | 0.30 | Class 2 |
| | | | 630 | 1190 | 5.72 | 157 | 0.41 | Class 2 |
| | Hd | T4 | 570 | 1370 | 9.54 | 126 | 0.45 | Class 2 |
| | | | 490 | 1360 | 8.53 | 153 | 0.53 | Class 2 |
| | | | 540 | 1250 | 4.25 | 159 | 0.43 | Class 2 |
| | | T5 | 640 | 1350 | 9.19 | 177 | 0.30 | Class 2 |
| | | | 610 | 1350 | 7.96 | 191 | 0.29 | Class 2 |
| | | T6 | 660 | 1300 | 12.64 | 136 | 0.40 | Class 2 |
| | | | 690 | 1300 | 7.86 | 167 | 0.40 | Class 2 |
| | | | 670 | 1340 | 12.10 | 179 | 0.40 | Class 2 |
| Alloy 24 | He | T4 | 450 | 930 | 10.52 | 169 | 0.16 | Class 1 |
| | | | 470 | 930 | 8.27 | 181 | 0.22 | Class 1 |
| | | | 500 | 930 | 9.54 | 192 | 0.20 | Class 1 |
| | | T5 | 410 | 880 | 5.23 | 245 | 0.23 | Class 1 |
| | | | 510 | 930 | 9.90 | 195 | 0.19 | Class 1 |
| | | | 500 | 910 | 10.45 | 148 | 0.20 | Class 1 |
| | | T6 | 490 | 810 | 2.68 | 184 | 0.26 | Class 1 |
| | | | 490 | 810 | 3.88 | 170 | 0.23 | Class 1 |
| | | | 560 | 960 | 9.43 | 143 | 0.12 | Class 1 |
| | Hc | T4 | 470 | 1050 | 20.86 | 170 | 0.23 | Class 2 |
| | | | 440 | 910 | 15.19 | 177 | 0.20 | Class 2 |
| | | | 460 | 830 | 9.10 | 178 | 0.21 | Class 2 |
| | | T5 | 460 | 930 | 15.09 | 164 | 0.21 | Class 2 |
| | | | 370 | 910 | 15.18 | 130 | 0.23 | Class 2 |
| | | | 450 | 650 | 2.11 | 199 | 0.25 | Class 2 |
| | | T6 | 460 | 950 | 15.59 | 171 | 0.20 | Class 2 |
| | | | 460 | 1080 | 22.31 | 173 | 0.29 | Class 2 |
| | Hd | T4 | 410 | 900 | 17.13 | 158 | 0.24 | Class 2 |
| | | | 410 | 1070 | 26.26 | 152 | 0.29 | Class 2 |
| | | | 410 | 980 | 20.70 | 156 | 0.26 | Class 2 |
| | | T5 | 400 | 790 | 12.61 | 172 | 0.19 | Class 2 |
| | | | 410 | 1080 | 26.25 | 157 | 0.38 | Class 2 |
| | | | 410 | 1040 | 21.27 | 163 | 0.32 | Class 2 |
| | | T6 | 410 | 1040 | 22.79 | 146 | 0.33 | Class 2 |
| | | | 400 | 810 | 11.94 | 160 | 0.20 | Class 2 |
| | | | 410 | 1020 | 21.28 | 163 | 0.32 | Class 2 |

Comparative Examples

Case Example #1

Tensile Properties Comparison with Existing Steel Grades

Tensile properties of selected alloy were compared with tensile properties of existing steel grades. The selected alloys and corresponding treatment parameters are listed in Table 10. Tensile stress—strain curves are compared to that of existing Dual Phase (DP) steels (FIG. 7); Complex Phase (CP) steels (FIG. 8); Transformation Induced Plasticity (TRIP) steels (FIG. 9); and Martensitic (MS) steels (FIG. 10). A Dual Phase Steel may be understood as a steel type consisting of a ferritic matrix containing hard martensitic second phases in the form of islands, a Complex Phase Steel may be understood as a steel type consisting of a matrix consisting of ferrite and bainite containing small amounts of martensite, retained austenite, and pearlite, a Transformation Induced Plasticity steel may be understood as a steel type which consists of austenite embedded in a ferrite matrix which additionally contains hard bainitic and martensitic second phases and a Martensitic steel may be understood as a steel type consisting of a martensitic matrix which may contain small amounts of ferrite and/or bainite. As it can be seen, the alloys claimed in this disclosure have superior properties as compared to existing advanced high strength (AHSS) steel grades.

TABLE 10

Downselected Tensile Curves Labels and Identity

| Curve Label | Alloy | HIP | HT |
|---|---|---|---|
| A | Alloy 16 | 850° C. for 1 hour | 350° C. for 20 min |
| B | Alloy 23 | 1100° C. for 1 hour | None |
| C | Alloy 14 | 1000° C. for 1 hour | 650° C. for 20 min |
| D | Alloy 19 | 1100° C. for 1 hour | 700° C. for 20 min |
| E | Alloy 22 | 1100° C. for 1 hour | 700° C. for 20 min |
| F | Alloy 24 | 1100° C. for 1 hour | 700° C. for 20 min |
| G | Alloy 21 | 1100° C. for 1 hour | 700° C. for 1 hr |

Case Example #2

Modal Structure

Microstructure of the sheets from selected alloys with chemical composition specified in Table 2 in as-cast state, after HIP cycle and after HIP cycle with additional heat treatment was examined by scanning electron microscopy (SEM) using an EVO-MA10 scanning electron microscope manufactured by Carl Zeiss SMT Inc. Examples of Modal Structure (Structure #1) and NanoModal Structures (Structure #2) in selected alloys are shown in FIGS. 11 through 15. As it can be seen, the Modal structure may be formed in alloys in as-cast state (FIG. 11). To produce the NanoModal Structure additional thermal mechanical treatment might be needed such as HIP cycle (FIGS. 12-13) and/or HIP cycle with additional heat treatment (FIGS. 14 and 15). Other types of thermal mechanical treatment such as hot rolling, forging, hot stamping, etc., might be also effective for NanoModal Structure formation in the alloys with referenced chemistries described in this application. Formation of modal structure in sheet materials is the first step in achieving high ductility at moderate strength (Class 1 steels) while achieving the NanoModal Structure is enabling for Class 2 steels.

Case Example #3

Structure Development in Alloy 1

According to the alloy stoichiometries in Table 2, the Alloy 1 was weighed out from high purity elemental charges. It should be noted that Alloy 1 has demonstrated Class I behavior with high plastic ductility at moderate strength. The resulting charges were arc-melted into 4 thirty-five gram ingots and flipped and re-melted several times to ensure homogeneity. The resulting ingots were then re-melted and cast into 3 sheets under identical processing conditions with nominal dimensions of 65 mm by 75 mm by 1.8 mm thick. An example picture of one of the 1.8 mm thick Alloy 1 sheets is shown in FIG. 16. Two of the sheets were then HIPed at 1000° C. for 1 hour. One of the HIPed sheets was then subsequently heat treated at 350° C. for 20 minutes. The sheets including as-cast, HIPed and HIPed/heat treated ones were then cut up using a wire-EDM to produce samples for various studies including tensile testing, SEM microscopy, TEM microscopy, and X-ray diffraction.

Samples that were cut out of the Alloy 1 sheets were metallographically polished in stages down to 0.02 μm Grit to ensure smooth samples for scanning electron microscopy (SEM) analysis. SEM was done using a Zeiss EVO-MA10 model with the maximum operating voltage of 30 kV. Example SEM backscattered electron micrographs of the Alloy 1 sheet samples in the as-cast, HIPed and HIPed and heat treated conditions are shown in FIG. 17.

As shown, the microstructure of the Alloy 1 sheet exhibits Modal Structures in all three conditions. In the as-cast sample, three areas can be readily identified (FIG. 17*a*). The matrix phase in a form of individual grains of 5 to ~10 μm in size are marked by #3 in FIG. 17*a*. These grains are separated by intergranular regions (#2 in FIG. 17*a*). Additional isolated precipitates are marked by #1 in FIG. 17*a*. The black phase precipitates (#1) represent a high Si-containing phase as identified by energy-dispersive spectroscopy (EDS). The intergranular region (#2) apparently contains higher concentration of light elements (such as B, Si) as compared to matrix grains #3. After the HIP cycle, significant change occurs in the intergranular region (#2). A number of fine precipitates, which are typically less than 500 nm in size, form in this area (FIG. 17*b*). These precipitates are predominantly distributed in the intergranular region #2, while matrix grains #3 and precipitates #1 do not show obvious change in terms of morphology and size. After heat treatment, the microstructure appears to be similar to that after HIP cycle, but additional finer precipitates are formed (FIG. 17*c*).

Additional details of the Alloy 1 sheet structure are revealed by using X-ray diffraction. X-ray diffraction was done using a Panalytical X'Pert MPD diffractometer with a Cu Kα X-ray tube and operated at 40 kV with a filament current of 40 mA. Scans were run with a step size of 0.01° and from 25° to 95° two-theta with silicon incorporated to adjust for instrument zero angle shift. The resulting scans were then subsequently analyzed using Rietveld analysis using Siroquant software. In FIGS. 18-20, X-ray diffraction scan patterns are shown including the measured/experimental pattern and the Rietveld refined pattern for the Alloy 1 sheets in the as-cast, HIPed, and HIPed/heat treated conditions, respectively. As can be seen, good fits of the experimental data were obtained in all cases. Analysis of the X-ray patterns including specific phases found, their space groups and lattice parameters are shown in Table 11. Note that the space group represents a description of the symmetry of the crystal and can have one of 230 types and is further identified with its corresponding Hermann Maugin space group symbol. In all cases, two phases were found, a cubic γ-Fe (austenite) and a complex mixed transitional metal boride phase with the $M_2B$ stoichiometry. Note that while a third phase appears to exist from the SEM microscopy studies, this phase was not identified by the X-ray diffraction scans indicating that intergranular region might be represented by a fine mixture of two identified phases. Note also that the lattice parameters of the identified phases are different than that found for pure phases clearly indicating the effects of dissolution by the alloying elements. For example, γ-Fe as a pure phase would exhibit a lattice parameter equal to a=3.575 Å and $Fe_2B$ pure phase would exhibit lattice parameters equal to a=5.099 Å and c=4.240 Å. Note that based on the significant change in lattice parameters in the $M_2B$ phase is it likely that silicon is also dissolved into this structure so it is not a pure boride phase. Additionally, as can be seen in Table 11, while the phases do not change, the lattice parameters do change as a function of the condition of the sheet (i.e. cast, HIPed, HIPed and heat treated) which indicates that redistribution of alloying elements is occurring.

To examine the structural details of the Alloy 1 sheets in more detail, high resolution transmission electron microscopy (TEM) was utilized. To prepare TEM specimens, samples were cut from the as-cast, HIPed, and HIPed/heat-treated sheets. The samples were then ground and polished to a thickness of 30~40 μm. Discs of 3 mm in diameter were punched from these thin samples, and the final thinning was done by twin-jet electropolishing using a 30% $HNO_3$ in methanol base. The prepared specimens were examined in a JEOL JEM-2100 HR Analytical Transmission Electron Microscope (TEM) operated at 200 kV.

In FIG. 21, TEM micrographs of the Alloy 1 sheet samples are shown for a) As-Cast, b) HIPed at 1000° C. for 1 hour, and c) HIPed at 1000° C. for 1 hour with subsequent heat treatment at 350° C. for 20 minutes, respectively. In the as-cast sample, the matrix grains are in the range of 5~10 μm in size (FIG. 21*a*) that are consistent with the SEM observation in FIG. 17*a*. In addition, lamella structure is revealed in the intergranular regions that separate the matrix grains. The lamella structure corresponds to the area #2 in FIG. 17*a*. The lamella spacing is typically of ~200 nm, which is beyond the limit of SEM resolution and not seen in FIG. 17*a*. After HIP cycle, the lamella structure is re-organized into the isolated precipitates of less than 500 nm in size distributed in the region between matrix grains which retain the same size as in the as-cast sample (FIG. 21*b*). Unlike the lamellas, the precipitates are discontinuous indicating that significant microstructural changes were induced by HIP cycle. Heat treatment does not induce large changes in the microstructure, but some finer precipitates can be identified by TEM (FIG. 21*c*). As noted above, Alloy 1 behaves herein as a Class 1 Steel and there is no Static Nanophase Refinement or Dynamic Nanophase Strengthening observed.

TABLE 11

Rietveld Phase Analysis of Alloy 1 Sheet

| Condition | Phase 1 | Phase 2 |
|---|---|---|
| As-Cast Sheet | γ-Fe<br>Structure: Cubic<br>Space group #:<br>#225<br>Space group:<br>Fm3m<br>LP: a = 3.588 Å | $M_2B$<br>Structure:<br>Tetragonal<br>Space group #:<br>#140<br>Space group:<br>I4/mcm<br>LP: a = 5.168 Å<br>c = 4.201 Å |
| HIPed at 1000° C.<br>for 1 hour | γ-Fe<br>Structure: Cubic<br>Space group #:<br>#225<br>Space group:<br>Fm3m<br>LP: a = 3.585 Å | $M_2B$<br>Structure:<br>Tetragonal<br>Space group #:<br>#140<br>Space group:<br>I4/mcm<br>LP: a = 5.295 Å<br>c = 4.186 Å |
| HIPed at 1000° C. for<br>1 hour, Heat treated<br>at 350° C. for 20 minutes | γ-Fe<br>Structure: Cubic<br>Space group #:<br>#225<br>Space group:<br>Fm3m<br>LP: a = 3.585 Å | $M_2B$<br>Structure:<br>Tetragonal<br>Space group #:<br>#140<br>Space group:<br>I4/mcm<br>LP: a = 5.177 Å<br>c = 4.234 Å |

Case Example #4

Tensile Properties and Structural Changes in Alloy 1

The tensile properties of the steel sheet produced in this application will be sensitive to the specific structure and specific processing conditions that the sheet experiences. In FIG. 22, the tensile properties of Alloy 1 sheet representative of a Class 1 steel are shown in the as-cast, HIPed (1000° C. for 1 hour) and HIPed (1000° C. for 1 hour)/heat treated (350° C. for 20 minutes) conditions. As can be seen, the as-cast sheet shows relatively lower ductility than the HIPed and HIPed/heat treated samples. This increase in ductility may be attributed to both the reduction of macrodefects in the HIPed sheets and microstructural changes occurring in the modal structures of the HIPed or HIPed/heat treated sheets as discussed earlier in Case Example #3. Additionally, during the application of a stress during tensile testing, it will be shown that structural changes are occurring.

For the Alloy 1 sheet HIPed at 1000° C. for 1 hour and heat treated at 350° C. for 20 minutes, structural details were obtained through using X-ray diffraction which was done on both the undeformed sheet samples and on the gage sections of the deformed tensile specimens. X-ray diffraction was specifically done using a Panalytical X'Pert MPD diffractometer with a Cu Kα x-ray tube and operated at 40 kV with a filament current of 40 mA. Scans were run with a step size of 0.01° and from 25° to 95° two-theta with silicon incorporated to adjust for instrument zero angle shift. In FIG. 23, X-ray diffraction patterns are shown for the Alloy 1 sheet HIPed at 1000° C. for 1 hour and heat treated at 350° C. for 20 minutes in both the undeformed sheet and the gage section of the tensile tested sample cut out from the sheet. As can be readily seen, there are significant structural changes occurring during deformation with new phases formation as indicated by new peaks in the X-ray pattern. Peak shifts indicate that redistribution of alloying elements is occurring between the phases present in both samples.

Figure 24:
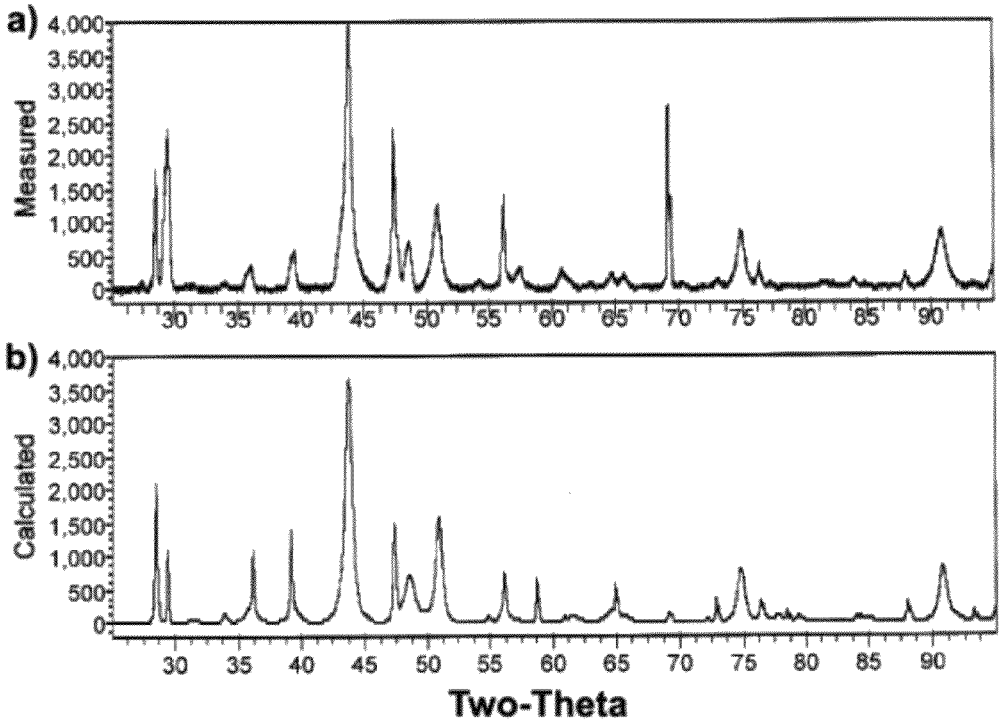
FIG. 24 is X-ray diffraction data for the gage section of tensile tested sample from Alloy 1 in the HIPed condition.
Figure 25:
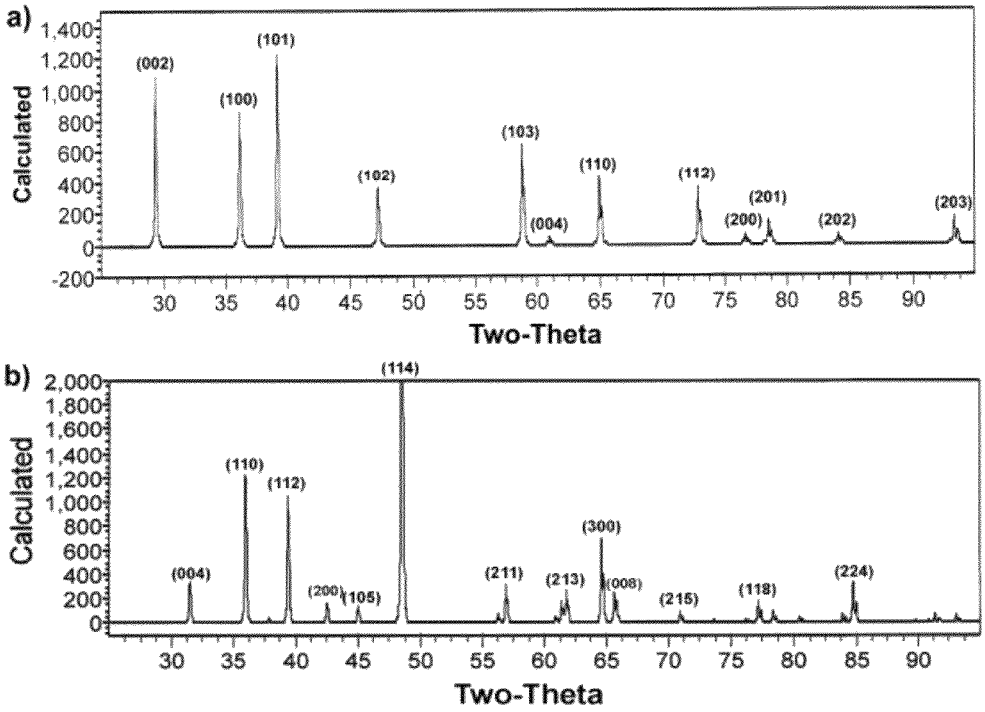
FIG. 25 is a calculated X-ray diffraction pattern for iron based hexagonal phase in the gage section of tensile tested sample from Alloy 1 sheet.

The X-ray pattern for the deformed Alloy 1 tensile tested specimen (HIPed (1000° C. for 1 hour)/heat treated at 350° C. for 20 minutes) was subsequently analyzed using Rietveld analysis using Siroquant software. As shown in FIG. 24, a close agreement was found between the measured and calculated patterns. In Table 12, the phases identified in the Alloy 1 sheet before and after tensile deformation are compared. As can be seen, the γ-Fe and $M_2B$ phases are present in the sheet before and after tensile testing although the lattice parameters changed indicating that the amount of solute elements dissolved in this phases changed. Furthermore, as shown in Table 12, after deformation, two new previously unknown hexagonal phases have been identified. One newly identified hexagonal phase is representative of a dihexagonal pyramidal class and has a hexagonal $P6_3mc$ space group (#186) and the calculated diffraction pattern with the diffracting planes listed is shown in FIG. 25*a*. The other hexagonal phase is representative of a ditrigonal dipyramidal class and has a hexagonal P6bar2C space group (#190) and the calculated diffraction pattern with the diffracting planes listed is shown in FIG. 25*b*. It is theorized based on the small crystal unit cell size that this phase is likely a silicon based phase possibly a previously unknown Si-B phase. Note that in the FIG. 25, key lattice planes are identified corresponding to significant Bragg diffraction peaks.

TABLE 12

Rietveld Phase Analysis of Alloy 1 Sheet; Before and After Tensile Testing

| Condition | Phase 1 | Phase 2 | Phase 3 | Phase 4 |
|---|---|---|---|---|
| Shed - HIPed at 1000° C. for 1 hour and heat treated at 350° C. for 20 minutes - Prior to tensile testing | γ-Fe Structure: Cubic Space group #: #225 Space group: Fm3m LP: a = 3.585 Å | $M_2B$ Structure: Tetragonal Space group #: #140 Space group; I4/mcm LP: a = 5.177 Å c = 4.234 Å | | |
| Sheet -HIPed at 1000° C. for 1 hour and heat treated at 350° C. for 20 minutes - After tensile testing | γ-Fe Structure: Cubic Space group #: #225 Space group: Fm3m LP: a = 3.589 Å | $M_2B$ Structure: Tetragonal Space group #: #140 Space group: I4/mcm LP: a = 5.290 Å c = 4.204 Å | Hexagonal Phase 1 (new) Structure: Hexagonal Space group #: #186 Space group: P63mc LP: a = 2.870 Å c = 6.079 Å | Hexagonal Phase 2 (new) Structure: Hexagonal Space group #: #190 Space group: P62barC LP: a = 4.995 Å c = 11.374 Å |

To focus on structural changes occurring during tensile testing, the Alloy 1 sheet HIPed at 1000° C. for 1 hour, and heat treated at 350° C. for 20 minutes was examined before and after deformation. TEM specimens were prepared from the undeformed HIPed and heat treated sheet and from the gage section of the sample cut off the same sheet and tested in tension until failure. TEM specimens were made from the sheet first by mechanical grinding/polishing, and then electrochemical polishing. TEM specimens of deformed tensile specimens were cut directly from the gage section and then prepared in an analogous manner to the undeformed sheet specimens. These specimens were examined in a JEOL JEM-2100 HR Analytical Transmission Electron Microscope operated at 200 kV.

Figure 26:
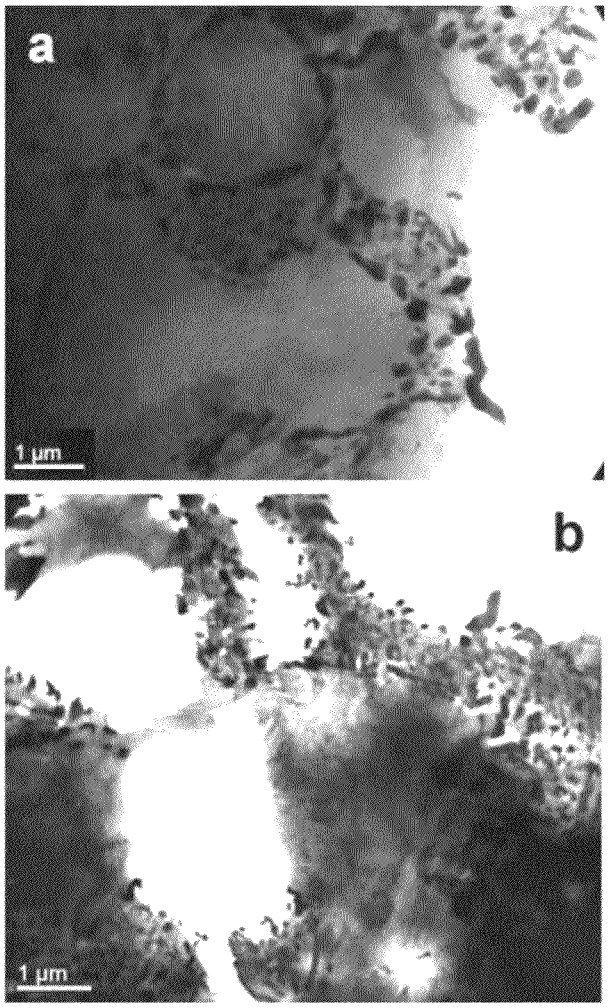
FIG. 26 is a TEM micrograph of Alloy 1 sheet HIPed under the indicated conditions.

In FIG. 26, TEM micrographs of microstructure in undeformed sheet and in a gage section after the tensile testing are shown. In the undeformed sample, the matrix grains are very clean, free of defects such as dislocations due to the high temperature exposure during HIP cycle, but the precipitates in the intergranular region are clearly seen (FIG. 26*a*). After the tensile testing, a high density of dislocations was observed in the matrix grains. A number of dislocations were also pinned by the precipitates in the intergranular region. Additionally, some very fine precipitates appear (i.e. Dynamic Nanophase Formation) within the matrix grains after the tensile testing, as shown in FIG. 26*b*. These very fine precipitates may correspond to the new hexagonal and face centered cubic type phases identified by X-ray diffraction (see subsequent section). The new hexagonal phase could also form as fine precipitates in the intergranular region where an extensive deformation may also take place. Due to the pinning effect by the precipitates, the matrix grains do not change their geometry during the tensile deformation. While the deformation-induced nanoscale phase formation may contribute to the hardening in the Alloy 1 sheet, the work-hardening of Alloy 1 appears to be dominated by dislocation based mechanisms including dislocation pinning by precipitates.

Figure 27:
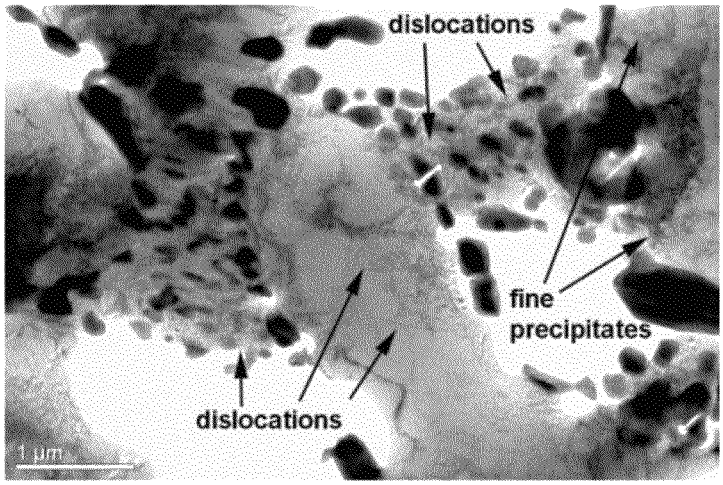
FIG. 27 is a TEM micrograph of the gage section microstructure in a tensile tested specimen from Alloy 1 sheet under the indicated conditions.
Figure 28:
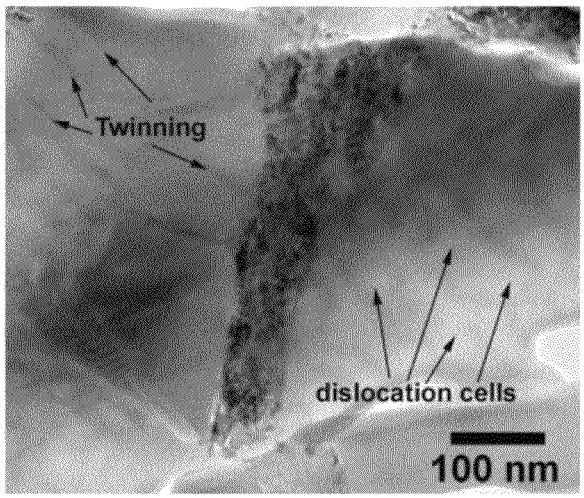
FIG. 28 is a TEM micrograph of the gage section microstructure in tensile tested specimen from Alloy 1 sheet under the indicated conditions.

The more detailed microstructure of the Alloy 1 sheet sample that was HIPed at 1000° C. for 1 hour, heat treated at 350° C. for 20 minutes, and, then tensile tested is shown in FIGS. 27-28. In the matrix grains, the dislocations of high density interact with each other forming dislocation cells. Occasionally, stacking faults and twins can be found in the grains as well. Meanwhile, the precipitates in the intergranular regions also pin down the dislocations, as shown in FIG. 27. Both in the grains and in the intergranular region, some very fine precipitates can be seen to form during the tensile deformation.

Due to micron sized matrix grains in the Alloy 1 sheet, the deformation is dominated by dislocation mechanism with corresponding strain hardening behavior. Some additional strain hardening may occur due to twining/stacking faults. A hexagonal phase formation corresponding to Dynamic Nanophase Strengthening (Mechanism #2) is also detected in the Alloy 1 sheet during the deformation. The Alloy 1 sheet is an example of Class 1 steel with Modal Structure formation and Dynamic Nanophase Strengthening leading to high ductility at moderate strength.

Case Example #5

Structure Development in Alloy 14

Figure 29:
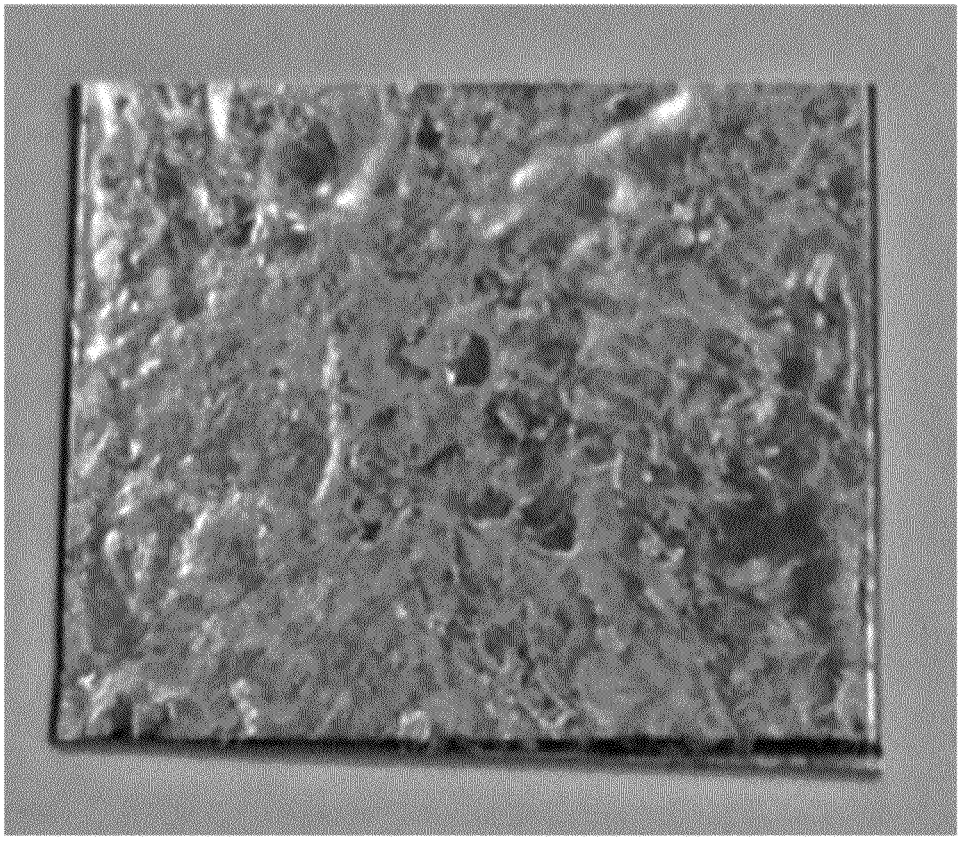
FIG. 29 is a picture of as-cast Alloy 14 sheet.

According to the alloy stoichiometries in Table 2, the Alloy 14 was weighed out using high purity elemental charges. I should be noted that Alloy 14 has demonstrated Class 2 behavior with high plastic ductility at high strength. The resulting charges were arc-melted into 4 thirty-five gram ingots and flipped and re-melted several times to ensure homogeneity. The resulting ingots were then re-melted and cast into 3 sheets under identical processing conditions with nominal dimensions of 65 mm by 75 mm by 1.8 mm thick. An example picture of one of the 1.8 mm thick Alloy 14 sheets is shown in FIG. 29. Two of the sheets were then HIPed at 1000° C. for 1 hour. One of the HIPed sheets was then subsequently heat treated at 350° C. for 20 minutes. The sheets in the as-cast, HIPed and HIPed/heat treated states were then cut up using a wire-EDM to produce samples for various studies including tensile testing, SEM microscopy, TEM microscopy, and X-ray diffraction.

Figure 30:
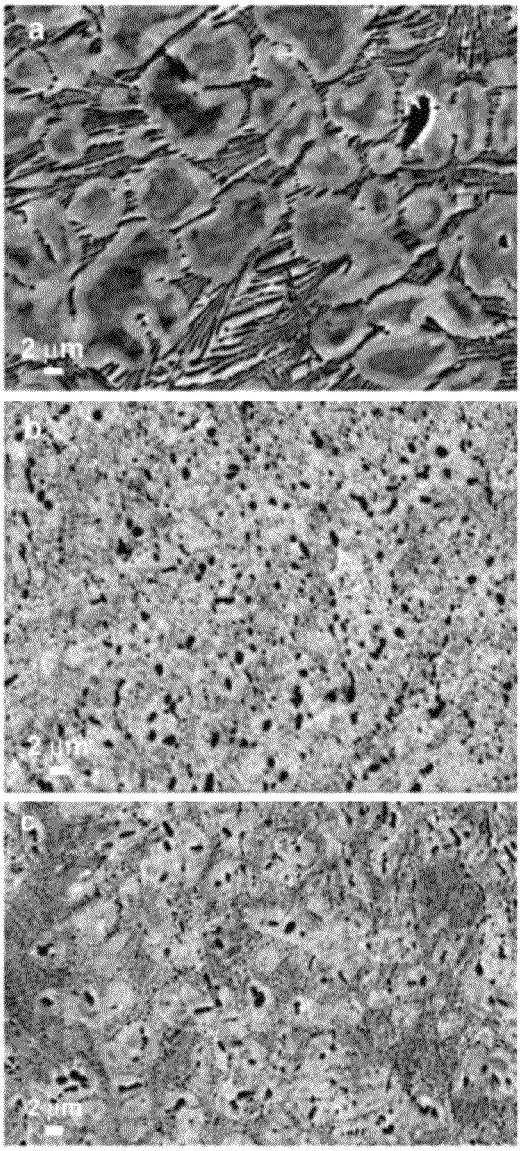
FIG. 30 is a SEM backscattered electron micrograph of the Alloy 14 sheet under the indicated conditions.

Samples that were cut out of the Alloy 14 sheets were metallography polished in stages down to 0.02 μm grit to ensure smooth samples for scanning electron microscopy (SEM) analysis. SEM was done using a Zeiss EVO-MA10 model with the maximum operating voltage of 30 kV. Example SEM backscattered electron micrographs of the Alloy 14 sheet sample in the as-cast, HIPed and HIPed/heat treated conditions are shown in FIG. 30. The Alloy 14 sheet has a modal structure in as-cast state (FIG. 30*a*) where micron sized matrix grains are separated by lamella structure. The lamella structure can be clearly resolved in the as-cast sample by SEM. Alloy 14 as-cast sheet has a higher volume fraction of the lamella structure as compared to the Alloy 1 sheet (case Example #3) with larger lamella spacing. Additionally, evidence for austenite to ferrite transformation was found to occur during the casting in Alloy 14 sheet. The matrix grains are surrounded by a layer that appears to have different chemical composition according to the revealed contrast. The brighter edges of the grains indicate less B or Si content as compared to the darker grain interior resulting from the compositional element re-distribution during alloy solidification. After HIP cycle, the lamellas completely disappeared and were replaced by very fine precipitates distributed nearly homogeneous in the sample volume such that the matrix grain boundaries cannot be readily identified (FIG. 30*b*). After the heat treatment, some finer precipitates can be found in the sample (FIG. 30*c*).

Figure 31:
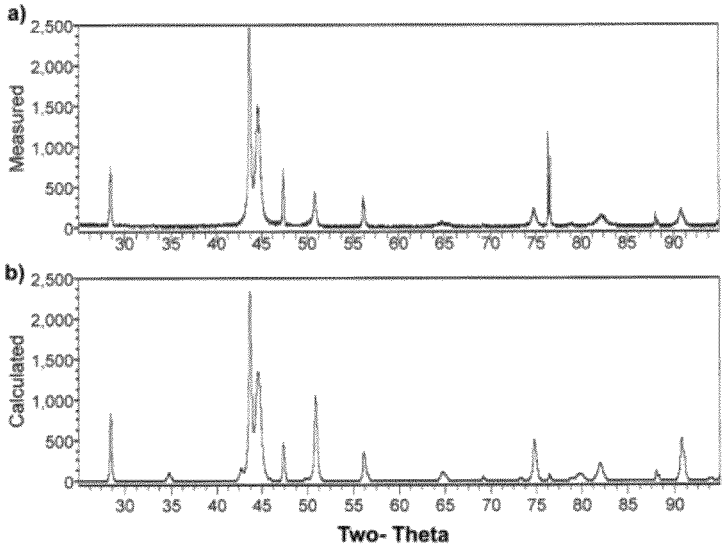
FIG. 31 X-ray diffraction data for Alloy 14 sheet under the indicated conditions.
Figure 32:
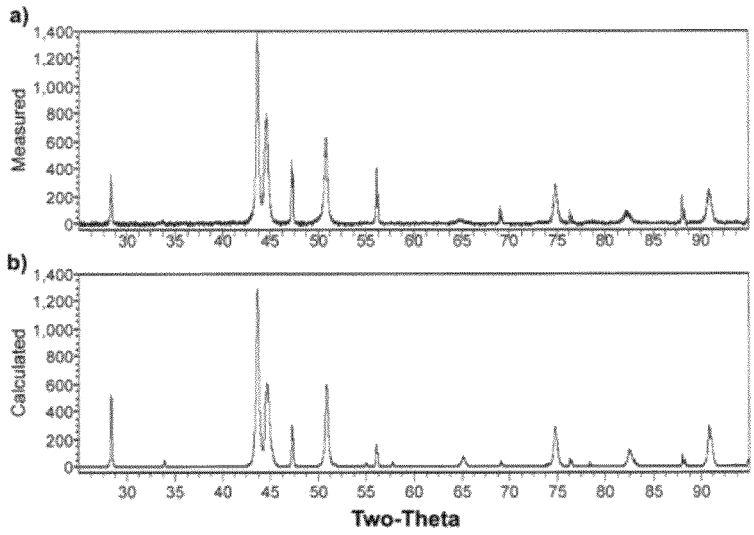
FIG. 32 is X-ray diffraction data for Alloy 14 in the HIPed condition.
Figure 33:
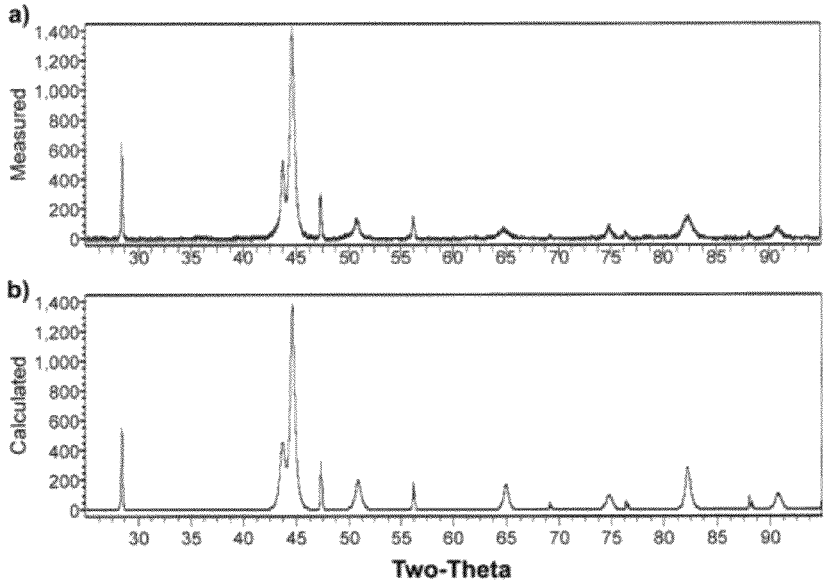
FIG. 33 is X-ray diffraction data for Alloy 14 in the HIPed condition.

Additional details of the Alloy 14 sheet structure are revealed using X-ray diffraction. X-ray diffraction was done using a Panalytical X'Pert MPD diffractometer with a Cu Kα x-ray tube and operated at 40 kV with a filament current of 40 mA. Scans were run with a step size of 0.01° and from 25° to 95° two-theta with silicon incorporated to adjust for instrument zero angle shift. The resulting scans were then subsequently analyzed using Rietveld analysis using Siroquant software. In FIGS. 31-33, X-ray diffraction scans are shown including the measured/experimental pattern and the Rietveld refined pattern for the Alloy 14 sheets in the as-cast, HIPed, and HIPed/heat treated conditions, respectively. As can be seen, good fits of the experimental data was obtained in all cases. Analysis of the X-ray patterns including specific phases found, their space groups and lattice parameters is shown in Table 13. Note that the space group represents a description of the symmetry of the crystal and can have one of 230 types and is further identified with its corresponding Hermann Maugin space group symbol.

In the as-cast sheet, three phases were identified, a cubic γ-Fe (austenite), a cubic α-Fe (ferrite) and a complex mixed transitional metal boride phase with the $M_2B$ stoichiometry. Note that the lattice parameters of the identified phases are different than that found for pure phases clearly indicating the dissolution of the alloying elements. For example, γ-Fe as a pure phase would exhibit a lattice parameter equal to a=3.575 Å, α-Fe would exhibit a lattice parameter equal to a=2.866 Å, and $Fe_2B_1$ pure phase would exhibit lattice parameters equal to a=5.099 Å and c=4.240 Å. Note that based on the significant change in lattice parameters in the $M_2B$ phase is it likely that silicon is also dissolved into this structure so it is not a pure boride phase. Additionally, as can be seen in Table 13, while the phases do not change, the lattice parameters do change as a function of the sheet condition (i.e. as-cast, HIPed, HIPed/heat treated), which indicates that redistribution of alloying elements is occurring.

TABLE 13

Rietveld Phase Analysis of Alloy 14 Sheet

| Condition | Phase 1 | Phase 2 | Phase 3 |
|---|---|---|---|
| As-Cast Sheet | γ-Fe<br>Structure:<br>Cubic<br>Space group #:<br>#225<br>Space group:<br>Fm3m<br>LP:<br>a = 3.589 Å | α-Fe<br>Structure:<br>Cubic<br>Space group #:<br>#229<br>Space group:<br>Im3m<br>LP:<br>a = 2.880 Å | $M_2B$<br>Structure:<br>Tetragonal<br>Space group #:<br>#140<br>Space group:<br>14/mcm<br>LP: a = 5.156 Å<br>c = 4.240 Å |
| HIPed at 1000° C. for 1 hour | γ-Fe<br>Structure:<br>Cubic<br>Space group #:<br>#225<br>Space group:<br>Fm3m<br>LP:<br>a = 3.587 Å | α-Fe<br>Structure:<br>Cubic<br>Space group #:<br>#229<br>Space group:<br>Im3m<br>LP:<br>a = 2.862 Å | $M_2B$<br>Structure:<br>Tetragonal<br>Space group #:<br>#140<br>Space group:<br>I4/mcm<br>LP: a = 5.275 Å<br>c = 4.003 Å |
| HIPed at 1000° C. for 1 hour, Heat treated at 350° C. for 20 minutes | γ-Fe<br>Structure:<br>Cubic<br>Space group #:<br>#225<br>Space group:<br>Fm3m<br>LP:<br>a = 3.591 Å | α-Fe<br>Structure:<br>Cubic<br>Space group #:<br>#229<br>Space group:<br>Im3m<br>LP:<br>a = 2.872 Å | $M_2B$<br>Structure:<br>Tetragonal<br>Space group #:<br>#140<br>Space group:<br>I4/mcm<br>LP: a = 5.226 Å<br>c = 4.025 Å |

To examine the structural features of the Alloy 14 sheets in more details, high resolution transmission electron microscopy (TEM) was utilized. To prepare TEM samples, specimens were cut from the as-cast, HIPed, and HIPed/heat-treated sheets, and then ground and polished to a thickness of ~30 to ~40 μm. Discs were then punched from these polished thin sheets, and then finally thinned by twin-jet electropolishing for TEM observation. The microstructure examination was conducted in a JEOL JEM-2100 HR Analytical Transmission Electron Microscope operated at 200 kV.

Figure 34:
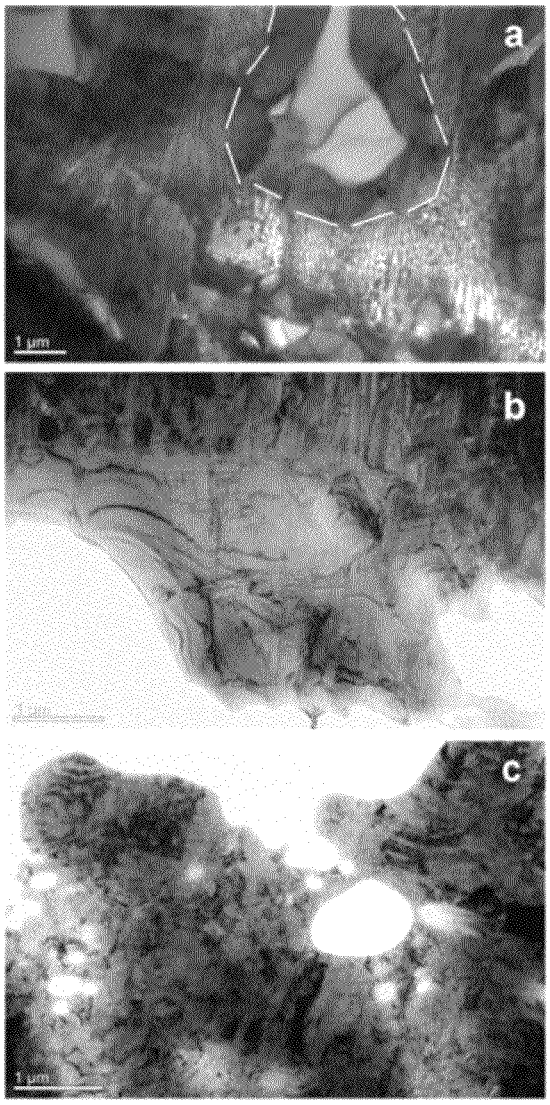
FIG. 34 are TEM micrographs of the Alloy 14 sheet under the indicated conditions.

In FIG. 34, TEM micrographs of the microstructure of the Alloy 14 sheets in the as-cast, HIPed, and HIPed/heat treated sheets are shown. In the as-cast sample, the lamella structure is predominant (FIG. 34*a*) that is consistent with the SEM observation. The matrix grains are mostly less than 10 μm in size. Similar to SEM observations, the edge of the grains exhibits a different composition as compared to the grain interior. As shown in FIG. 34*a*, the TEM analysis also shows a layer around the matrix grain. This layer does not belong to the lamella structure as shown by the dash line. After HIP cycle, the lamella structure disappears, and is instead replaced with precipitates in the intergranular regions (FIG. 34*b*). In addition, precipitation also occurred inside the matrix grains such that no matrix grain boundaries can be clearly seen. This is a significant microstructural difference from Alloy 1 sheet, in which no precipitates form within the matrix grains during HIP cycle. After additional heat treatment, another significant change in the microstructure was observed. As shown in FIG. 34*c*, there is a marked grain refinement in the sample resulting from the heat treatment and grains of ~200 to ~300 nm in size were formed. As revealed by X-ray diffraction, the austenite to ferrite transformation is activated, which led to the grain refinement in accordance with Step #2 (Mechanism #1 Static Nanophase Refinement) towards development of the NanoModal Structure (Step #3).

Case Example #6

Tensile Properties and Structural Changes in Alloy 14

Figure 35:
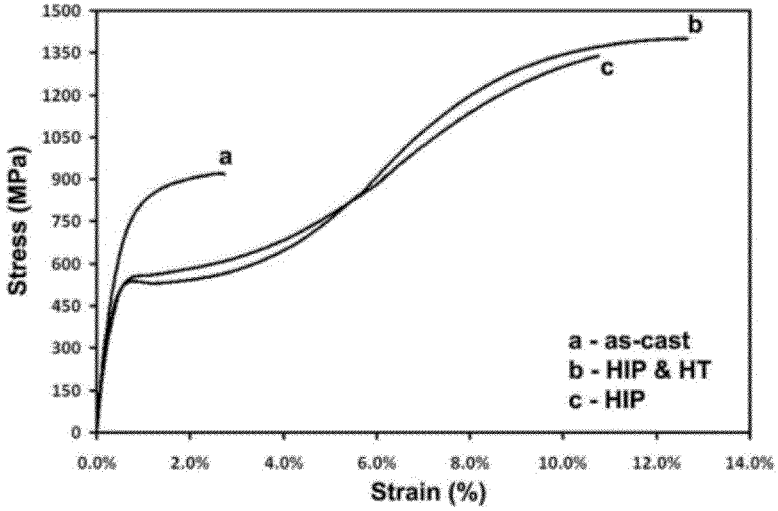
FIG. 35 is a stress-strain plot of Alloy 14 sheet under the indicated conditions.

The tensile properties of the steel sheet produced in this application will be sensitive to the specific structure and specific processing conditions that the sheet experiences. In FIG. 35, the tensile properties of Alloy 14 sheet representing a Class 2 steel are shown in the as-cast, HIPed (1000° C. for 1 hour) and HIPed (1000° C. for 1 hour)/heat treated (350° C. for 20 minutes) conditions. As can be seen, the as-cast sheet shows much lower ductility than the HIPed and the HIPed/heat treated samples. This increase in ductility can be attributed to both the reduction of macrodefects in the HIPed sheets and microstructural changes occurring in the modal structures of the HIPed or HIPed/heat treated sheet as discussed earlier in Case Example #5. Additionally, during the application of a stress during tensile testing it will be shown the structural changes which are occurring.

Figure 36:
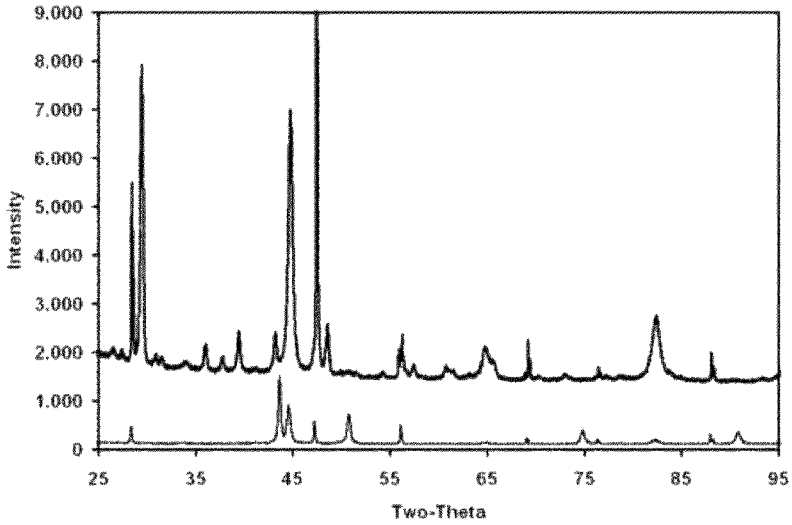
FIG. 36 is a comparison of X-ray data for Alloy 14 sheet under the indicated conditions.

For the Alloy 14 sheet HIPed at 1000° C. for 1 hour, additional structural details were obtained through using X-ray diffraction which was done on both the undeformed sheet samples and the gage sections of the deformed tensile specimens. X-ray diffraction was specifically done using a Panalytical X'Pert MPD diffractometer with a Cu Kα X-ray tube and operated at 40 kV with a filament current of 40 mA. Scans were run with a step size of 0.01° and from 25° to 95° two-theta with silicon incorporated to adjust for instrument zero angle shift. In FIG. 36, X-ray diffractions patterns are shown for the Alloy 14 sheet HIPed at 1000° C. for 1 hour in both the undeformed sheet condition and the gage section of the tensile tested specimen cut out from the sheet. As can be readily seen, there are significant structural changes occurring during deformation with new phases formation as indicated by new peaks in the X-ray pattern. Peak shifts indicate that redistribution of alloying elements is occurring between the phases present in both samples.

Figure 37:
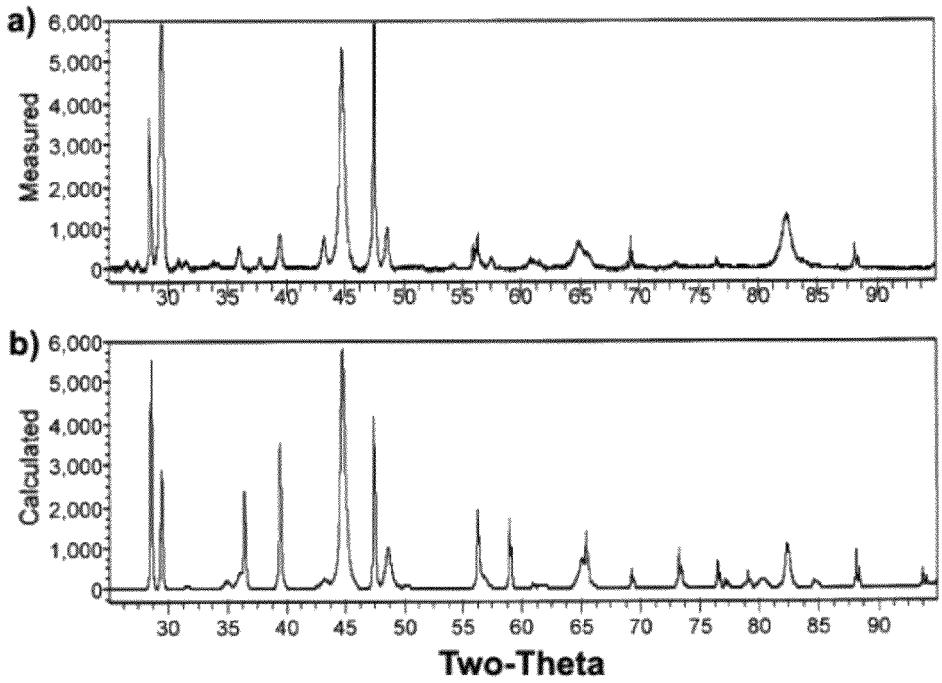
FIG. 37 is X-ray diffraction data from the gage section of tensile tested sample from Alloy 14 in the HIPed condition.
Figure 38:
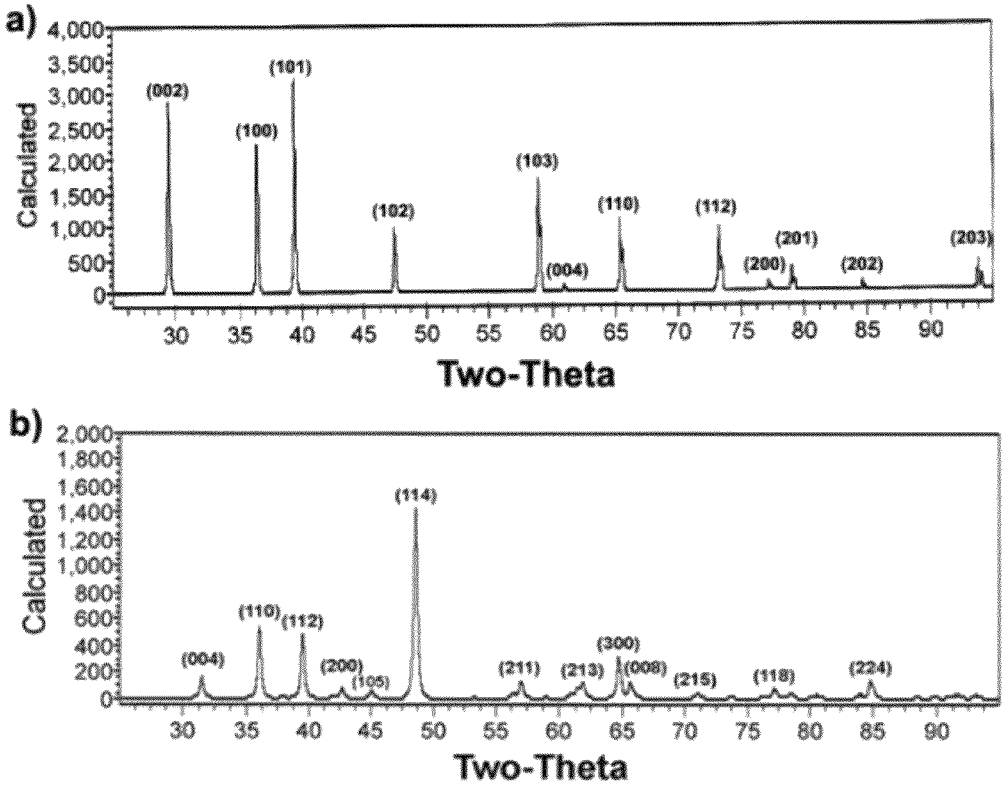
FIG. 38 is a calculated X-ray diffraction pattern for iron based hexagonal phase in the gage section of tensile tested sample from Alloy 14 sheet in the HIPed condition.

The X-ray pattern for the deformed Alloy 14 tensile tested specimen (HIPed (1000° C. for 1 hour) was subsequently analyzed using Rietveld analysis using Siroquant software. As shown in FIG. 37, a close agreement was found between the measured and calculated patterns. In Table 14, the phases identified in the Alloy 14 undeformed sheet and in a gage section of tensile specimens are compared. As can be seen, the $M_2B$ phase exists in the sheet before and after tensile testing although the lattice parameters changed indicating that the amount of solute elements dissolved in this phases changed. Additionally, the γ-Fe phase existing in the undeformed Alloy 14 sheet no longer exists in the gage section of tensile tested specimen indicating that a phase transformation took place. Rietveld analysis of the undeformed sheet and tensile tested specimen indicates that the volume fraction of α-Fe content exhibited only a slight increase measured from ~28% to ~29%. This would indicate that the γ-Fe phase transformed into multiple phases including possibly α-Fe and at least two new previously unknown phases. As shown in Table 14, after deformation, two new previously unknown hexagonal phases have been identified. One newly identified hexagonal phase is representative of a dihexagonal pyramidal class and has a hexagonal $P6_3mc$ space group (#186) and the calculated diffraction pattern with the diffracting planes listed is shown in FIG. 38*a*. The other hexagonal phase is representative of a ditrigonal dipyramidal class and has a hexagonal P6bar2C space group (#190) and the calculated diffraction pattern with the diffracting planes listed is shown in FIG. 38*b*. It is theorized based on the small crystal unit cell size that this phase is likely a silicon based phase possibly a previously unknown Si-B phase. Note that in the FIG. 38, key lattice planes are identified corresponding to significant Bragg diffraction peaks.

TABLE 14

Rietveld Phase Analysis of Alloy 14 Sheet; Before and After Tensile Testing

| Condition | Phase 1 | Phase 2 | Phase 3 | Phase 4 |
|---|---|---|---|---|
| Sheet - HIPed at 1000° C. for 1 hour - Prior to tensile testing | γ-Fe Structure: Cubic Space group #: #225 Space group: Fm3m LP: a = 3.587 Å | α-Fe Structure: Cubic Space group #: #229 Space group: Im3m LP: a = 2.862 Å | $M_2B$ Structure: Tetragonal Space group #: #140 Space group: I4/mcm LP: a = 5.275 Å c = 4.003 Å | |
| Sheet - HIPed at 1000° C. for 1 hour - After tensile testing | α-Fe Structure: Cubic Space group #: #229 Space group: Im3m LP: a = 2.870 Å | $M_2B$ Structure: Tetragonal Space group #: #140 Space group: I4/mcm LP: a = 5.150 Å c = 4.195 Å | Hexagonal Phase 1 (new) Structure: Hexagonal Space group #: #186 Space group: P63mc LP: a = 2.856 Å c = 6.087 Å | Hexagonal Phase 2 (new) Structure: Hexagonal Space group #: #190 Space group: P62barC LP: a = 4.999 Å c = 11.350 Å |

To examine the structural changes of the Alloy 14 sheets induced by tensile deformation, high resolution transmission electron microscopy (TEM) was utilized. To prepare TEM samples, they were cut from the gage section of the tensile tested specimens and polished to a thickness of ~30 to ~40 μm. Discs were punched from these polished thin sheets, and then finally thinned by twin-jet electropolishing for TEM observation. These specimens were examined in a JEOL JEM-2100 HR Analytical Transmission Electron Microscope operated at 200 kV.

Figure 39:
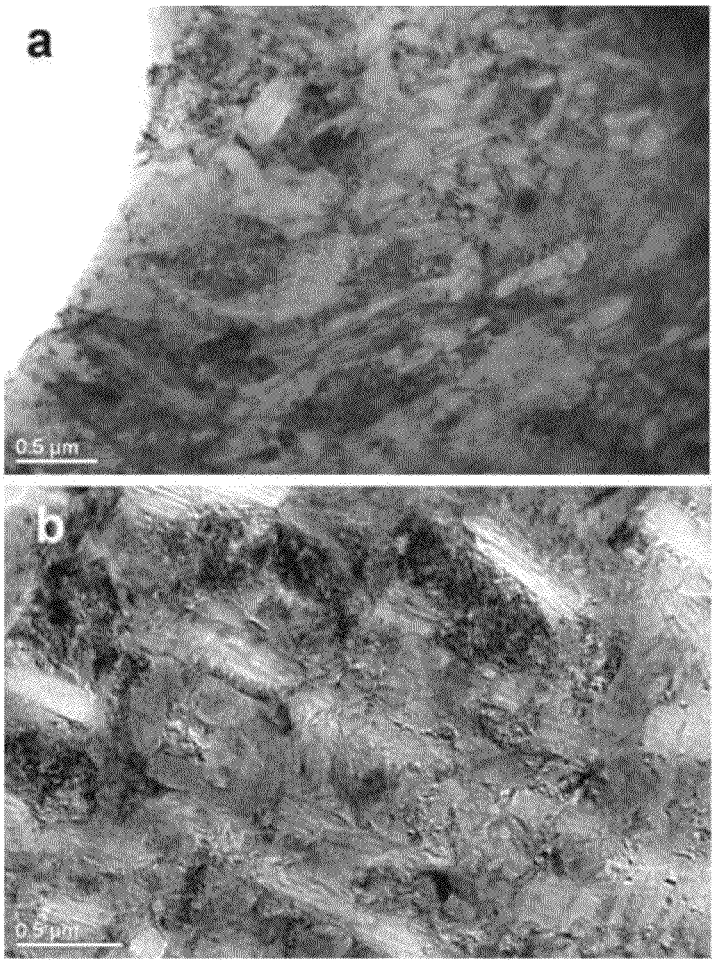
FIG. 39 is a TEM micrograph of Alloy 14 sheet HIPed at 1000° C. under the indicated conditions.

In FIG. 39, the microstructure of the gage section of the Alloy 14 sheet in HIPed conditions before and after the tensile deformation is shown. In the sample before tension, the precipitates are distributed in the matrix. Additionally, fine grains are shown in the sample due to the grain refinement induced by the phase transformation during the HIP cycle corresponding to Step #2 (Static Nanophase Refinement). Thus, NanoModal Structure (Step #3) was developed in the material prior to deformation. After the yield stress is exceeded, further grain refinement is developed with the continued transformation of austenite phase induced by the tensile deformation. According to X-ray analysis, the austenite phase transforms into multiple phases simultaneously including two new unidentified phases. As a result, grains of ~200 to ~300 nm in size can be widely observed in the sample. Dislocation activity induced by tensile deformation can also be observed in some of the grains. At the same time, the boride precipitates retain the same geometry, suggesting that they do not experience obvious plastic deformation.

Figure 40:
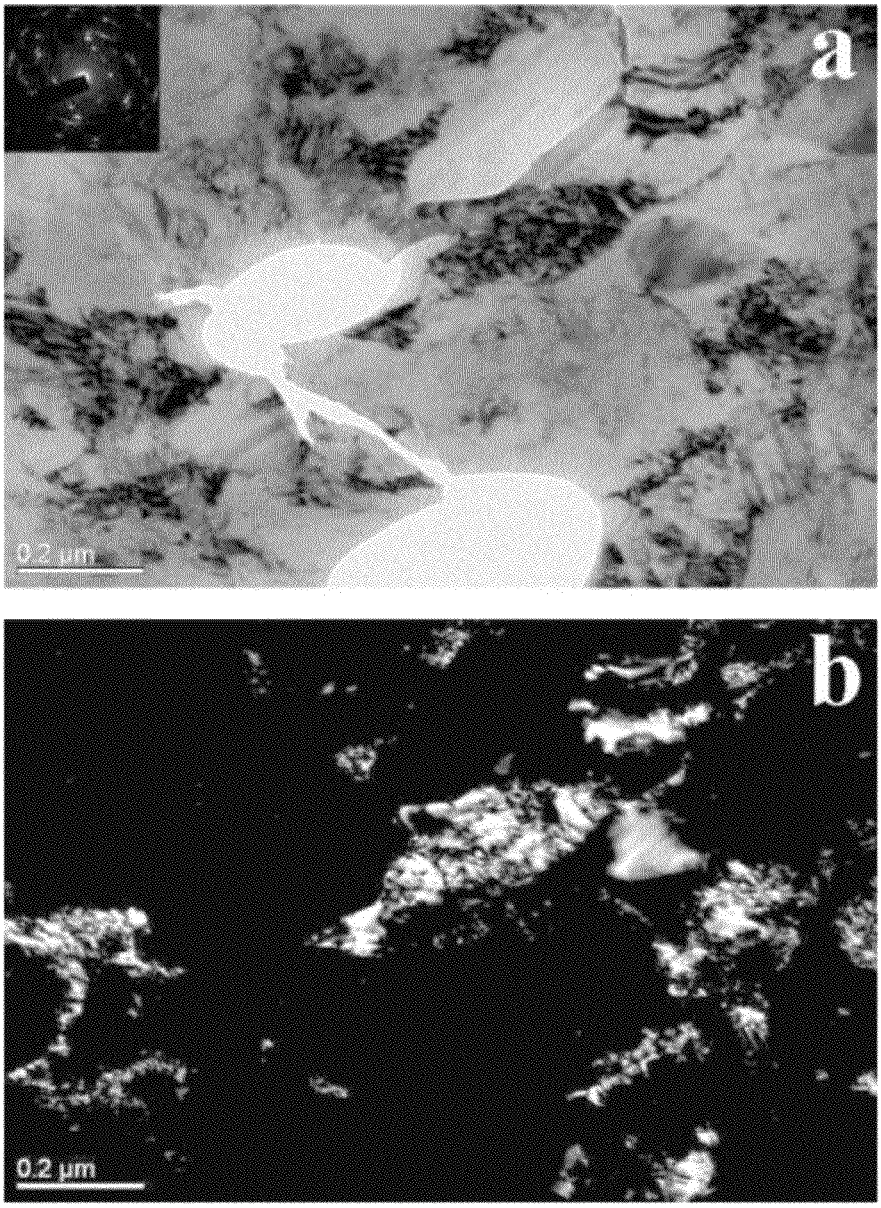
FIG. 40 is a TEM micrograph of the Alloy 14 tensile tested gage specimen under the indicated conditions.

FIG. 40 shows a detailed microstructure of the gage section of the Alloy 14 sheet in HIPed conditions after the tensile deformation. In the microstructure, other than the hard boride phase exhibiting twinned structure, small grains of several hundred nanometers in size can be found. Moreover, the ring pattern of the electron diffraction pattern, which is a collective contribution from many grains, further confirms the refined microstructure. In the dark-field image, the small grains appear bright; their sizes are all less than 500 nm. Additionally, it can be seen that sub-structures are displayed within these small grains, indicating that the deformation-induced defects such as dislocations distort the lattice. As in Alloy 1, new hexagonal phases were identified in the sample after tensile deformation, which is believed to be the very fine precipitates that formed during the tensile deformation. Grain refinement might be considered as a result of Dynamic Nanophase Strengthening (Step #4) leading to High Strength NanoModal Structure (Step #5) in the Alloy 14 sheet.

As it was shown, the Alloy 14 sheet has demonstrated Structure #1 Modal Structure (Step#1) in as-cast state (FIG. 30*a*). High strength with high ductility in this material was measured after HIP cycle (FIG. 35), which provides the Static Nanophase Refinement (Step #2) and the formation of the NanoModal Structure (Step #3) in the material prior deformation. The strain hardening behavior of the Alloy 14 during tensile deformation is attributed mostly to grain refinement corresponding to Mechanism #2 Dynamic Nanophase Strengthening (Step #4) with subsequent creation of the High Strength NanoModal Structure (Step #5). Additional hardening may occur by dislocation mechanism in newly formed grains. The Alloy 14 sheet is an example of Class 2 steel with High Strength NanoModal Structure formation leading to high ductility at high strength.

Case Example #7

Structure Development in Alloy 19

According to the alloy stoichiometries in Table 2, the Alloy 19 was weighed out from high purity elemental charges.

Figure 41:
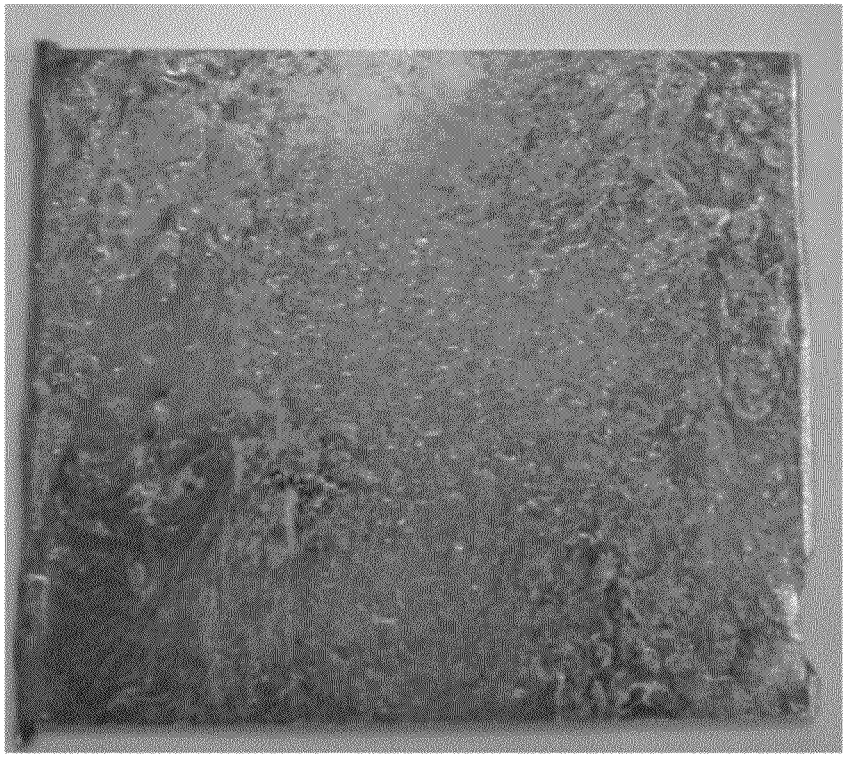
FIG. 41 is a picture of as-case Alloy 19 sheet.

Similar to Alloy 14, this alloy has demonstrated Class 2 behavior with high plastic ductility at high strength. The resulting charges were arc-melted into 4 thirty-five gram ingots and flipped and remelted several times to ensure homogeneity. The resulting ingots were then re-melted and cast into 3 sheets under identical processing conditions with nominal dimensions of 65 mm by 75 mm by 1.8 mm thick. An example picture of one of the 1.8 mm thick Alloy 19 sheets is shown in FIG. 41. Two of the sheets were then HIPed at 1100° C. for 1 hour. One of the HIPed sheets was then subsequently heat treated at 700° C. for 20 minutes. The sheets in the as-cast, HIPed and HIPed/heat treated states were then cut up using a wire-EDM to produce samples for various studies including tensile testing, SEM microscopy, TEM microscopy, and X-ray diffraction.

Figure 42:
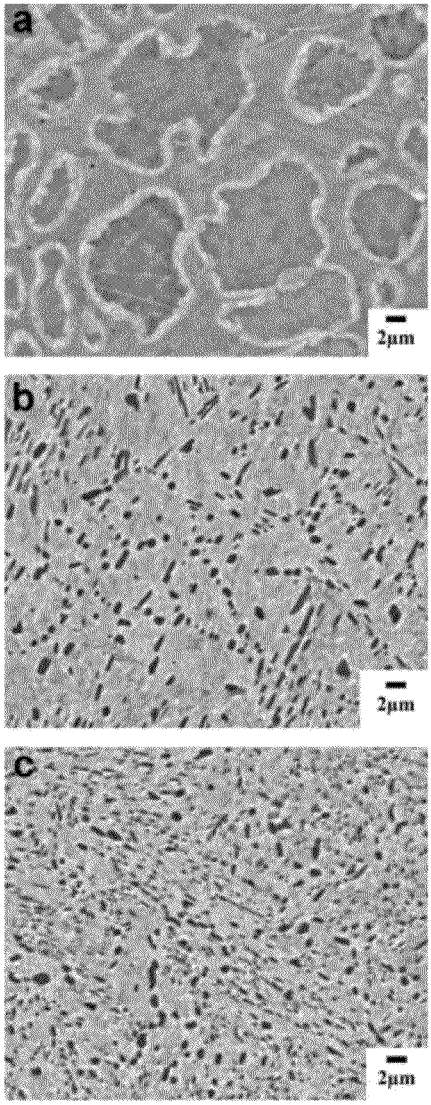
FIG. 42 is a SEM backscattered electron micrograph of Alloy 19 sheet under the indicated conditions.

Samples that were cut out of the Alloy 19 sheets were metallography polished in stages down to 0.02 μm grit to ensure smooth samples for scanning electron microscopy (SEM) analysis. The samples were analyzed in detail using a Zeiss EVO-MA10 model with the maximum operating voltage of 30 kV. Example SEM backscattered electron micrographs of the Alloy 19 sheet samples in the as-cast, HIPed and HIPed/heat treated conditions are shown in FIG. 42.

As shown in FIG. 42*a*, the microstructure of the as-cast Alloy 19 sheet distinctly exhibit modal structures, i.e., matrix grained phase and intergranular regions. The matrix grains are ~5 to ~10 μm in the size. Similar to the microstructure of Alloy 14, the edge of the grains exhibits different compositional contrast from that in the grain interior, perhaps due to the phase transformation during the casting. No lamella structure was revealed by SEM in as-cast state. Exposure to the HIP cycle led to significant changes in the microstructure. Very fine precipitates were formed that were nearly homogeneous distributed in the matrix grains and the intergranular regions so that the matrix grain boundaries cannot be readily identified (FIG. 42*b*). After the heat treatment, the volume fraction of precipitates increased significantly (FIG. 42*c*), most of which form with reduced microstructural scale.

Figure 43:
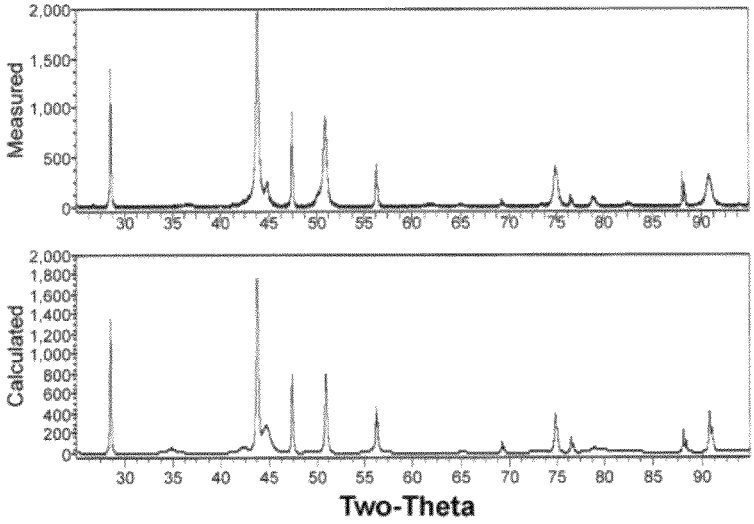
FIG. 43 is X-ray diffraction data for Alloy 19 sheet under the indicated conditions.
Figure 44:
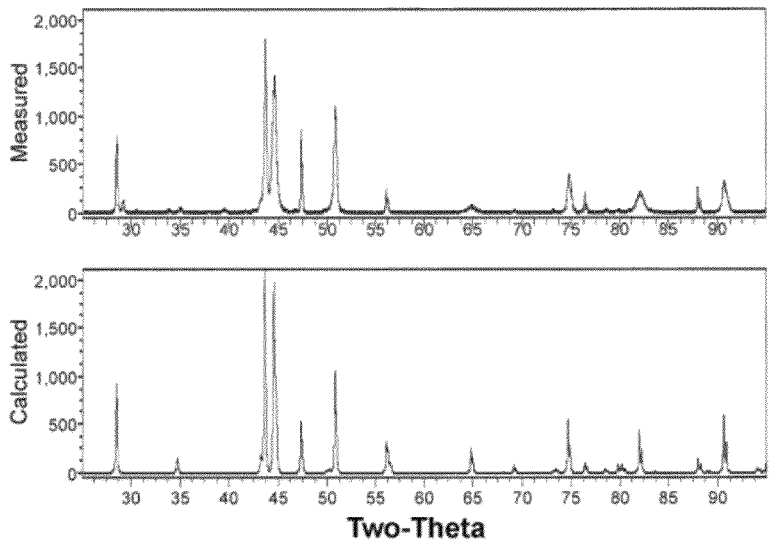
FIG. 44 is X-ray diffraction data for Alloy 19 sheet in the HIPed condition.
Figure 45:
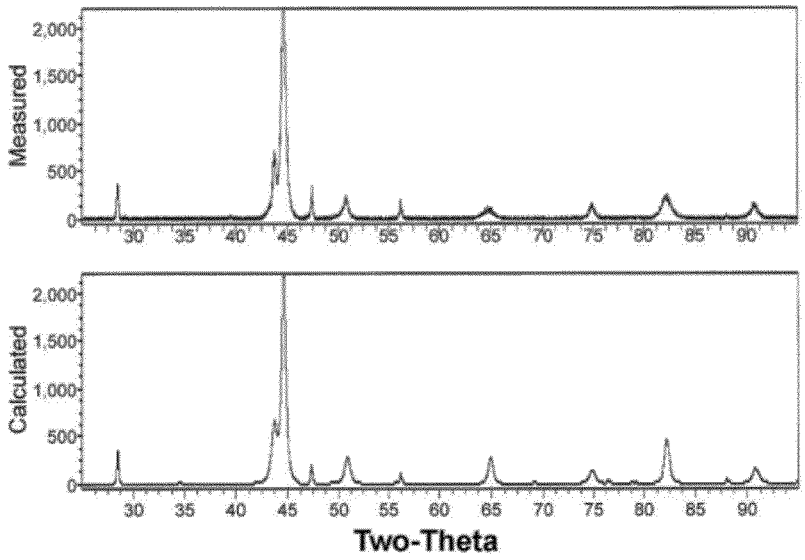
FIG. 45 is X-ray diffraction data for Alloy 19 sheet in the HIPed condition.

Additional details of the Alloy 19 sheet structure are revealed using X-ray diffraction. X-ray diffraction was done using a Panalytical X'Pert MPD diffractometer with a Cu Kα X-ray tube and operated at 40 kV with a filament current of 40 mA. Scans were run with a step size of 0.01° and from 25° to 95° two-theta with silicon incorporated to adjust for instrument zero angle shift. The resulting scan patterns were then subsequently analyzed using Rietveld analysis using Siroquant software. In FIGS. 43-45, X-ray diffraction scan patterns are shown including the measured/experimental pattern and the Rietveld refined pattern for the Alloy 19 sheets in the as-cast, HIPed, and HIPed/heat treated conditions, respectively. As can be seen, good fits of the experimental data was obtained in all cases. Analysis of the X-ray patterns including specific phases found, their space groups and lattice parameters is shown in Table 15. Note that the space group represents a description of the symmetry of the crystal and can have one of 230 types and is further identified with its corresponding Hermann Maugin space group symbol.

In the as-cast sheet, three phases were identified, a cubic γ-Fe (austenite), a cubic α-Fe (ferrite) and a complex mixed transitional metal boride phase with the $M_2B$ stoichiometry. Note that the lattice parameters of the identified phases are different than that found for pure phases clearly indicating the dissolution of the alloying elements. For example, γ-Fe as a pure phase would exhibit a lattice parameter equal to a=3.575 Å, α-Fe would exhibit a lattice parameter equal to a=2.866 Å, and $Fe_2B_1$ pure phase would exhibit lattice parameters equal to a=5.099 Å and c=4.240 Å. Note that based on the significant change in lattice parameters in the $M_2B$ phase is it likely that silicon is also dissolved into this structure so it is not a pure boride phase. Additionally, as can be seen in Table 15, while the phases do not change, the lattice parameters do change as a function of the condition of the sheet (i.e. cast, HIPed, HIPed/heat treated) which indicates that redistribution of alloying elements is occurring.

TABLE 15

Rietveld Phase Analysis of Alloy 19 Sheet

| Condition | Phase 1 | Phase 2 | Phase 3 |
|---|---|---|---|
| As-Cast | γ-Fe<br>Structure: Cubic<br>Space group #: #225<br>Space group: Fm3m<br>LP: a = 3.590 Å | α-Fe<br>Structure: Cubic<br>Space group #: #229<br>Space group: Im3m<br>LP: a = 2.868Å | $M_2B$<br>Structure: Tetragonal<br>Space group #: #140<br>Space group: I4/mcm<br>LP: a = 5.162 Å<br>c = 4.281 Å |
| HIPed at 1100° C. for 1 hour | γ-Fe<br>Structure: Cubic<br>Space group #: #225<br>Space group: Fm3m<br>LP: a = 3.593 Å | α-Fe<br>Structure: Cubic<br>Space group #: #229<br>Space group: Im3m<br>LP: a = 2.876 Å | $M_2B$<br>Structure: Tetragonal<br>Space group #: #140<br>Space group: I4/mcm<br>LP: a = 5.168 Å<br>c = 4.188 Å |
| HIPed at 1100° C. for 1 hour and heat treated at 700° C. for 20 minutes | γ-Fe<br>Structure: Cubic<br>Space group #: #225<br>Space group: Fm3m<br>LP: a = 3.590 Å | α-Fe<br>Structure: Cubic<br>Space group #: #229<br>Space group: Im3m<br>LP: a = 2.873 Å | M2B<br>Structure: Tetragonal<br>Space group #: #140<br>Space group: I4/mcm<br>LP: a = 5.197<br>c = 4.280 |

To examine the structural features of the Alloy 19 sheets in more details, high resolution transmission electron microscopy (TEM) was utilized. To prepare TEM samples, specimens were cut from the as-cast, HIPed, and HIPed/heat-treated sheets, and then ground and polished. To study the deformation mechanisms, samples were also taken from the gage section of the tensile tested specimens and polished to a thickness of ~30 to ~40 μm. Discs were punched from these polished thin sheets, and then finally thinned by twin-jet electropolishing for TEM observation. These specimens were examined in a JEOL JEM-2100 HR Analytical Transmission Electron Microscope (TEM) operated at 200 kV.

Figure 46:
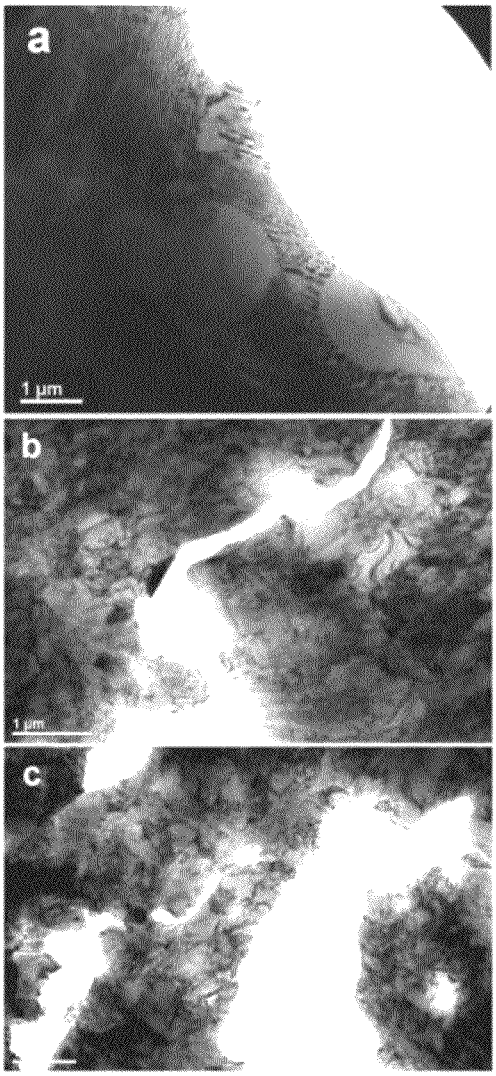
FIG. 46 is TEM electron micrographs of the Alloy 19 sheet under the indicated conditions.

In FIG. 46, TEM micrographs of the microstructure of the Alloy 19 sheets in the as-cast, HIPed, and HIPed/heat treated sheets are shown. In the as-cast sample, the grains of ~5 to ~10 μm in size with the lamella structure in the intergranular regions were observed (FIG. 46*a*). The lamella structure is much finer as compared to that in Alloy 14 sheets and was not previously revealed by SEM analysis. After the HIP cycle, the lamella structure generally disappears, and is instead replaced with precipitates that are homogeneously distributed in the sample volume (FIG. 46*b*). In addition, the refined grains can be observed after HIP cycle. The grain refinement is achieved through the phase transformation of austenite phase. As revealed by X-ray diffraction, the austenite to ferrite transformation is activated, which led to the grain refinement in accordance with Step #2 (Mechanism #1 Static Nanophase Refinement). After the heat treatment cycle, further grain refinement occurred as a result of the continued phase transformation resulting in the completion of the formation of the NanoModal Structure (Step #3). In addition, the precipitates become more uniformly distributed (FIG. 46*c*).

Case Example #8

Tensile Properties and Structural Changes in Alloy 19

Figure 47:
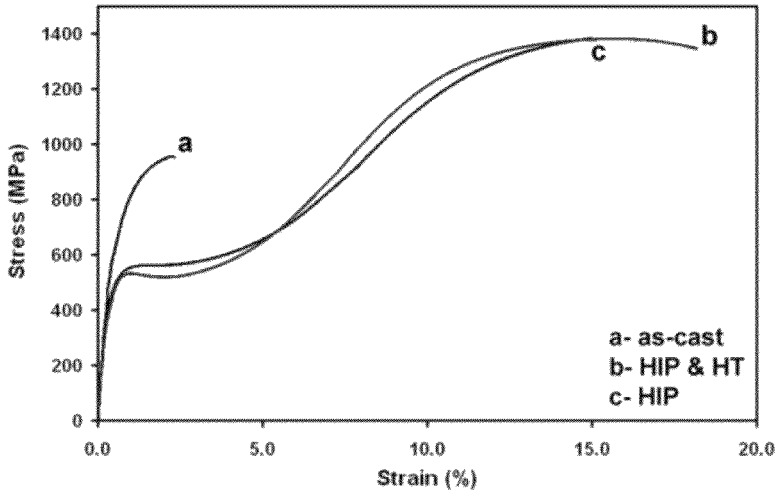
FIG. 47 is a stress-strain plot of Alloy 19 sheet under the indicated conditions.

The tensile properties of the steel sheet produced in this application will be sensitive to the specific structure and specific processing conditions that the sheet experiences. In FIG. 47, the tensile properties of Alloy 19 sheet representing a Class 2 steel are shown which were in the as-cast, HIPed (1100° C. for 1 hour), and HIPed (1100° C. for 1 hour)/heat treated (700° C. for 20 minutes) conditions. As can be seen, the as-cast sheet shows much lower ductility than the HIPed samples. This increase in ductility can be attributed to both the reduction of macrodefects in the HIPed sheets and microstructural changes occurring in the modal structures of the HIPed or HIPed/heat treated sheet as discussed earlier in Case Example #7. Additionally, during the application of a stress during tensile testing it will be shown that structural changes are occurring.

Figure 48:
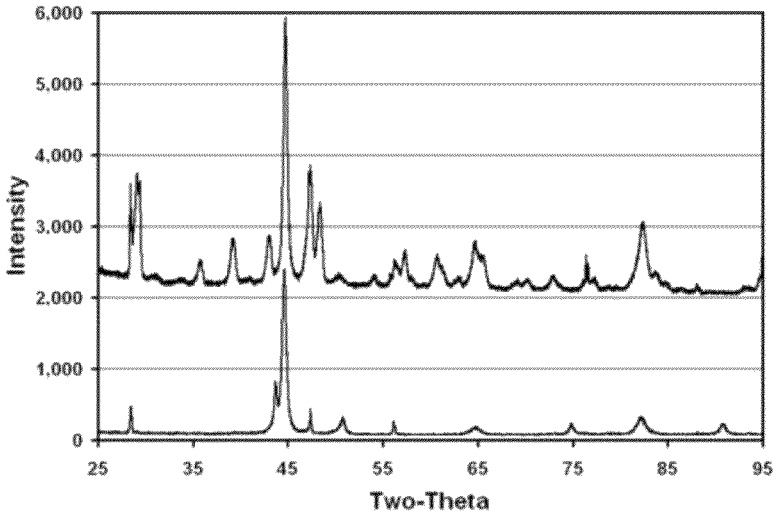
FIG. 48 is a comparison between X-ray data for Alloy 19 sheet after the HIP cycle at 1100° C. for 1 hour and heat treatment at 700° C. for 20 minutes.

For the Alloy 19 sheet HIPed at 1100° C. for 1 hour and heat treated at 700° C. for 20 minutes, additional structural details were obtained through using X-ray diffraction which was done on both the undeformed sheet samples and the gage sections of the deformed tensile specimens cut from the sheet. X-ray diffraction was specifically done using a Panalytical X'Pert MPD diffractometer with a Cu Kα x-ray tube and operated at 40 kV with a filament current of 40 mA. Scans were run with a step size of 0.01° and from 25° to 95° two-theta with silicon incorporated to adjust for instrument zero angle shift. In FIG. 48, X-ray diffraction curves are shown of the Alloy 19 sheet HIPed at 1100° C. for 1 hour and heat treated at 700° C. for 20 minutes for both the undeformed sheet and the gage section of tensile specimen from the same sheet after tensile deformation. As can be readily seen, there are significant structural changes occurring during deformation with new phases formation as indicated by new peaks in the X-ray pattern. Peak shifts indicate that redistribution of alloying elements is occurring between the phases present in both samples.

Figure 49:
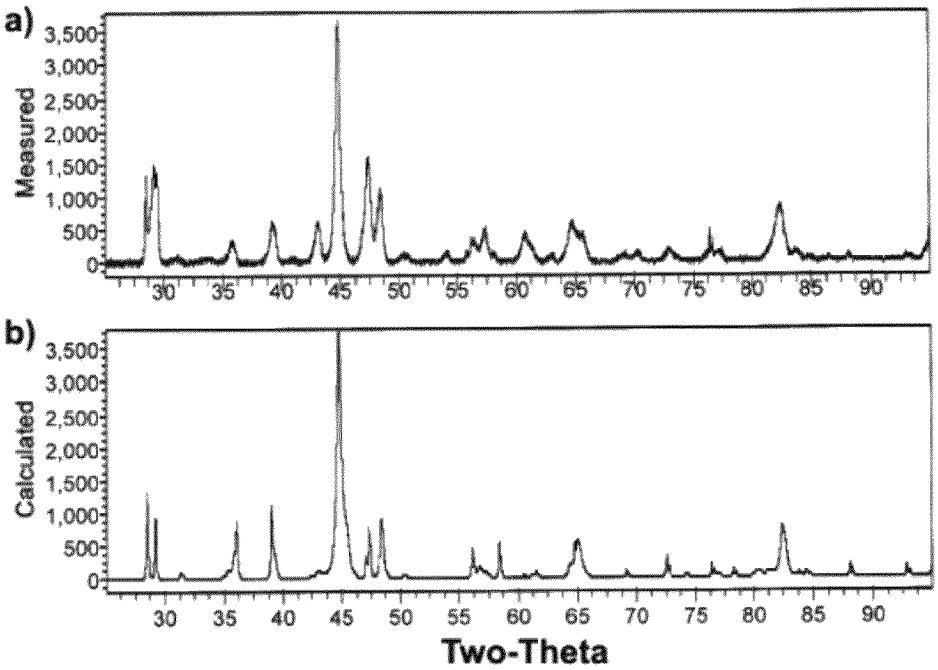
FIG. 49 is X-ray diffraction data for the gage section of tensile tested sample from Alloy 19 under the indicated conditions.
Figure 50:
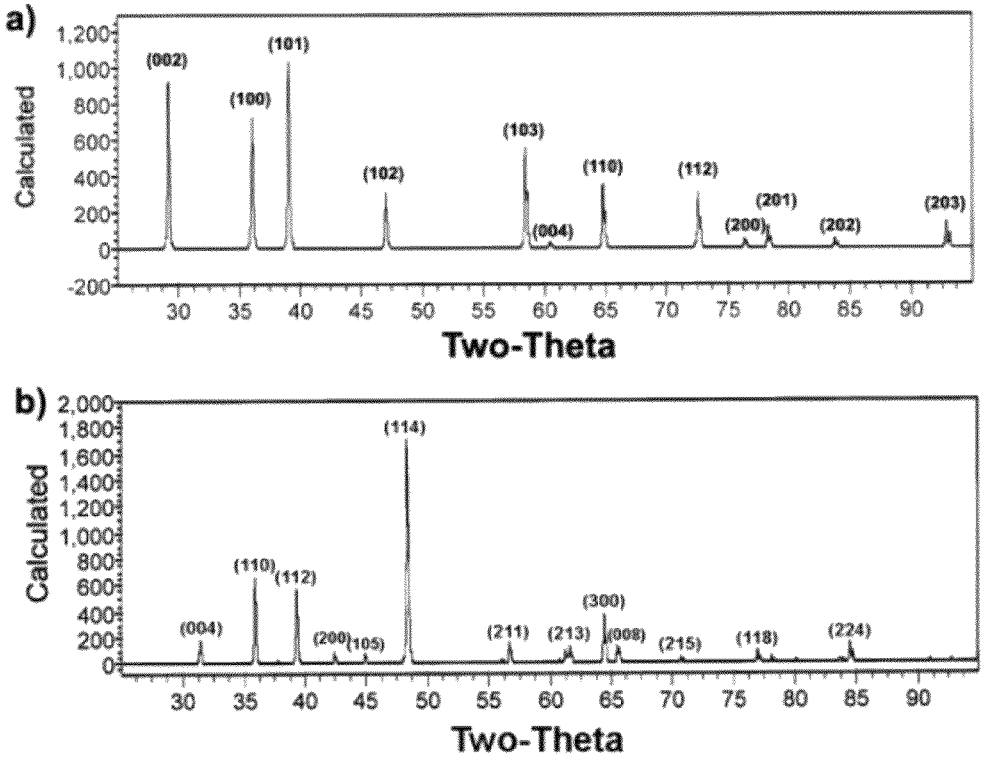
FIG. 50 is a calculated X-ray diffraction pattern for iron based hexagonal phase found in the gage section of tensile tested sample from Alloy 19 under the indicated conditions.

The X-ray pattern for the tensile tested specimen from Alloy 19 sheet (HIPed at 1100° C. for 1 hour and heat treated 700° C. for 20 minutes) was subsequently analyzed using Rietveld analysis using Siroquant software. As shown in FIG. 49, a close agreement was found between the measured and calculated patterns. In Table 16, the phases identified in the Alloy 19 undeformed sheet and a gage section of tensile specimens are compared. As can be seen, the $M_2B$ phase exists in the sheet before and after tensile testing although the lattice parameters changed indicating that the amount of solute elements dissolved changed. Additionally, the γ-Fe phase existing in the undeformed Alloy 19 sheet no longer exists in the tensile specimen gage section indicating that the phase transformation took place. Rietveld analysis of the undeformed sheet and tensile tested specimen indicates that the α-Fe content changes little with only a slight increase measured from ~65% to ~66%. This would indicate that the γ-Fe phase transformed into multiple phases including possibly α-Fe and at least two new previously unknown phases. As shown in Table 16, after deformation, two new previously unknown hexagonal phases have been identified. One newly identified hexagonal phase is representative of a dihexagonal pyramidal class and has a hexagonal $P6_3mc$ space group (#186) and the calculated diffraction pattern with the diffracting planes listed is shown in FIG. 50*a*. The other hexagonal phase is representative of a ditrigonal dipyramidal class and has a hexagonal P6bar2C space group (#190) and the calculated diffraction pattern with the diffracting planes listed is shown in FIG. 50*b*. It is theorized based on the small crystal unit cell size that this phase is likely a silicon based phase possibly a previously unknown Si-B phase. Note that in the FIG. 50, key lattice planes are identified corresponding to significant Bragg diffraction peaks.

TABLE 16

Rietveld Phase Analysis of Alloy 19 Sheet; Before and After Tensile Testing

| Condition | Phase 1 | Phase 2 | Phase 3 | Phase 4 |
|---|---|---|---|---|
| Sheet - HIPed at 1000° C. for 1 hour and heat treated at 700° C. for 20 minutes - Prior to tensile testing | γ-Fe Structure: Cubic Space group #: #225 Space group: Fm3m LP: a = 3.590 Å | α-Fe Structure: Cubic Space group #: #229 Space group: Im3m LP: a = 2.873 Å | $M_2B$ Structure: Tetragonal Space group #: #140 Space group: I4/mcm LP: a = 5.197 c = 4.280 | |
| Sheet - HIPed at 1000° C. for 1 hour and heat treated at 700° C. for 20 minutes - After tensile testing | α-Fe Structure: Cubic Space group #: #229 Space group: Im3m LP: a = 2.865 Å | $M_2B$ Structure: Tetragonal Space group #: #140 Space group: I4/mcm LP: a = 5.086 Å c = 4.206 Å | Hexagonal Phase 1 (new) Structure: Hexagonal Space group #: #186 Space group: P63mc LP: a = 2.876 Å c = 6.123 Å | Hexagonal Phase 2 (new) Structure: Hexagonal Space group #: #190 Space group: P62barC LP: a = 5.010 Å c = 11.395 Å |

To examine the structural changes of the Alloy 19 sheets induced by tensile deformation, high resolution transmission electron microscopy (TEM) was utilized to analyze the sample gage section before and after tensile tests. To prepare TEM sample, specimens were cut from the gage section of tensile specimens, and then ground and polished to a thickness of ~30 to ~40 μm. Discs were punched from these polished thin sheets, and then finally thinned by twin-jet electropolishing for TEM observation. These specimens were examined in a JEOL JEM-2100 HR Analytical Transmission Electron Microscope (TEM) operated at 200 kV.

FIG. 51 shows TEM micrographs of microstructure in Alloy 19 sheet before and after the tensile deformation. As in Alloy 14, homogeneously distributed boride phase is found in the sample, and the austenite phase transformation during HIP cycle and heat treatment led to significant grain refinement as a result of Static Nanophase Refinement (Step #2) with NanoModal Structure (Step #3) in the sheet sample before deformation (FIG. 51*a*). In the sample after tensile testing, although the boride phase does not exhibit obvious plastic deformation, a significant structure change was observed that was induced by the deformation (FIG. 51*b*). First, many small grains of several hundred nanometers in size can be found. The electron diffraction in the inset of FIG. 51*b* shows the ring pattern, which shows the refinement in microstructure scale. The small grains can also be revealed in the dark-field image, as shown in FIG. 52, and the small grains less than 500 nm can be clearly seen. In addition, it can be found that the grains contain a high density of dislocations after the tensile deformation such that the lattice of many grains are distorted and appear as if they are further divided into smaller grains (FIG. 52*b*). FIG. 53 shows another example of TEM micrographs representing microstructure in the gage section of the tensile deformed sample. A number of dislocations generated in the grains can be seen, as indicated by the black arrows. In addition, nanometer size precipitates can be found in the microstructure, as indicated by the white arrows. These very fine precipitates are presumably the new phases induced by deformation and found in the X-ray diffraction scans. Fine grain formation is a result of Dynamic Nanophase Strengthening (Step #4) occurring in the sample during tensile deformation that leads to High Strength Nano-Modal Structure (Step #5) in the Alloy 19 sheet material.

As a summary, the deformation of Alloy 19 sheet is characterized by the substantial work hardening similar to that in Alloy 14 sheet. As it was shown, the Alloy 19 sheet has demonstrated Structure #1 Modal Structure (Step#1) in as-cast state (FIG. 46*a*). High strength with high ductility in this material was measured after HIP cycle and heat treatment, which provide the Static Nanophase Refinement (Step #2) and creation of the NanoModal Structure (Step #3) in the material prior deformation (FIG. 46*c*). The strain hardening behavior of the Alloy 19 during tensile deformation (FIG. 47) is attributed mostly to the previous grain refinement corresponding to Mechanism #2 Dynamic Nanophase Strengthening (Step #4) with subsequent High Strength NanoModal Structure (Step #5) represented in FIG. 51*b* and FIGS. 52-53. Additional hardening may occur by dislocation based mechanisms in newly formed grains. The Alloy 19 sheet is an example of Class 2 steel with High Strength NanoModal Structure formation leading to high ductility at high strength.

Case Example #9

Strain Hardening Behavior

Using high purity elements, 35 g alloy feedstocks of the targeted alloys listed in Table 2 were weighed out according to the atomic ratios provided in Table 2. The feedstock material was then placed into the copper hearth of an arc-melting system. The feedstock was arc-melted into an ingot using high purity argon as a shielding gas. The ingots were flipped several times and re-melted to ensure homogeneity. After mixing, the ingots were then cast in the form of a finger approximately 12 mm wide by 30 mm long and 8 mm thick. The resulting fingers were then placed in a PVC chamber, melted using RF induction and then ejected onto a copper die designed for casting a 3×4 inches plate with thickness of 1.8 mm. The resultant plates were subjected to HIP cycle with subsequent heat treatment. Corresponding HIP cycle parameters and heat treatment parameters are listed in Table 17. In a case of air cooling, the specimens were hold at the target temperature for a target period of time, removed from the furnace and cooled down in air. In a case of slow cooling, after the specimens were hold at the target temperature for a target period of time, the furnace was turned off and the specimens were cooled down with the furnace.

The listed samples from selected alloys (Table 17) were tested in tension on an Instron mechanical testing frame (Model 3369) with recording strain hardening coefficient values as a function of straining during testing utilizing Instron's Bluehill control and analysis software. The results are summarized in FIG. 54 where the strain hardening coefficient values are plotted versus corresponding plastic strain as a percentage of total elongation of the sample. As it can be seen, Samples 4 and 7 have demonstrated an increase in strain hardening after about 25% up to 80-90% of strain in the sample (FIG. 54*a*). These sheet samples have shown high ductility during tensile testing (FIG. 54*b*) and represents Class 1 steels. Sample 5 also represents Class 1 steels and demonstrated high ductility during tensile testing while strain hardening is almost independent from strain percentage with slight increase up to sample failure. For all these three samples, the strain hardening related to deformation of Modal Structure through dislocation mechanism with additional strengthening through Dynamic Nanophase Strengthening. Samples 1, 2 and 3 had demonstrated very high strain hardening at the strain value of about 50% with subsequent strain hardening coefficient values decreasing up to sample failure (FIG. 54*a*). These sheet samples have high strength/high ductility combination (FIG. 54*b*) and represents Class 2 steels where initial 50% of straining corresponds to phase transformation in the sample with a plateau on the stress-strain curve. Following strain hardening behavior corresponds to High Strength NanoModal Structure formation through extensive Dynamic Nanophase Strengthening. Sample 6 represents Class 2 steel also but have shown intermediate behavior in terms of strain hardening and intermediate properties at tensile testing that can be related to the lower level of phase transformation during straining depending on alloy chemistry.

TABLE 17

| Sample Specification | | | |
|---|---|---|---|
| Samples | Alloy | HIP Cycle | Heat Treatment |
| Sample 1 | Alloy 24 | 1100° C. for 1 hour | None |
| Sample 2 | Alloy 25 | 1100° C. for 1 hour | 700° C. for 1 hour; Slow cooling |
| Sample 3 | Alloy 26 | 1100° C. for 1 hour | 700° C. for 20 minutes; Air cooling |
| Sample 4 | Alloy 27 | 1100° C. for 1 hour | 700° C. for 1 hour; Air cooling |
| Sample 5 | Alloy 28 | 1100° C. for 1 hour | 700° C. for 1 hour; Air cooling |
| Sample 6 | Alloy 29 | 1100° C. for 1 hour | 700° C. for 20 minutes; Air cooling |
| Sample 7 | Alloy 31 | 1100° C. for 1 hour | 700° C. for 20 minutes; Air cooling |

Case Example #10

Strain Rate Sensitivity

Using high purity elements, 35 g alloy feedstocks of the Alloy 1 and Alloy 19 were weighed out according to the atomic ratios provided in Table 2. The feedstock material was then placed into the copper hearth of an arc-melting system. The feedstock was arc-melted into an ingot using high purity argon as a shielding gas. The ingots were flipped several times and re-melted to ensure homogeneity. After mixing, the ingots were then cast in the form of a finger approximately 12 mm wide by 30 mm long and 8 mm thick. The resulting fingers were then placed in a PVC chamber, melted using RF induction and then ejected onto a copper die designed for casting a 3×4 inches plate with thickness of 1.8 mm.

The resultant sheets from each alloy were subjected to HIP cycle using an American Isostatic Press Model 645 machine with a molybdenum furnace with furnace chamber size of 4 inch diameter by 5 inch height. The sheets were heated at 10° C./min until the target temperature was reached and were exposed to gas pressure for specified time. The resultant plates were subjected to HIP cycle with subsequent heat treatment. Corresponding HIP cycle parameters and heat treatment parameters are listed in Table 18. In a case of air cooling, the specimens were hold at the target temperature for a target period of time, removed from the furnace and cooled down in air. In a case of slow cooling, after the specimens were hold at the target temperature for a target period of time, the furnace was turned off and the specimens were cooled down with the furnace.

TABLE 18

HIP Cycle and Heat Treatment Parameters

| Alloy | HIP Cycle | Heat Treatment |
|---|---|---|
| Alloy 1 | 1000° C. for 1 hour | 350° C. for 20 minutes; Air cooling |
| Alloy 19 | 1125° C. for 1 hour | 700° C. for 1 hour; Slow cooling |

The tensile measurements were done at four different strain rates on an Instron mechanical testing frame (Model 3369) utilizing Instron's Bluehill control and analysis software. All tests were run at room temperature in displacement control with the bottom fixture held ridged and the top fixture moving with the load cell attached to the top fixture. The displacement rate was varied in a range from 0.006 to 0.048 mm/sec. The resultant stress—strain curves are shown in FIGS. 55-56. Alloy 1 did not show strain rate sensitivity in a range of applied strain rates. Alloy 19 has demonstrated slightly higher strain hardening rate at lower strain rates in the studied range that is probably related to the volume fraction of dynamically refined phases induced by deformation at different strain rates.

Case Example #11

Sheet Material Behavior at Incremental Straining

Using high purity elements, 35 g alloy feedstocks of the Alloy 19 were weighed out according to the atomic ratios provided in Table 2. The feedstock material was then placed into the copper hearth of an arc-melting system. The feedstock was arc-melted into an ingot using high purity argon as a shielding gas. The ingots were flipped several times and re-melted to ensure homogeneity. After mixing, the ingots were then cast in the form of a finger approximately 12 mm wide by 30 mm long and 8 mm thick. The resulting fingers were then placed in a PVC chamber, melted using RF induction and then ejected onto a copper die designed for casting a 3×4 inches plate with thickness of 1.8 mm.

The resultant sheets from each alloy were subjected to HIP cycle at 1150° C. for 1 hour using an American Isostatic Press Model 645 machine with a molybdenum furnace with furnace chamber size of 4 inch diameter by 5 inch height. The sheets were heated at 10° C./min until the target temperature was reached and were exposed to gas pressure for 1 hour before cooling down to room temperature while in the machine.

The incremental tensile testing was done on an Instron mechanical testing frame (Model 3369), utilizing Instron's Bluehill control and analysis software. All tests were run at room temperature in displacement control with the bottom fixture held ridged and the top fixture moving while the load cell is attached to the top fixture. Each loading-unloading cycle was done at incremental strain of about 2%. The resultant stress—strain curves are shown in FIG. 57. As it can be seen, Alloy 19 has demonstrated strengthening at each loading-unloading cycle confirming Dynamic Nanophase Strengthening in the alloy during deformation at each cycle.

Case Example #12

Annealing Effect on Property Recovering

Using high purity elements, 35 g alloy feedstocks of the Alloy 19 were weighed out according to the atomic ratios provided in Table 2. The feedstock material was then placed into the copper hearth of an arc-melting system. The feedstock was arc-melted into an ingot using high purity argon as a shielding gas. The ingots were flipped several times and re-melted to ensure homogeneity. After mixing, the ingots were then cast in the form of a finger approximately 12 mm wide by 30 mm long and 8 mm thick. The resulting fingers were then placed in a PVC chamber, melted using RF induction and then ejected onto a copper die designed for casting a 3×4 inches plate with thickness of 1.8 mm.

The resultant sheet from the Alloy 19 was subjected to a HIP cycle using an American Isostatic Press Model 645 machine with a molybdenum furnace with furnace chamber size of 4 inch diameter by 5 inch height. The sheets were heated at 10° C./min until the target temperature of 1100° C. was reached and were exposed to an isostatic pressure of 30 ksi for 1 hour. Subsequent heat treatment at 700° C. for 1 hour with slow cooling was applied to the sheet after the HIP cycle.

The tensile testing was done on an Instron mechanical testing frame (Model 3369), utilizing Instron's Bluehill control and analysis software. All tests were run at room temperature in displacement control with the bottom fixture held ridged and the top fixture moving with the load cell attached to the top fixture. Two tensile specimens were pre-strained to 10% with subsequent unloading. One of the samples was tested again up to failure. The resultant stress-strain curves are shown in FIG. 58*a*. As it can be seen, the Alloy 19 sheet after pre-straining has demonstrated high strength with limited ductility (~4.5%). Ultimate strength of the sample and summary strain from two tests correspond to that measured for the Alloy 19 sheets in the same conditions (same HIP cycle and heat treatment parameters) (see FIG. 57).

Another sample after pre-straining was annealed at 1150° C. for 1 hour with slow cooling and tested again up to failure. The resultant stress-strain curves are shown in FIG. 58*b*. The sample has demonstrated complete property restoration after annealing showing typical behavior of the Alloy 19 sheets in the same conditions (same HIP cycle and heat treatment parameters) without pre-straining (FIG. 47*b*).

Case Example #13

Cyclic Annealing Effect on Tensile Mechanisms

Using the methodology provided in Case Example #12 to prepare the sheet, an additional sample has been cut from Alloy 19 sheet after HIP cycle at 1100° C. for 1 hour and heat treatment at 700° C. for 1 hour. The sample was pre-strained to 10% with subsequent annealing at 1150° C. for 1 hour. Then it was deformed to 10% again with subsequent unloading and annealing at 1150° C. for 1 hour. This procedure was repeated 11 times total leading to total strain of ~100%. The tensile curves superimposed upon each other for all 11 cycles are shown in FIG. 59. The specimen after 10 cycles is shown in FIG. 60 as compared to its initial geometry. Note that same level of strength was recorded at each test cycle confirming property restoration at the annealing between tests.

High strength in pre-strained specimen (FIG. 58*a*) might be explained by High Strength Modal Structure Creation (Structure #3) during Dynamic Nanophase Strengthening (Mechanism #2) at tension. The restoration of the pre-strained sheet properties after annealing suggests that phase transformation at Dynamic Nanophase Strengthening (Mechanism #2) are reversible at subsequent annealing of the deformed material.

Microstructure of the gage section of the tensile specimens from Alloy 19 sheet (HIPed at 1100° C. for 1 hour and heat treated at 700° C. for 1 hour) after pre-straining and after pre-straining with subsequent annealing was examined by scanning electron microscopy (SEM) using an EVO-60 scanning electron microscope manufactured by Carl Zeiss SMT Inc. Microstructure of the gage section of the tensile specimens from Alloy 19 sheet (HIPed at 1100° C. for 1 hour and heat treated at 700° C. for 1 hour) after pre-straining to 10% is shown in FIG. 61. In the pre-strained microstructure (FIG. 61), no visible changes in microstructure have been revealed by SEM as compared to the Alloy 19 sheet before pre-straining (FIG. 42*c*). In a case of annealing at 1150° C. for 1 hour after pre-straining to 10%, the precipitates distribute even more homogeneously in the matrix (FIG. 62). Presumably some austenite is in the sample after annealing, but the austenite grains cannot be revealed. Due to the repetitive straining and annealing, this resulting microstructure may be considered as a prototype microstructure for future hot working like hot rolling.

Case Example #13

Bake Hardening of Sheet Material

Three by four inch plates with thickness of 1.8 mm were cast from Alloys 1, 2, and 3 with chemical composition specified in Table 2. The resultant sheets were subjected to HIP cycle using an American Isostatic Press Model 645 machine with a molybdenum furnace with furnace chamber size of 4 inch diameter by 5 inch height. The sheets were heated at 10° C./min until the target temperature of 1100° C. was reached and were exposed to an isostatic pressure of 30 ksi for 1 hour. After the HIP cycle, the individual sheets were subsequently heat treated in a box furnace at 350° C. for 20 minutes. To evaluate the bake hardening effect, the resultant sheets were additionally annealed at 170° C. for 30 minutes.

Hardness measurements of sheet materials before and after bake hardening treatment were performed by Rockwell C Hardness test in accordance with ASTM E-18 standards. A Newage model AT130RDB instrument was used for all hardness testing which was done on ~9 mm by ~9 mm square samples cut from cast and treated sheets with thickness of 1.8 mm. Testing was done with indents spaced such that the distance between each of them was greater than three times the indent width. Hardness data (average of three measurements) for sheet materials before and after bake hardening treatment are listed in Table 19. As it can be seen, hardness increased in all three alloys after additional annealing demonstrating a favorable bake hardening effect in all three alloys.

TABLE 19

Bake Hardening Effect on Selected Alloys

| Alloy | HRC (Average) Before | HRC (Average) After | Bake Hardening Effect (Δ HRC) |
|---|---|---|---|
| Alloy 1 | 18.6 | 25.0 | 6.4 |
| Alloy 2 | 23.8 | 27.1 | 3.2 |
| Alloy 3 | 21.9 | 25.3 | 3.3 |

Case Example #15

Cold Formability of Sheet Material

A 3×4 inches plates with thickness of 1.8 mm were cast from Alloy 1, Alloy 2, and Alloy 3 with chemical composition specified in Table 2. The resultant sheets were subjected to HIP cycle using an American Isostatic Press Model 645 machine with a molybdenum furnace with furnace chamber size of 4 inch diameter by 5 inch height. The sheets were heated at 10° C./min until the target temperature was reached and were exposed to gas pressure for specified time in accordance with Hc HIP cycle parameters listed in Table 6. Resultant sheets were subjected to Erichsen Cup Test (ASTM E643-09) to estimate cold formability of the cast sheet materials. The Erichsen cupping test is a simple stretch forming test of a sheet clamped firmly between blank holders to prevent in-flow of sheet material into the deformation zone. The punch is forced onto the clamped sheet with tool contact (lubricated, but with some friction) until cracks occur. The depth (mm) of the punch is measured and gives the Erichsen depth index as shown in FIG. 63. Test results for sheets from selected alloys are listed in Table 20 showing variation in depth index from 2.72 to 5.48 mm depending on alloy chemistry. These measurements correspond to plastic ductility of the plate at outer surface in a range from 9 to 20% indicating significant plasticity of the selected alloys.

TABLE 20

Erichsen Cup Test Results for As-Cast Plates

| Alloy | Maximum Load (kN) | Erichsen depth index (mm) |
|---|---|---|
| Alloy 1 | 9.00 | 5.18 |
| Alloy 2 | 9.72 | 2.72 |
| Alloy 3 | 8.15 | 5.48 |

The selected three alloys represent deformation behavior corresponding to that described in Case Example #4 when only Step #1 (Modal Structure) and Step #4 (Dynamic Nanophase Strengthening) was observed. High levels of formability might be achieved in the alloys with referenced chemistries that demonstrate deformation behavior described in Case Examples #6 and #8. Due to Static Nanophase Refinement (Step #2) and NanoModal Structure (Step #3), a reversible phase transformation with Dynamic Nanophase Strengthening (Step #4) was found as described in Case Example #12. By applying annealing to pre-deformed sheet material, total strain of more than 100% might be achieved.

Case Example #16

Thick Plate Properties

Using high purity elements, feedstocks with different mass of the Alloy 1 and Alloy 19 were weighed out according to the atomic ratios provided in Table 2. The feedstock material was then placed into the crucible of a custom-made vacuum casting system. The feedstock was melted using RF induction and then ejected onto a copper die designed for casting a 4×5 inches sheets at different thickness. Sheets with three different thicknesses of 0.5 inches, 1 inch and 1.25 inches were cast from each alloy (FIG. 64). Note that the sheets that were cast were much thicker than the previous 1.8 mm plates and illustrate the potential for the chemistries in Table 2 to be processed by the Thin Slab Casting process.

All sheets from each alloy were subjected to HIP cycle using an American Isostatic Press Model 645 machine with a molybdenum furnace with furnace chamber size of 4 inch diameter by 5 inch height. The sheets were heated at 10° C./min until the target temperature was reached and were exposed to gas pressure for specified time. HIP cycle parameters for both alloys are listed in Table 21 and are representative of the thermal exposure experienced by sheets in the Thin Slab Casting process. After HIP cycle, sheet material was heat treated in a box furnace at parameters specified in Table 22

TABLE 21

HIP Cycle Parameters

| Alloy | HIP Cycle Temperature [° C.] | HIP Cycle Pressure [psi] | HIP Cycle Time [hr] |
|---|---|---|---|
| Alloy 1 | 1000 | 30,000 | 1 |
| Alloy 19 | 1125 | 30,000 | 1 |

TABLE 22

Heat Treatment Parameters

| Alloy | Temperature (° C.) | Time (min) | Cooling |
|---|---|---|---|
| Alloy 1 | 350 | 20 | In air |
| Alloy 19 | 700 | 60 | With furnace |

The tensile specimens were cut from the sheets using wire electrical discharge machining (EDM). The tensile properties were measured on an Instron mechanical testing frame (Model 3369), utilizing Instron's Bluehill control and analysis software. All tests were run at room temperature in displacement control with the bottom fixture held ridged and the top fixture moving with the load cell attached to the top fixture. In Table 23, a summary of the tensile test results including total tensile strain, yield stress, ultimate tensile strength and Elastic Modulus is shown for 1.25 inches thick sheets in as-cast state and after HIP cycle and heat treatment. As can be seen the tensile strength values vary from 428 to 575 MPa for Alloy 1 sheet and from 642 to 814 MPa for Alloy 19 sheet. The total strain value varies from 2.78 to 14.20% for Alloy 1 sheet and from 3.16 to 6.02% for Alloy 19 sheet. Elastic Modulus is measured in a range from 103 to 188 GPa for both alloys. Note that these properties are not optimized at the much greater cast thickness but represent clear indications of the promise of the new steel types, enabling structures and mechanisms for large scale production through Thin Slab Casting.

TABLE 23

Summary of Tensile Test Results for 1.25 inches Thick Sheets

| Alloy | Sheet Thickness (inches) | Yield Stress (MPa) | Ultimate Strength (MPa) | Tensile Elongation (%) | Elastic Modulus (GPa) |
|---|---|---|---|---|---|
| Alloy 1 | As-cast | 237 | 518 | 8.78 | 165 |
| | | 226 | 428 | 2.78 | 152 |
| | | 256 | 525 | 10.10 | 172 |
| | | 242 | 515 | 7.39 | 169 |
| | | 229 | 555 | 13.49 | 152 |
| | | 242 | 543 | 11.58 | 103 |
| | HIPed | 234 | 575 | 14.20 | 165 |
| | and heat | 222 | 496 | 6.78 | 124 |
| | treated | 237 | 533 | 11.80 | 117 |
| Alloy 19 | As-cast | 377 | 760 | 5.35 | 167 |
| | | 334 | 751 | 5.47 | 134 |
| | | 387 | 665 | 4.59 | 176 |
| | | 329 | 642 | 4.26 | 188 |
| | | 371 | 687 | 4.83 | 155 |
| | | 353 | 652 | 4.98 | 162 |
| | HIPed | 318 | 805 | 6.02 | 150 |
| | and heat | 344 | 814 | 5.96 | 153 |
| | treated | 366 | 809 | 5.61 | 154 |
| | | 284 | 656 | 3.16 | 134 |

Case Example #17

Melt-Spinning Study

Using high purity elements, 15 g alloy feedstocks of the Alloy 19 were weighed out according to the atomic ratios provided in Table 2. The feedstock material was then placed into the copper hearth of an arc-melting system. The feedstock was arc-melted into an ingot using high purity argon as a shielding gas. The ingots were flipped several times and re-melted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were then processed by melting in different atmosphere using RF induction and then ejected onto a 245 mm diameter copper wheel which was traveling at different tangential velocities varying from 16 to 39 m/s. Continuous ribbons with various thicknesses were produced.

Thermal analysis was done on the as-solidified ribbon structure on a Perkin Elmer DTA-7 system with the DSC-7 option. Differential thermal analysis (DTA) and differential scanning calorimetry (DSC) was performed at a heating rate of 10° C./minute with samples protected from oxidation through the use of flowing ultrahigh purity argon. All ribbons have crystalline structure in as-cast state and similar melting behavior with melting peak at 1248° C.

The mechanical properties of metallic ribbons were obtained at room temperature using microscale tensile testing. The testing was carried out in a commercial tensile stage made by Fullam which was monitored and controlled by a MTEST Windows software program. The deformation was applied by a stepping motor through the gripping system while the load was measured by a load cell that was connected to the end of one gripping jaw. Displacement was obtained using a Linear Variable Differential Transformer (LVDT) which was attached to the two gripping jaws to measure the change of gauge length. Before testing, the thickness and width of a ribbon were carefully measured for at least three times at different locations in the gauge length. The average values were then recorded as gauge thickness and width, and used as input parameters for subsequent stress and strain calculation. The initial gauge length for tensile testing was set at ~9 mm with the exact value determined after the ribbon was fixed by accurately measuring the ribbon span between the front faces of the two gripping jaws. All tests were performed under displacement control, with a strain rate of ~0.001$s^{-1}$. A summary of the tensile test results including total elongation, yield strength, ultimate tensile strength, and Young's Modulus are shown in Table 24. As can be seen the tensile strength values vary from 810 MPa to 1288 MPa with the total elongation from 0.83% to 17.33%. Large scattering in properties is observed for all tested ribbons suggesting a formation of non-uniform structures at fast cooling.

TABLE 24

Summary on Tensile Properties of Melt-Spun Ribbons

| Wheel Speed (m/s) | Yield Stress (MPa) | Ultimate Strength (MPa) | Total Elongation (%) |
|---|---|---|---|
| 16 | 664 | 829 | 9.82 |
| | 665 | 810 | 2.17 |
| | 701 | 828 | 5.61 |
| 20 | 799 | 891 | 3.72 |
| | 769 | 922 | 9.89 |
| | 733 | 1095 | 17.33 |
| 25 | 751 | 1020 | 15.56 |
| | 1003 | 1142 | 2.51 |
| | 746 | 1043 | 15.06 |
| 30 | 1113 | 1249 | 2.82 |
| | 770 | 1027 | 15.67 |
| | 1183 | 1288 | 1.39 |
| 39 | 1075 | 1220 | 1.13 |
| | 650 | 837 | 0.83 |
| | 1030 | 1193 | 1.14 |

Case Example #18

Tensile Properties of Mn-Containing Alloys

Tensile Properties of alloys listed in Table 25 were examined to determine the effect of the addition of Manganese in levels of up to 4.53 atomic percent. Alloys were prepared in 35 g charges using high purity research grade elemental constituents. Charges of each alloy were arc-melted into ingots, and then homogenized under argon atmosphere. The resulting 35 gram ingots were then cast into plates with nominal dimensions of 65 mm by 75 mm by 1.8 mm.

TABLE 25

Alloy Composition

| Alloy | Fe | Cr | Ni | B | Si | Mn |
|---|---|---|---|---|---|---|
| Alloy 25 | 62.20 | 17.62 | 4.14 | 5.30 | 6.60 | 4.14 |
| Alloy 26 | 60.35 | 20.70 | 3.53 | 5.30 | 6.60 | 3.52 |
| Alloy 27 | 61.10 | 19.21 | 3.90 | 5.30 | 6.60 | 3.89 |
| Alloy 28 | 61.32 | 20.13 | 3.33 | 5.30 | 6.60 | 3.32 |
| Alloy 29 | 63.83 | 17.97 | 3.15 | 5.30 | 6.60 | 3.15 |
| Alloy 30 | 63.08 | 15.95 | 4.54 | 5.30 | 6.60 | 4.53 |
| Alloy 31 | 64.93 | 16.92 | 3.13 | 5.30 | 6.60 | 3.12 |
| Alloy 32 | 64.45 | 15.86 | 3.90 | 5.30 | 6.60 | 3.89 |
| Alloy 33 | 62.11 | 20.31 | 2.84 | 5.30 | 6.60 | 2.84 |
| Alloy 34 | 62.20 | 17.62 | 6.21 | 5.30 | 6.60 | 2.07 |
| Alloy 35 | 60.35 | 20.70 | 5.29 | 5.30 | 6.60 | 1.76 |
| Alloy 36 | 61.10 | 19.21 | 5.85 | 5.30 | 6.60 | 1.94 |
| Alloy 37 | 61.32 | 20.13 | 4.99 | 5.30 | 6.60 | 1.66 |
| Alloy 38 | 63.83 | 17.97 | 4.73 | 5.30 | 6.60 | 1.57 |
| Alloy 39 | 63.08 | 15.95 | 6.80 | 5.30 | 6.60 | 2.27 |
| Alloy 40 | 64.93 | 16.92 | 4.69 | 5.30 | 6.60 | 1.56 |
| Alloy 41 | 64.45 | 15.86 | 5.85 | 5.30 | 6.60 | 1.94 |
| Alloy 42 | 62.11 | 20.31 | 4.26 | 5.30 | 6.60 | 1.42 |

As-cast plates were then subjected to hot isostatic pressing (HIPing) at 30 ksi for 1 hour, with a temperature selected according to Table 26. HIPing was done using an American Isostatic Press Model 645 machine with a molybdenum furnace. Samples were heated to the target temperature at a rate of 10° C./min and held at temperature under the pressure of 30 ksi for 1 hour.

TABLE 26

HIP Parameters Selected for Alloys Used in Case Study

| Alloy | HIP Cycle Designation | HIP Temperature | HIP Pressure | Dwell Time |
|---|---|---|---|---|
| Alloy 25 | Hf | 1150° C. | 30 ksi | 1 Hour |
| Alloy 26 | Hf | 1150° C. | 30 ksi | 1 Hour |
| Alloy 27 | Hf | 1150° C. | 30 ksi | 1 Hour |
| Alloy 28 | Hf | 1150° C. | 30 ksi | 1 Hour |
| Alloy 29 | Hf | 1150° C. | 30 ksi | 1 Hour |
| Alloy 30 | Hf | 1150° C. | 30 ksi | 1 Hour |
| Alloy 31 | Hf | 1150° C. | 30 ksi | 1 Hour |
| Alloy 32 | Hf | 1150° C. | 30 ksi | 1 Hour |
| Alloy 33 | Hf | 1150° C. | 30 ksi | 1 Hour |
| Alloy 34 | Hf | 1150° C. | 30 ksi | 1 Hour |
| Alloy 35 | Hf | 1150° C. | 30 ksi | 1 Hour |
| Alloy 36 | Hf | 1150° C. | 30 ksi | 1 Hour |
| Alloy 37 | Hf | 1150° C. | 30 ksi | 1 Hour |
| Alloy 38 | Hf | 1150° C. | 30 ksi | 1 Hour |
| Alloy 39 | Hf | 1150° C. | 30 ksi | 1 Hour |
| Alloy 40 | Hf | 1150° C. | 30 ksi | 1 Hour |
| Alloy 41 | Hf | 1150° C. | 30 ksi | 1 Hour |
| Alloy 42 | Hf | 1150° C. | 30 ksi | 1 Hour |

Tensile specimens were cut from HIPed plates by Electric Discharge Machining (EDM). Some of the tensile specimens were heat treated according to the heat treatment schedule in Table 27. Heat treatments were performed using a Lindberg Blue furnace. In a case of air cooling, the specimens were held at the target temperature for a target period of time, removed from the furnace and cooled down in air. In a case of slow cooling, the specimens were heated to the target temperature and then cooled with the furnace at cooling rate of 1° C./min. Heat treated specimens were then tested to determine tensile properties of the selected alloys.

TABLE 27

Heat Treatment Schedule for Case Study Alloys

| Heat Treatment | Temperature | Dwell Time | Cooling |
|---|---|---|---|
| HT2 | 700° C. | 1 Hour | Air Cooling |
| HT3 | 700° C. | N/A | 1° C./min Slow Cool |
| HT4 | 850° C. | 1 Hour | Air Cooling |

Tensile testing was performed on an Instron Model 3369 mechanical testing frame, using the Instron Bluehill control and analysis software. Samples were tested at room temperature under displacement control at a strain rate of $1\times10^{-3}$ per second. Samples were mounted to a stationary bottom fixture, and a top fixture attached to a moving crosshead. A 50 kN load cell was attached to the top fixture to measure load. Strain measurements were made using an advanced video extensometer (AVE). Tensile results for the study are tabulated in Table 28. As can be seen from the results table, tensile strength in the examined alloys ranged from 753 to 1511 MPa. It is useful to note that the ceramics used in the production of sheets for the indicated case examples (e.g. ceramic crucibles) were not optimized for these manganese containing melts. This resulted in some ceramic entrainment in the melt creating defects which lowered the ductility in some cases. Higher ductility is expected by changing the ceramics used in melting. Total elongation values ranged from 2.0% to 28.0%. Strain hardening exponents were calculated as an average value, using a strain range beginning with the yield point and ending with the point corresponding to the ultimate tensile strength. Example tensile curves have been provided in FIG. 65 showing variation in alloy mechanical response depending on alloy chemistry and processing conditions.

TABLE 28

Tensile Properties of Manganese Containing Alloys

| Alloy | HIP Cycle | Heat Treatment | Yield Stress (MPa) | Ultimate Strength (MPa) | Tensile Elongation (%) | Elastic Modulus (GPa) | Strain Hardening Exponent | Type of Behavior |
|---|---|---|---|---|---|---|---|---|
| Alloy 25 | Hf | None | 472 | 1020 | 10.8 | 169 | 0.57 | Class 2 |
| | | | 473 | 914 | 9.8 | 213 | 0.54 | Class 2 |
| | | | 484 | 1045 | 11.5 | 183 | 0.56 | Class 2 |
| | | HT2 | 507 | 1244 | 14.4 | 183 | 0.69 | Class 2 |
| | | | 505 | 1247 | 13.9 | 184 | 0.71 | Class 2 |
| | | HT3 | 492 | 1204 | 13.2 | 177 | 0.70 | Class 2 |
| | | | 500 | 1076 | 10.7 | 187 | 0.65 | Class 2 |
| | | HT4 | 505 | 1095 | 12.2 | 150 | 0.62 | Class 2 |
| | | | 525 | 1288 | 16.8 | 174 | 0.69 | Class 2 |
| Alloy 26 | Hf | None | 651 | 1018 | 8.7 | 132 | 0.28 | Class 2 |
| | | | 642 | 990 | 7.4 | 187 | 0.25 | Class 2 |
| | | HT2 | 502 | 973 | 7.7 | 143 | 0.26 | Class 2 |
| | | | 624 | 846 | 4.6 | 192 | 0.14 | Class 2 |
| | | HT3 | 617 | 753 | 2.0 | 172 | 0.15 | Class 1 |
| | | | 616 | 889 | 4.8 | 279 | 0.13 | Class 1 |
| | | HT4 | 634 | 1151 | 14.9 | 200 | 0.32 | Class 2 |
| Alloy 27 | Hf | None | 585 | 1196 | 14.1 | 189 | 0.46 | Class 2 |
| | | HT2 | 548 | 1124 | 11.9 | 172 | 0.47 | Class 2 |
| | | | 567 | 1235 | 15.3 | 167 | 0.49 | Class 2 |
| | | HT3 | 582 | 1131 | 11.2 | 190 | 0.46 | Class 2 |
| | | | 611 | 983 | 8.1 | 175 | 0.32 | Class 2 |
| | | HT4 | 626 | 1200 | 18.2 | 161 | 0.41 | Class 2 |
| | | | 556 | 1098 | 11.4 | 177 | 0.41 | Class 2 |
| Alloy 28 | Hf | None | 552 | 779 | 2.7 | 223 | 0.20 | Class 1 |
| | | | 657 | 878 | 3.5 | 222 | 0.14 | Class 1 |
| | | HT2 | 648 | 1083 | 10.4 | 180 | 0.29 | Class 2 |
| | | HT3 | 671 | 846 | 2.1 | 207 | 0.16 | Class 1 |
| | | | 633 | 851 | 2.7 | 225 | 0.14 | Class 1 |
| | | HT4 | 601 | 1094 | 12.7 | 232 | 0.31 | Class 2 |
| Alloy 29 | Hf | None | 1038 | 1239 | 2.4 | 139 | 0.19 | Class 2 |
| | | | 573 | 996 | 2.5 | 184 | 0.38 | Class 2 |
| | | HT2 | 558 | 1254 | 10.7 | 162 | 0.37 | Class 2 |
| | | HT3 | 665 | 964 | 3.1 | 206 | 0.24 | Class 2 |
| | | | 702 | 1280 | 9.2 | 183 | 0.33 | Class 2 |
| | | HT4 | 556 | 1227 | 6.8 | 187 | 0.61 | Class 2 |
| | | | 573 | 1129 | 5.5 | 148 | 0.61 | Class 2 |
| Alloy 30 | Hf | None | 459 | 1203 | 13.0 | 155 | 0.82 | Class 2 |
| | | | 474 | 1341 | 17.7 | 126 | 0.82 | Class 2 |
| | | | 466 | 1275 | 14.3 | 153 | 0.82 | Class 2 |
| | | HT2 | 432 | 1348 | 18.3 | 148 | 0.80 | Class 2 |
| | | | 450 | 1323 | 16.2 | 160 | 0.85 | Class 2 |
| | | HT3 | 445 | 768 | 7.5 | 186 | 0.40 | Class 2 |
| | | | 448 | 1356 | 20.6 | 153 | 0.77 | Class 2 |
| | | | 425 | 1156 | 13.4 | 147 | 0.77 | Class 2 |
| | | HT4 | 437 | 1115 | 12.0 | 149 | 0.80 | Class 2 |
| | | | 420 | 1355 | 17.5 | 185 | 0.83 | Class 2 |
| | | | 429 | 1021 | 10.5 | 160 | 0.69 | Class 2 |
| Alloy 31 | Hf | None | 650 | 1330 | 4.5 | 194 | 0.37 | Class 2 |
| | | | 676 | 1373 | 7.4 | 179 | 0.32 | Class 2 |
| | | HT2 | 661 | 1169 | 5.7 | 198 | 0.31 | Class 2 |
| | | HT3 | 732 | 973 | 2.7 | 204 | 0.18 | Class 1 |
| | | | 790 | 1011 | 2.7 | 239 | 0.15 | Class 1 |
| | | HT4 | 481 | 1160 | 4.0 | 184 | 0.47 | Class 2 |
| | | | 469 | 1139 | 4.6 | 174 | 0.55 | Class 2 |
| | | | 502 | 1245 | 6.0 | 163 | 0.49 | Class 2 |
| Alloy 32 | Hf | None | 432 | 1391 | 10.6 | 127 | 0.94 | Class 2 |
| | | | 454 | 1381 | 8.8 | 198 | 0.89 | Class 2 |
| | | HT2 | 431 | 1423 | 13.3 | 196 | 0.91 | Class 2 |
| | | | 418 | 1434 | 12.6 | 142 | 0.92 | Class 2 |
| | | | 366 | 872 | 5.4 | 160 | 0.67 | Class 2 |
| | | HT3 | 410 | 1390 | 9.6 | 153 | 0.94 | Class 2 |
| | | | 384 | 1421 | 13.2 | 149 | 0.90 | Class 2 |
| | | | 398 | 1418 | 9.4 | 152 | 0.95 | Class 2 |
| | | HT4 | 398 | 1444 | 15.8 | 155 | 0.92 | Class 2 |
| | | | 451 | 1431 | 13.9 | 187 | 0.97 | Class 2 |
| | | | 444 | 1349 | 9.9 | 155 | 0.98 | Class 2 |

TABLE 28-continued

Tensile Properties of Manganese Containing Alloys

| Alloy | HIP Cycle | Heat Treatment | Yield Stress (MPa) | Ultimate Strength (MPa) | Tensile Elongation (%) | Elastic Modulus (GPa) | Strain Hardening Exponent | Type of Behavior |
|---|---|---|---|---|---|---|---|---|
| Alloy 33 | Hf | None | 657 | 1100 | 5.1 | 211 | 0.27 | Class 1 |
| | | | 743 | 1064 | 4.3 | 225 | 0.19 | Class 1 |
| | | HT2 | 701 | 1100 | 11.5 | 235 | 0.21 | Class 1 |
| | | HT3 | 749 | 1013 | 3.4 | 224 | 0.19 | Class 1 |
| | | | 680 | 983 | 2.8 | 243 | 0.22 | Class 1 |
| | | HT4 | 697 | 1080 | 7.6 | 238 | 0.20 | Class 1 |
| Alloy 34 | Hf | None | 440 | 1228 | 18.8 | 137 | 0.77 | Class 2 |
| | | | 438 | 1236 | 18.9 | 185 | 0.70 | Class 2 |
| | | | 449 | 1273 | 21.1 | 152 | 0.73 | Class 2 |
| | | HT2 | 418 | 1124 | 15.0 | 169 | 0.73 | Class 2 |
| | | | 438 | 1222 | 18.2 | 183 | 0.72 | Class 2 |
| | | | 430 | 1278 | 25.6 | 137 | 0.76 | Class 2 |
| | | HT3 | 435 | 1193 | 16.9 | 172 | 0.72 | Class 2 |
| | | | 421 | 1261 | 26.7 | 147 | 0.75 | Class 2 |
| | | | 426 | 1262 | 20.4 | 141 | 0.73 | Class 2 |
| | | | 460 | 1208 | 17.7 | 129 | 0.76 | Class 2 |
| | | HT4 | 425 | 1180 | 17.2 | 141 | 0.76 | Class 2 |
| | | | 426 | 1194 | 17.6 | 159 | 0.74 | Class 2 |
| | | | 443 | 1148 | 16.3 | 135 | 0.70 | Class 2 |
| | | | 460 | 1292 | 28.0 | 103 | 0.74 | Class 2 |
| Alloy 35 | Hf | None | 526 | 927 | 11.2 | 183 | 0.31 | Class 2 |
| | | | 580 | 1114 | 17.2 | 227 | 0.44 | Class 2 |
| | | | 583 | 1162 | 19.3 | 168 | 0.44 | Class 2 |
| | | HT2 | 501 | 1024 | 13.2 | 197 | 0.53 | Class 2 |
| | | | 518 | 978 | 12.1 | 186 | 0.48 | Class 2 |
| | | | 541 | 972 | 11.9 | 116 | 0.41 | Class 2 |
| | | HT3 | 564 | 856 | 8.0 | 185 | 0.26 | Class 2 |
| | | | 594 | 1095 | 14.6 | 195 | 0.45 | Class 2 |
| | | | 561 | 1047 | 12.8 | 219 | 0.43 | Class 2 |
| | | HT4 | 571 | 1168 | 18.4 | 194 | 0.49 | Class 2 |
| | | | 594 | 1046 | 12.6 | 176 | 0.43 | Class 2 |
| | | | 584 | 990 | 11.7 | 202 | 0.39 | Class 2 |
| Alloy 36 | Hf | None | 440 | 1210 | 20.8 | 155 | 0.70 | Class 2 |
| | | | 461 | 1169 | 18.2 | 193 | 0.68 | Class 2 |
| | | HT2 | 441 | 952 | 12.3 | 199 | 0.57 | Class 2 |
| | | | 435 | 1084 | 15.2 | 194 | 0.63 | Class 2 |
| | | | 472 | 1200 | 20.1 | 114 | 0.71 | Class 2 |
| | | HT3 | 412 | 996 | 13.5 | 258 | 0.60 | Class 2 |
| | | | 434 | 1205 | 23.1 | 176 | 0.68 | Class 2 |
| | | | 463 | 1029 | 14.3 | 149 | 0.60 | Class 2 |
| | | HT4 | 463 | 1243 | 27.1 | 126 | 0.67 | Class 2 |
| | | | 455 | 1166 | 18.9 | 131 | 0.69 | Class 2 |
| | | | 424 | 1194 | 19.7 | 192 | 0.71 | Class 2 |
| | | | 437 | 1243 | 26.7 | 194 | 0.66 | Class 2 |
| Alloy 37 | Hf | None | 539 | 1181 | 15.4 | 166 | 0.61 | Class 2 |
| | | | 563 | 1178 | 15.7 | 145 | 0.58 | Class 2 |
| | | HT2 | 541 | 1186 | 16.4 | 194 | 0.56 | Class 2 |
| | | | 510 | 1180 | 17.0 | 187 | 0.56 | Class 2 |
| | | HT3 | 542 | 1204 | 18.1 | 186 | 0.55 | Class 2 |
| | | | 503 | 1185 | 15.0 | 228 | 0.59 | Class 2 |
| | | | 519 | 1015 | 9.5 | 220 | 0.53 | Class 2 |
| | | HT4 | 523 | 1114 | 12.5 | 156 | 0.59 | Class 2 |
| | | | 582 | 1200 | 19.0 | 116 | 0.53 | Class 2 |
| | | | 553 | 1187 | 17.5 | 168 | 0.51 | Class 2 |
| Alloy 38 | Hf | None | 465 | 1319 | 9.0 | 157 | 0.84 | Class 2 |
| | | | 437 | 1275 | 8.1 | 256 | 0.88 | Class 2 |
| | | HT2 | 418 | 1347 | 12.9 | 127 | 0.82 | Class 2 |
| | | | 407 | 1304 | 11.3 | 182 | 0.94 | Class 2 |
| | | HT3 | 435 | 1279 | 6.1 | 157 | 0.85 | Class 2 |
| | | | 419 | 1289 | 13.3 | 184 | 0.80 | Class 2 |
| | | | 431 | 1312 | 11.9 | 185 | 0.81 | Class 2 |
| | | HT4 | 433 | 1354 | 10.6 | 139 | 0.99 | Class 2 |
| | | | 434 | 1342 | 12.5 | 181 | 0.95 | Class 2 |
| Alloy 39 | Hf | None | 454 | 787 | 8.9 | 204 | 0.44 | Class 2 |
| | | | 443 | 1065 | 14.3 | 166 | 0.68 | Class 2 |
| | | | 458 | 1132 | 16.1 | 177 | 0.70 | Class 2 |
| | | HT2 | 452 | 1011 | 12.6 | 190 | 0.66 | Class 2 |
| | | | 445 | 996 | 12.3 | 190 | 0.65 | Class 2 |
| | | HT3 | 457 | 1273 | 23.9 | 157 | 0.72 | Class 2 |
| | | | 448 | 1296 | 23.8 | 161 | 0.70 | Class 2 |
| | | | 446 | 1277 | 20.9 | 159 | 0.74 | Class 2 |
| | | | 424 | 1159 | 16.6 | 181 | 0.80 | Class 2 |

TABLE 28-continued

| Tensile Properties of Manganese Containing Alloys | | | | | | | | |
|---|---|---|---|---|---|---|---|---|
| Alloy | HIP Cycle | Heat Treatment | Yield Stress (MPa) | Ultimate Strength (MPa) | Tensile Elongation (%) | Elastic Modulus (GPa) | Strain Hardening Exponent | Type of Behavior |
| | | HT4 | 466 | 1092 | 14.8 | 184 | 0.68 | Class 2 |
| | | | 437 | 1163 | 17.0 | 163 | 0.74 | Class 2 |
| | | | 444 | 954 | 12.1 | 180 | 0.60 | Class 2 |
| Alloy 40 | Hf | None | 661 | 1492 | 5.3 | 155 | 0.42 | Class 2 |
| | | | 669 | 1511 | 9.9 | 203 | 0.36 | Class 2 |
| | | | 673 | 1510 | 8.1 | 225 | 0.35 | Class 2 |
| | | HT2 | 617 | 1306 | 7.5 | 224 | 0.48 | Class 2 |
| | | | 638 | 1343 | 11.5 | 193 | 0.42 | Class 2 |
| | | | 648 | 1325 | 8.8 | 191 | 0.44 | Class 2 |
| | | HT3 | 802 | 1383 | 7.9 | 193 | 0.33 | Class 2 |
| | | | 830 | 1368 | 8.2 | 186 | 0.31 | Class 2 |
| | | | 830 | 1408 | 11.4 | 186 | 0.30 | Class 2 |
| | | | 815 | 1391 | 8.9 | 201 | 0.32 | Class 2 |
| | | HT4 | 416 | 1357 | 10.1 | 183 | 0.89 | Class 2 |
| | | | 402 | 1390 | 11.4 | 153 | 0.87 | Class 2 |
| | | | 401 | 1356 | 7.3 | 204 | 0.98 | Class 2 |
| | | | 425 | 1399 | 13.4 | 213 | 0.88 | Class 2 |
| Alloy 41 | Hf | None | 447 | 1372 | 13.7 | 161 | 0.49 | Class 2 |
| | | | 458 | 1029 | 8.9 | 155 | 0.37 | Class 2 |
| | | HT2 | 409 | 1150 | 8.7 | 164 | 0.95 | Class 2 |
| | | | 401 | 1372 | 16.4 | 150 | 0.88 | Class 2 |
| | | HT3 | 387 | 937 | 7.2 | 142 | 0.69 | Class 2 |
| | | | 395 | 1386 | 14.6 | 179 | 0.86 | Class 2 |
| | | | 394 | 1180 | 9.1 | 192 | 0.97 | Class 2 |
| | | HT4 | 441 | 1319 | 11.4 | 131 | 0.96 | Class 2 |
| | | | 446 | 810 | 6.9 | 132 | 0.74 | Class 2 |
| | | | 438 | 1366 | 14.9 | 123 | 0.98 | Class 2 |
| Alloy 42 | Hf | None | 583 | 1244 | 10.7 | 174 | 0.59 | Class 2 |
| | | | 596 | 924 | 5.6 | 164 | 0.38 | Class 2 |
| | | HT2 | 579 | 1188 | 8.1 | 179 | 0.56 | Class 2 |
| | | | 572 | 1202 | 9.8 | 213 | 0.54 | Class 2 |
| | | | 531 | 1135 | 7.0 | 246 | 0.61 | Class 2 |
| | | HT3 | 382 | 1171 | 7.8 | 172 | 0.66 | Class 2 |
| | | | 585 | 992 | 5.2 | 192 | 0.51 | Class 2 |
| | | | 625 | 1047 | 6.0 | 119 | 0.51 | Class 2 |
| | | HT4 | 593 | 1085 | 7.9 | 206 | 0.43 | Class 2 |
| | | | 574 | 1196 | 13.0 | 199 | 0.45 | Class 2 |
| | | | 619 | 779 | 3.5 | 193 | 0.17 | Class 2 |

Case Example #19

Melt-Spinning Study on Additional Alloys

Melt-spinning is an example of chill surface processing in which high cooling rates, higher than either thin slab or twin-roll casting, may be achieved. The required charge size is small and the process is faster compared to the other formerly noted processes. Thus, it is useful tool for quickly examining the potential of an alloy for chill surface processing. Using high purity elements, 15 g charges of the alloys listed in Table 29 were weighed. Charges were then placed into the copper hearth of an arc-melting system. The charge was arc-melted into an ingot using high purity argon as a shielding gas. The ingots were flipped several times and re-melted to ensure homogeneity. After mixing, the ingots were then cast in the form of a finger approximately 12 mm wide by 30 mm long and 8 mm thick. The resulting fingers were then placed in a melt-spinning chamber in a quartz crucible with an orifice diameter of ~0.81 mm.

TABLE 29

| Alloy Chemistries | | | | | | | |
|---|---|---|---|---|---|---|---|
| Alloy | Fe | Cr | Ni | B | Si | Mn | C |
| Alloy 43 | 62.38 | 17.40 | 7.92 | 7.40 | 4.20 | 0.50 | 0.20 |
| Alloy 44 | 65.99 | 13.58 | 6.58 | 7.60 | 4.40 | 1.50 | 0.35 |

TABLE 29-continued

| Alloy Chemistries | | | | | | | |
|---|---|---|---|---|---|---|---|
| Alloy | Fe | Cr | Ni | B | Si | Mn | C |
| Alloy 45 | 58.76 | 17.22 | 9.77 | 7.80 | 4.60 | 1.30 | 0.55 |
| Alloy 46 | 58.95 | 11.35 | 13.40 | 8.00 | 4.80 | 1.25 | 2.25 |
| Alloy 47 | 62.28 | 10.00 | 12.56 | 4.80 | 8.00 | 2.00 | 0.36 |
| Alloy 48 | 53.82 | 20.22 | 11.60 | 4.60 | 7.80 | 0.75 | 1.21 |
| Alloy 49 | 61.21 | 21.00 | 4.90 | 4.40 | 7.60 | 0.00 | 0.89 |
| Alloy 50 | 62.00 | 17.50 | 6.25 | 4.20 | 7.40 | 0.10 | 2.55 |
| Alloy 51 | 59.71 | 14.30 | 13.74 | 4.00 | 7.20 | 0.40 | 0.65 |
| Alloy 52 | 57.85 | 13.90 | 12.25 | 7.00 | 7.00 | 1.75 | 0.25 |
| Alloy 53 | 56.90 | 15.25 | 14.50 | 6.00 | 6.00 | 1.35 | 0.00 |
| Alloy 54 | 65.82 | 12.22 | 7.22 | 5.00 | 6.00 | 1.14 | 2.60 |
| Alloy 55 | 58.72 | 18.26 | 8.99 | 4.26 | 7.22 | 1.55 | 1.00 |
| Alloy 56 | 61.30 | 17.30 | 6.50 | 7.15 | 4.55 | 0.20 | 3.00 |
| Alloy 57 | 65.80 | 14.89 | 8.66 | 4.35 | 4.05 | 0.00 | 2.25 |
| Alloy 58 | 63.99 | 12.89 | 10.25 | 8.00 | 4.22 | 0.65 | 0.00 |
| Alloy 59 | 71.24 | 10.55 | 5.22 | 7.55 | 4.55 | 0.89 | 0.00 |
| Alloy 60 | 61.88 | 11.22 | 12.55 | 7.45 | 5.22 | 1.12 | 0.56 |

The density of the alloys was measured on arc-melt ingots using the Archimedes method in a balance allowing weighing in both air and distilled water. The density of each alloy is tabulated in Table 30 and was found to vary from 7.45 g/cm$^3$ to 7.71 g/cm$^3$. Experimental results have revealed that the accuracy of this technique is ±0.01 g/cm$^3$.

TABLE 30

| Summary of Density Results ($g/cm^3$) | |
|---|---|
| Alloy | Density (avg) |
| Alloy 43 | 7.66 |
| Alloy 44 | 7.65 |
| Alloy 45 | 7.63 |
| Alloy 46 | 7.67 |
| Alloy 47 | 7.62 |
| Alloy 48 | 7.54 |
| Alloy 49 | 7.45 |
| Alloy 50 | 7.54 |
| Alloy 51 | 7.64 |
| Alloy 52 | 7.60 |
| Alloy 53 | 7.67 |
| Alloy 54 | 7.61 |
| Alloy 55 | 7.57 |
| Alloy 56 | 7.59 |
| Alloy 57 | 7.66 |
| Alloy 58 | 7.71 |
| Alloy 59 | 7.54 |
| Alloy 60 | 7.67 |

The arc-melted fingers were then placed into a melt-spinning chamber in a quartz crucible with a orifice diameter of ~0.81 mm. The ingots were then processed by melting in different atmosphere using RF induction and then ejected onto a 245 mm diameter copper wheel which was traveling at a tangential velocity at 20 m/s. Continuous ribbons with thicknesses between 41 μm and 59 μm were produced. The quality of ribbon produced varied by alloy with some alloys providing more uniform cross-sections than others.

Differential Thermal Analysis (DTA) was performed on the as-solidified ribbon using a Netzsch DSC 404 F3 Pegasus system. Scans were performed at a constant heating rate of 10° C./minute from 100° C. to 1410° C. with an ultrahigh purity argon purge gas to protect samples from oxidation as shown in Table 31. As shown, some ribbons (melt-spun at 20 m/s) contained small fractions of metallic glass while others did not. Based on the thickness of the ribbon produced, the estimated cooling rates were $3\times10^5$ to $6\times10^5$K/s which is beyond the cooling rates identified for sheet as described previously. For the alloys in this case example, melting was found to occur with one to three distinct melting peaks. The solidus ranged between 1138° C. and 1230° C. with melting events observed up to 1374° C.

TABLE 31

| Differential Thermal Analysis Data for Melting Behavior | | | | | |
|---|---|---|---|---|---|
| Alloy | Metallic Glass Present | Solidus (° C.) | Peak 1 (° C.) | Peak 2 (° C.) | Peak 3 (° C.) |
| Alloy 43 | No | 1241 | 1256 | 1264 | 1271 |
| Alloy 44 | Yes | 1221 | 1244 | 1250 | — |
| Alloy 45 | Yes | 1227 | 1245 | 1260 | 1270 |
| Alloy 46 | Yes | 1138 | 1155 | 1205 | 1218 |
| Alloy 47 | No | 1185 | 1215 | 1241 | 1313 |
| Alloy 48 | No | 1216 | 1252 | — | — |
| Alloy 49 | No | 1208 | 1223 | 1273 | — |
| Alloy 50 | No | 1180 | 1197 | 1218 | — |
| Alloy 51 | No | 1218 | 1244 | 1302 | 1349 |
| Alloy 52 | Yes | 1198 | 1215 | 1240 | 1245 |
| Alloy 53 | No | 1221 | 1242 | 1248 | 1252 |
| Alloy 54 | No | 1157 | 1173 | — | — |
| Alloy 55 | No | 1230 | 1255 | — | — |
| Alloy 56 | Yes | 1180 | 1198 | 1248 | — |
| Alloy 57 | No | 1226 | 1250 | 1374 | — |
| Alloy 58 | Yes | 1215 | 1238 | 1243 | 1251 |
| Alloy 59 | No | 1211 | 1226 | 1240 | — |
| Alloy 60 | Yes | 1193 | 1228 | 1236 | 1292 |

The mechanical properties of metallic ribbons were measured at room temperature using uniaxial tensile testing. The testing was carried out in a commercial tensile stage made by Fullam which was monitored and controlled by a MTEST Windows software program. Deformation was applied by a stepping motor through the gripping system while the load was measured by a load cell which was connected to the end of one gripping jaw. Displacement was measured using a Linear Variable Differential Transformer (LVDT) which was attached to the two gripping jaws to measure the change of gauge length. Before testing, the thickness and width of a ribbon were carefully measured for at least three times at different locations in the gauge length. The average values were then recorded as gauge thickness and width, and used as input parameters for subsequent stress and strain calculations. The initial gauge length for tensile testing was set at ~9 mm with the exact value determined after the ribbon was fixed by measuring the ribbon span between the front faces of the two gripping jaws.

All tests were performed under displacement control, with a strain rate of ~$0.001s^{-1}$. Three tests were performed for each bendable ribbon while one to three tests were performed on non-bendable ribbons. A summary of the tensile test results including total elongation, yield strength, and ultimate tensile strength are shown in Table 32. The tensile strength values varied from 282 to 2072 MPa. The total elongation value varied from 0.37 to 6.56% indicating limited ductility of alloys in as-cast state for most samples. Some samples failure occurred in elastic region without yielding while others showed clear ductility such Alloy 47 shown in FIG. 66. Considerable variability exists in the mechanical properties of these ribbons as this variability is caused in part by irregularities in sample geometry and microstructural defects which means that the tensile properties are lower than expected in sheet form. Additionally, for alloys which contained metallic glass (i.e. 44, 45, 46, 52, 56, 58, and 60), it can be seen that the mechanical properties especially the ductility were lowered. Thus, it is clear that the favorable structures and mechanisms in this application are for crystalline structures and not partial or full metallic glass.

TABLE 32

| Summary on Tensile Properties of Melt-Spun Ribbons at 20 m/s | | | |
|---|---|---|---|
| Alloy | Yield Stress (MPa) | Ultimate Strength (MPa) | Tensile Elongation (%) |
| Alloy 43 | 1663 | 2072 | 3.63 |
| | 1225 | 1611 | 3.37 |
| | 1241 | 1618 | 3.13 |
| Alloy 44 | 904 | 1085 | 1.08 |
| Alloy 45 | 282 | 282 | 0.37 |
| Alloy 46 | 1958 | 2019 | 2.59 |
| Alloy 47 | 630 | 920 | 6.38 |
| | 695 | 963 | 4.96 |
| | 617 | 824 | 2.84 |
| Alloy 48 | 997 | 1303 | 4.17 |
| | 1082 | 1390 | 2.27 |
| | 1071 | 1369 | 3.40 |
| Alloy 49 | 1018 | 1252 | 3.92 |
| | 1049 | 1151 | 2.47 |
| | 1047 | 1133 | 2.13 |
| Alloy 50 | 904 | 991 | 1.22 |
| | 1024 | 1074 | 1.27 |
| | 981 | 1127 | 2.02 |
| Alloy 51 | 624 | 892 | 5.39 |
| | 599 | 846 | 4.67 |
| | 613 | 911 | 6.56 |

TABLE 32-continued

| Summary on Tensile Properties of Melt-Spun Ribbons at 20 m/s | | | |
|---|---|---|---|
| Alloy | Yield Stress (MPa) | Ultimate Strength (MPa) | Tensile Elongation (%) |
| Alloy 52 | | Not tested (brittle) | |
| Alloy 53 | 946 | 1265 | 4.49 |
| | 937 | 1130 | 2.79 |
| | 851 | 1251 | 4.80 |
| Alloy 54 | 1077 | 1218 | 1.77 |
| | 1142 | 1386 | 2.57 |
| | 1098 | 1244 | 1.98 |
| Alloy 55 | 915 | 1172 | 4.07 |
| | 869 | 1147 | 5.90 |
| | 938 | 1200 | 4.57 |
| Alloy 56 | 998 | 998 | 1.22 |
| Alloy 57 | 804 | 1123 | 3.13 |
| | 688 | 1038 | 5.13 |
| | 686 | 862 | 2.07 |
| Alloy 58 | 1001 | 1298 | 1.70 |
| Alloy 59 | 1159 | 1627 | 4.67 |
| | 1260 | 1638 | 2.35 |
| | 1391 | 1512 | 1.92 |
| Alloy 60 | 695 | 888 | 0.88 |

Applications

The alloys herein in either forms as Class 1 or Class 2 Steel have a variety of applications. These include but are not limited to structural components in vehicles, including but not limited to parts and components in the vehicular frame, front end structures, floor panels, body side interior, body side outer, rear structures, as well as roof and side rails. While not all encompassing, specific parts and components would include B-pillar major reinforcement, B-pillar belt reinforcement, front rails, rear rails, front roof header, rear roof header, A-pillar, roof rail, C-pillar, roof panel inners, and roof bow. The Class 1 and/or Class 2 steel will therefore be particular useful in optimizing crash worthiness management in vehicular design and allow for optimization of key energy management zones, including engine compartment, passenger and/or trunk regions where the strength and ductility of the disclosed steels will be particular advantageous.

The alloys herein may also provide for use in additional non-vehicular applications, such as for drilling applications, which therefore may include use as a drill collars (a component that provides weight on a bit for drilling), drill pipe (hollow wall pipe used on drilling rigs to facilitate drilling), tool joints (i.e. the threaded ends of drill pipe) and wellheads (i.e. the component of a surface or an oil or gas well that provides the structural and pressure-containing interface for drilling and production equipment) including but not limited to ultra-deep and ultra-deep water and extended reach (ERD) well exploration.

The invention claimed is:

1. A method comprising:

supplying a metal alloy comprising Fe at a level of 53.5 to 72.1 atomic percent, Cr at 10.0 to 21.0 atomic percent, Ni at 2.8 to 14.50 atomic percent, B at 4.0 to 8.0 atomic percent, Si at 4.0 to 8.0 atomic percent;

melting said alloy and solidifying to provide a matrix grain size in the range of 500 nm to 20,000 nm and a boride grain size in the range of 25 nm to 500 nm;

mechanical stressing said alloy and/or heating to form at least one of the following grain size distributions and mechanical property profiles, wherein said boride grains provide pinning phases that resist coarsening of said matrix grains:

(a) matrix grain size in the range of 500 nm to 20,000 nm, boride grain size in the range of 25 nm to 500 nm, precipitation grain size in the range of 1 nm to 200 nm wherein said alloy indicates a yield strength of 300 MPa to 840 MPa, tensile strength of 630 MPa to 1100 MPa and tensile elongation of 10 to 40%; or (b) matrix grain size in the range of 100 nm to 2000 nm and boride grain size in the range of 25 nm to 500 nm which has a yield strength of 300 MPa to 600 MPa.

2. The method of claim 1 wherein said alloy includes one or more of the following:

V at 1.0 to 3.0 atomic percent;

Zr at 1.0 atomic percent;

C at 0.2 to 3.0 atomic percent;

W at 1.0 atomic percent; or

Mn at 0.2 to 4.6 atomic percent.

3. The method of claim 1 wherein said melting is achieved at temperatures in the range of 1100° C. to 2000° C. and solidification is achieved by cooling in the range of $11\times10^{3}$ to $4\times10^{-2}$ K/s.

4. The method of claim 1 wherein said alloy having said grain size distribution (b) is exposed to a stress that exceeds said yield strength of 300 MPa to 600 MPa wherein said grain size remains in the range of 100 nm to 2000 nm, said boride grain size remains in the range of 25 nm to 500 nm, along with the formation of precipitation grains of 1 nm to 200 nm wherein said precipitation grains include a hexagonal phase.

5. The method of claim 4 wherein said alloy indicates a tensile strength of 720 MPa to 1580 MPa and an elongation of 5% to 35%.

6. The method of claim 5 wherein said alloy indicates a strain hardening coefficient of 0.2 to 1.0.

7. The method of claim 1 wherein said alloy having said mechanical property profile and grain size distribution (a) or (b) is in the form of sheet.

8. The method of claim 4 wherein said alloy having said grain size in the range of 100 nm to 2000 nm, said boride grain size in the range of 25 nm to 500 nm, and said precipitation grains in the range of 1 nm to 200 nm wherein said precipitation grains include a hexagonal phase, is in the form of sheet.

9. The method of claim 1 wherein said alloy having said mechanical property profile and grain size distribution (a) is positioned in a vehicle.

10. The method of claim 5 wherein said alloy is positioned in a vehicle.

11. The method of claim 1 wherein said alloy having said mechanical property profile and grain size distribution is positioned in one of a drill collar, drill pipe, tool joint or wellhead.

12. The method of claim 5 wherein said alloy is positioned in one of a drill collar, drill pipe, tool joint or wellhead.

13. A method comprising:

supplying a metal alloy comprising Fe at a level of 53.5 to 72.1 atomic percent, Cr at 10.0 to 21.0 atomic percent, Ni at 2.8 to 14.50 atomic percent, B at 4.00 to 8.00 atomic percent, Si at 4.00 to 8.00 atomic percent;

melting said alloy and solidifying to provide a matrix grain size in the range of 500 nm to 20,000 nm containing 10% to 70% by volume ferrite and a boride grain size in the range of 25 nm to 500 nm wherein said boride grains provide pinning phases that resist coarsening of said matrix grains upon application of heat and wherein said alloy has a yield strength of 300 MPa to 600 MPa;

heating said alloy wherein said grain size is in the range of 100 nm to 2000 nm, said boride grain size remains in the range of 25 nm to 500 nm and said level of ferrite increases to 20% to 80% by volume;

stressing said alloy to a level that exceeds said yield strength of 300 MPa to 600 MPa wherein said grain size remains in the range at 100 nm to 2000 nm, said boride grain size remains in the range of 25 nm to 500 nm, along with the formation of precipitation grains in the range of 1 nm to 200 nm and said alloy has a tensile strength of 720 MPa to 1580 MPa and an elongation of 5% to 35%.

14. The method of claim 13 wherein said alloy includes one or more of the following:

V at 1.0 to 3.0 atomic percent;

Zr at 1.0 atomic percent;

C at 0.2 to 3.0 atomic percent;

W at 1.00 atomic percent; or

Mn at 0.20 to 4.6 atomic percent.

15. The method of claim 13 wherein said melting is achieved at temperature in the range of 1100° C. to 2000° C. and solidification is achieved by cooling in the range of $11\times10^{3}$ to $4\times10^{-2}$K/s.

16. The method of claim 13 wherein said alloy is in the form of sheet.

17. A metallic alloy comprising:

Fe at a level of 53.5 to 72.1 atomic percent;

Cr at 10.0 to 21.0 atomic percent;

Ni at 2.8 to 14.5 atomic percent;

B at 4.0 to 8.0 atomic percent;

Si at 4.0 to 8.0 atomic percent;

wherein said alloy indicates a matrix grain size in the range of 500 nm to 20,000 nm and a boride grain size in the range of 25 nm to 500 nm and wherein said alloy having been exposed to mechanical stress and/or heat to indicate at least one of the following:

(a) exposure to mechanical stress said alloy indicates a mechanical property profile providing a yield strength of 300 MPa to 840 MPa, tensile strength of 630 MPa to 1100 MPa, tensile elongation of 10 to 40%; or (b) exposure to heat, followed by mechanical stress, said alloy indicates a mechanical property profile providing a yield strength of 300 MPa to 1300 MPa, tensile strength of 720 MPa to 1580 MPa, tensile elongation of 5.0% to 35.0%.

18. The metallic alloy of claim 17 wherein said mechanical property profile (a) includes a strain hardening coefficient of 0.1 to 0.4.

19. The metallic alloy of claim 17 wherein said mechanical property profile (b) includes a strain hardening coefficient of 0.2 to 1.0.

20. The metallic alloy of claim 17 wherein said mechanical property profile (a) comprises the following grain size distribution: a matrix grain size in the range of 500 nm to 20,000 nm and a boride grain size in the range of 25 nm to 500 nm and a precipitation grain size in the range of 1.0 nm to 200 nm.

21. The metallic alloy of claim 17 wherein said mechanical property profile (b) comprise the following grain size distribution: a matrix grain size in the range of 100 nm to 2000 nm, a boride grain size in the range of 25 nm to 500 nm and precipitation grain size in the range of 1 nm to 200 nm.

22. The metallic alloy of claim 21 wherein said precipitation grain size of 1 nm to 200 nm includes a hexagonal phase.

23. The metallic alloy of claim 17 wherein said alloy includes one or more of the following:

V at 1.0 to 3.0 atomic percent;

Zr at 1.0 atomic percent;

C at 0.2 to 3.0 atomic percent;

W at 1.0 atomic percent; or

Mn at 0.2 to 4.6 atomic percent.

24. The alloy of claim 17 wherein said alloy recited in (a) or (b) is in the form of sheet material.

25. A metallic alloy comprising:

Fe at a level of 53.5 to 72.1 atomic percent;

Cr at 10.0 to 21.0 atomic percent;

Ni at 2.8 to 14.5 atomic percent;

B at 4.0 to 8.0 atomic percent;

Si at 4.0 to 8.0 atomic percent;

wherein said alloy indicates a matrix grain size in the range of 500 nm to 20,000 nm and a boride grain size in the range of 25 nm to 500 nm and wherein said alloy having been exposed to mechanical stress and/or heat to indicate at least one of the following:

(a) exposure to mechanical stress said alloy indicates a mechanical property profile providing a yield strength of 300 MPa to 840 MPa, tensile strength of 630 MPa to 1100 MPa, tensile elongation of 10% to 40%, and a matrix grain size in the range of 500 nm to 20,000 nm, a boride grain size in the range of 25 nm to 500 nm and a precipitation grain size in the range of 1.0 nm to 200 nm; or (b) exposure to heat followed by mechanical stress, said alloy indicates a mechanical property profile providing a yield strength of 300 MPa to 1300 MPa, tensile strength of 720 MPa to 1580 MPa, tensile elongation of 5% to 35% and a matrix grain size in the range of 100 nm to 2000 nm, a boride grain size in the range of 25 nm to 500 nm, and a precipitation grain size in the range of 1 nm to 200 nm.

26. The metallic alloy of claim 25 wherein said alloy includes one or more of the following:

V at 1.0 to 3.0 atomic percent;

Zr at 1.0 atomic percent;

C at 0.2 to 3.00 atomic percent;

W at 1.0 atomic percent; or

Mn at 0.20 to 4.6 atomic percent.

27. The alloy of claim 17 wherein said mechanical property profile (a) includes a strain hardening coefficient of 0.1 to 0.4 and said mechanical property profile (b) includes a strain hardening coefficient of 0.2 to 1.0.

* * * * *